US009306301B2

(12) United States Patent
Shimoji

(10) Patent No.: US 9,306,301 B2
(45) Date of Patent: Apr. 5, 2016

(54) WIRE-TO-BOARD CONNECTOR

(71) Applicant: JAPAN AVIATION ELECTRONICS INDUSTRY, LTD., Tokyo (JP)

(72) Inventor: Kenichi Shimoji, Tokyo (JP)

(73) Assignee: JAPAN AVIATION ELECTRONICS INDUSTRY, LTD., Tokyo (JP)

( * ) Notice: Subject to any disclaimer, the term of this patent is extended or adjusted under 35 U.S.C. 154(b) by 0 days.

(21) Appl. No.: 14/384,242

(22) PCT Filed: Jan. 30, 2013

(86) PCT No.: PCT/JP2013/000510
§ 371 (c)(1),
(2) Date: Sep. 10, 2014

(87) PCT Pub. No.: WO2013/145521
PCT Pub. Date: Oct. 3, 2013

(65) Prior Publication Data

US 2015/0050820 A1 Feb. 19, 2015

(30) Foreign Application Priority Data

Mar. 28, 2012 (JP) ..... 2012-074033

(51) Int. Cl.
*H01R 12/70* (2011.01)
*H01R 12/53* (2011.01)
(Continued)

(52) U.S. Cl.
CPC ..... *H01R 12/70* (2013.01); *H01R 12/53* (2013.01); *H01R 12/57* (2013.01); *H01R 12/7005* (2013.01); *H01R 12/712* (2013.01); *H01R 12/718* (2013.01); *H01R 12/75* (2013.01); *H01R 13/20* (2013.01); *H01R 2101/00* (2013.01)

(58) Field of Classification Search
CPC ..... H01R 12/55
See application file for complete search history.

(56) References Cited

U.S. PATENT DOCUMENTS 3,383,457 A * 5/1968 Schumacher et al. ..... 174/261
3,566,341 A * 2/1971 Skony ..... 439/685
(Continued)

FOREIGN PATENT DOCUMENTS

JP H5-15339 2/1993
JP 2004-303554 A 10/2004
(Continued)

OTHER PUBLICATIONS

International Search Report mailed Mar. 26, 2013 for International Patent Application PCT/JP2013/000510 filed Jan. 30, 2013.
(Continued)

*Primary Examiner* — James Harvey
(74) *Attorney, Agent, or Firm* — Maier & Maier, PLLC

(57) ABSTRACT

A wire-to-board connector includes a plug which is attached to a wire, and a receptacle which is mounted on a connector mounting surface of a board. The plug and the receptacle are each formed of metal, and the plug is mated with the receptacle to thereby connect the wire to the board. The wire-to-board connector has the following structure. A wire direction corresponding to a longitudinal direction of the wire in the vicinity of the plug when the plug is mated with the receptacle is parallel to the connector mounting surface of the board. A mating direction in which the plug is mated with the receptacle is a direction approaching the connector mounting surface of the board.

8 Claims, 36 Drawing Sheets

(51) Int. Cl.

| | |
|---|---|
| ***H01R 12/57*** | (2011.01) |
| ***H01R 12/71*** | (2011.01) |
| ***H01R 12/75*** | (2011.01) |
| *H01R 13/20* | (2006.01) |
| *H01R 101/00* | (2006.01) |

(56) References Cited

U.S. PATENT DOCUMENTS

| | | | | |
|---|---|---|---|---|
| 3,777,301 | A * | 12/1973 | Michaels | 439/749 |
| 4,056,299 | A * | 11/1977 | Paige | 439/439 |
| 5,246,384 | A * | 9/1993 | Sato | 439/585 |
| 5,482,477 | A | 1/1996 | Michael | |
| 5,709,574 | A * | 1/1998 | Bianca et al. | 439/858 |
| 6,302,709 | B1 * | 10/2001 | Ross | 439/78 |
| 7,357,651 | B2 * | 4/2008 | Minoura et al. | 439/82 |
| 7,841,860 | B1 * | 11/2010 | Chen | 439/65 |
| 9,039,429 | B2 * | 5/2015 | Shimoji | 439/81 |
| 2008/0305668 | A1 * | 12/2008 | Wu | 439/272 |
| 2009/0227143 | A1 * | 9/2009 | Ichimiya et al. | 439/620.15 |
| 2013/0303037 | A1 | 11/2013 | Shimoji | |
| 2014/0120783 | A1 * | 5/2014 | Bishop | 439/744 |

FOREIGN PATENT DOCUMENTS

| | | | |
|---|---|---|---|
| JP | 2010-021083 | A | 1/2010 |
| JP | 2010-186663 | A | 8/2010 |
| JP | 1885320 | B1 | 12/2011 |

OTHER PUBLICATIONS

Extended European Search Report dated Sep. 23, 2015, including the Supplementary European Search Report and the European Search Opinion, in connection with corresponding EP Application No. 13768161.5.

Chinese Office Action dated Jan. 12, 2016, in connection with corresponding CN Application No. 201380012206.X (partial English translation provided, 10 pgs).

* cited by examiner

[PRIOR ART]

WIRE-TO-BOARD CONNECTOR

RELATED APPLICATIONS

This application claims priority under 35 U.S.C. §371 to International Patent Application No. PCT/JP2013/000510 filed Jan. 30, 2013 and Japanese Patent Application No. 2012-074033 filed Mar. 28, 2012, the disclosures of which are incorporated by reference herein in their entirety.

TECHNICAL FIELD

The present invention relates to a wire-to-board connector.

BACKGROUND ART

As a technique of this type, Patent Literature 1 discloses a structure in which a wire-side fast-on tab terminal 603 with a wire 602 is connected to a low-height type surface mounting fast-on tab terminal 601 which is mounted on the surface of a board 600, as shown in FIG. 36 of this application. As indicated by the thick arrow in FIG. 36, the direction in which the wire-side fast-on tab terminal 603 is connected to the low-height type surface mounting fast-on tab terminal 601 is designed to be parallel to the board 600, thereby suppressing the mounting height.

CITATION LIST

Patent Literature

[Patent Literature 1] Japanese Unexamined Patent Application Publication No. 2010-186663

SUMMARY OF INVENTION

Technical Problem

However, in the structure disclosed in Patent Literature 1 described above, the workability significantly deteriorates with increased miniaturization of the connector itself It is an object of the present invention to provide a wire-to-board connector with excellent workability.

Solution to Problem

According to an aspect of the present invention, there is provided a wire-to-board connector including: a first terminal that is attached to a wire; and a second terminal that is mounted on a connector mounting surface of a board, the first terminal and the second terminal being each formed of metal, and the first terminal being mated with the second terminal to thereby connect the wire to the board. When the first terminal is mated with the second terminal, a wire direction corresponding to a longitudinal direction of the wire in the vicinity of the first terminal is parallel to the connector mounting surface of the board, and a mating direction in which the first terminal is mated with the second terminal is a direction approaching the connector mounting surface of the board.

Preferably, the mating direction is a direction orthogonal to the connector mounting surface of the board.

Preferably, the second terminal includes a base plate portion opposed to the connector mounting surface of the board, and a pair of side plate portions that sandwich the first terminal mated with the second terminal in a wire orthogonal direction orthogonal to the wire direction.

Preferably, the second terminal includes a guide rod portion extending so as to be away from the connector mounting surface of the board, and the first terminal has a guide hole portion into which the guide rod portion is inserted.

Preferably, the first terminal includes a pair of contact beams having a beam shape, and the second terminal includes a contact piece that is inserted between the pair of contact beams.

Preferably, the pair of contact beams is formed in a cantilever shape.

Preferably, the contact piece is formed so as to be away from the base plate portion.

Preferably, the contact piece is supported by one of the pair of side plate portions.

Preferably, the first terminal includes a flat plate-like pushing plate portion that is disposed opposite to the board with the pair of contact beams interposed therebetween and is orthogonal to the mating direction.

Preferably, at least one of the first terminal and the second terminal has a lock mechanism that prevents disengagement of the first terminal from the second terminal.

Preferably, the second terminal includes a pair of lock beams that are respectively supported by the pair of side plate portions and extend in a beam shape in the wire direction, and a pair of claw portions that are respectively supported by the pair of lock beams and protrude so as to approach each other; the first terminal is formed to be caught on the pair of claw portions of the second terminal when the first terminal is mated with the second terminal; and the pair of lock beams and the pair of claw portions constitute the lock mechanism.

Preferably, the first terminal includes a central conductor holding portion that holds a central conductor of the wire, and the central conductor holding portion of the first terminal is formed to be caught on the pair of claw portions of the second terminal when the first terminal is mated with the second terminal.

Preferably, the second terminal includes a pair of inclined portions that are respectively connected to the pair of side plate portions and are inclined so as to be gradually spaced apart from each other in a direction away from the connector mounting surface of the board.

Advantageous Effects of Invention

According to the present invention, a first terminal can be mated with a second terminal with excellent workability.

DESCRIPTION OF EMBODIMENTS

First Embodiment

A first embodiment of the present invention will be described below with reference to FIGS. 1 to 8.

Figure 1:
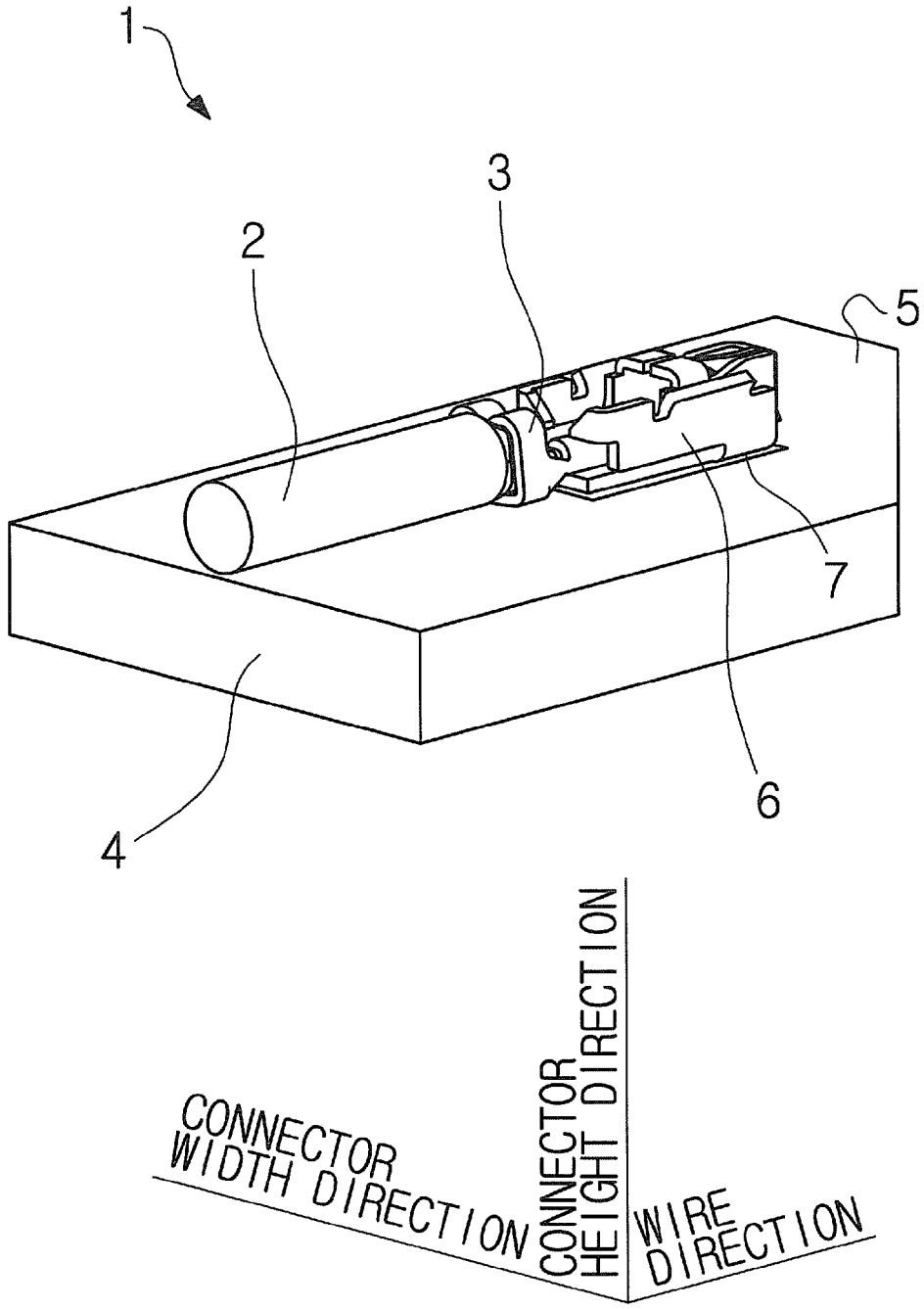
FIG. 1 is a perspective view of a wire-to-board connector in use (first embodiment)
Figure 2:
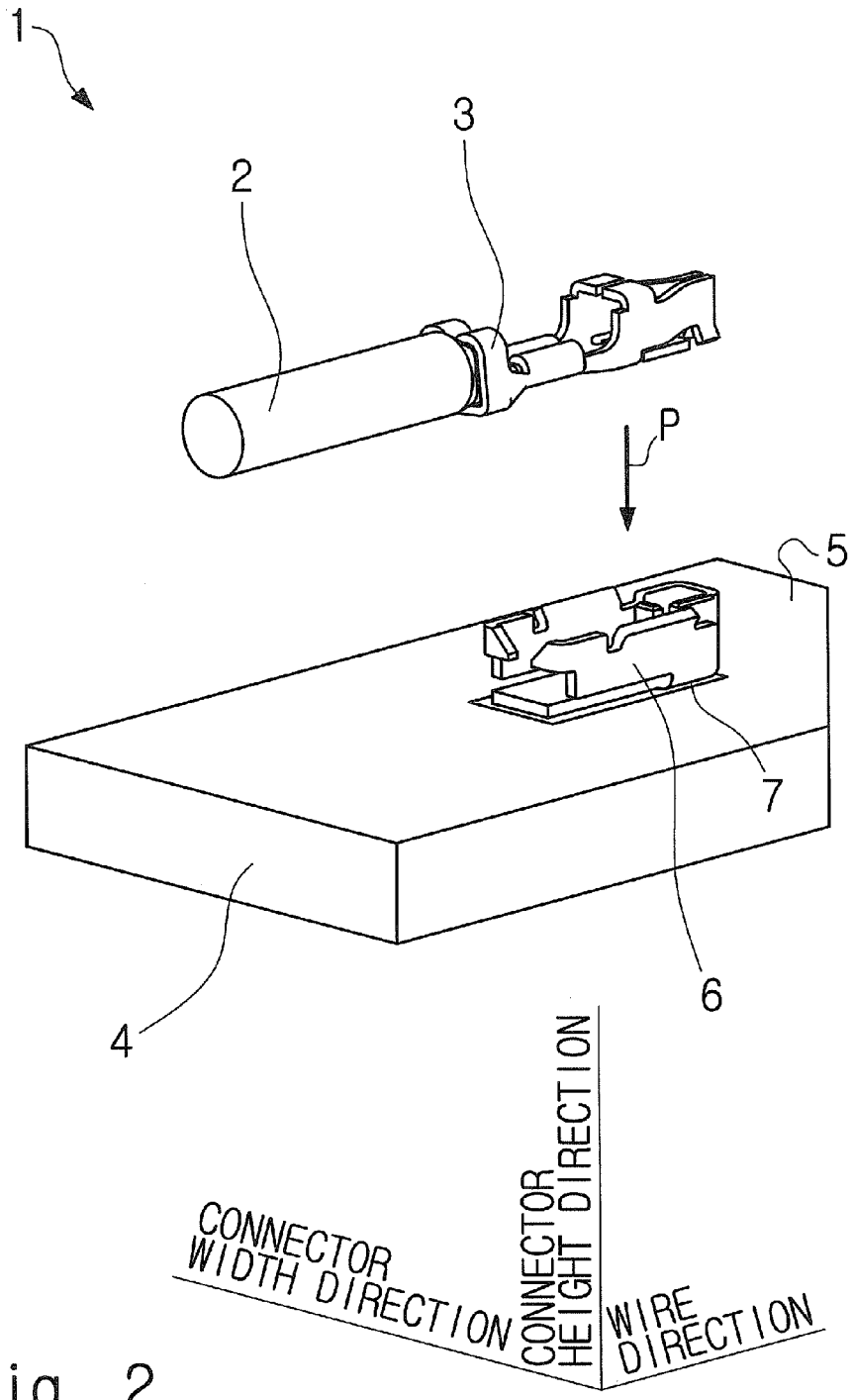
FIG. 2 is a perspective view of the wire-to-board connector in a state before a plug is attached to a receptacle (first embodiment)

As shown in FIGS. 1 and 2, a wire-to-board connector 1 includes a plug 3 (first terminal) which is attached to a wire 2, and a receptacle 6 (second terminal) which is mounted on a connector mounting surface 5 of a board 4. The plug 3 and the receptacle 6 are each formed of metal. The plug 3 and the receptacle 6 are formed by sheet metal bending. The plug 3 and the receptacle 6 are each a so-called insulator-less terminal (housing-less terminal) with no insulator. The plug 3 is mated with the receptacle 6, thereby allowing the wire 2 to be electrically connected to the board 4.

The terms "wire direction", "connector height direction", and "connector width direction" are now defined. As shown in FIG. 1, the term "wire direction" refers to a direction corresponding to the longitudinal direction of the wire 2 in the vicinity of the plug 3 when the plug 3 is mated with the receptacle 6. In this embodiment, the "wire direction" is set to be parallel to the connector mounting surface 5 of the board 4. In the "wire direction", a direction in which the plug 3 is viewed from the wire 2 is defined as a "wire plug direction" and a direction in which the wire 2 is viewed from the plug 3 is defined as a "plug wire direction". The term "connector height direction" refers to a direction orthogonal to the connector mounting surface 5 of the board 4. In the "connector height direction", a direction approaching the connector mounting surface 5 of the board 4 is defined as a "board approaching direction" and a direction separating from the connector mounting surface 5 of the board 4 is defined as a "board separating direction". The term "connector width direction" refers to a direction orthogonal to each of the wire direction and the connector height direction. In the "connector width direction", a direction approaching the center of the wire-to-board connector 1 is defined as a "connector width center direction" and a direction separating from the center of the wire-to-board connector 1 is defined as a "connector width anti-center direction".

As shown in FIG. 2, a mating direction P in which the plug 3 is mated with the receptacle 6 is a direction approaching the connector mounting surface 5 of the board 4. Accordingly, when other parts are disposed at a high density in the vicinity of the receptacle 6, for example, the workability that allows the plug 3 to be mated with the receptacle 6 is favorable. In this embodiment, the mating direction P coincides with the board approaching direction. Accordingly, the workability that allows the plug 3 to be mated with the receptacle 6 is more favorable.

(Board 4)

As shown in FIGS. 1 and 2, the board 4 is a rigid board, such as a paper phenol board, in this embodiment. Instead of a rigid board, a flexible board can be used as the board 4. On the connector mounting surface 5 of the board 4, an electrode pad 7 to which the receptacle 6 is soldered is formed.

(Wire 2)

Figure 3:
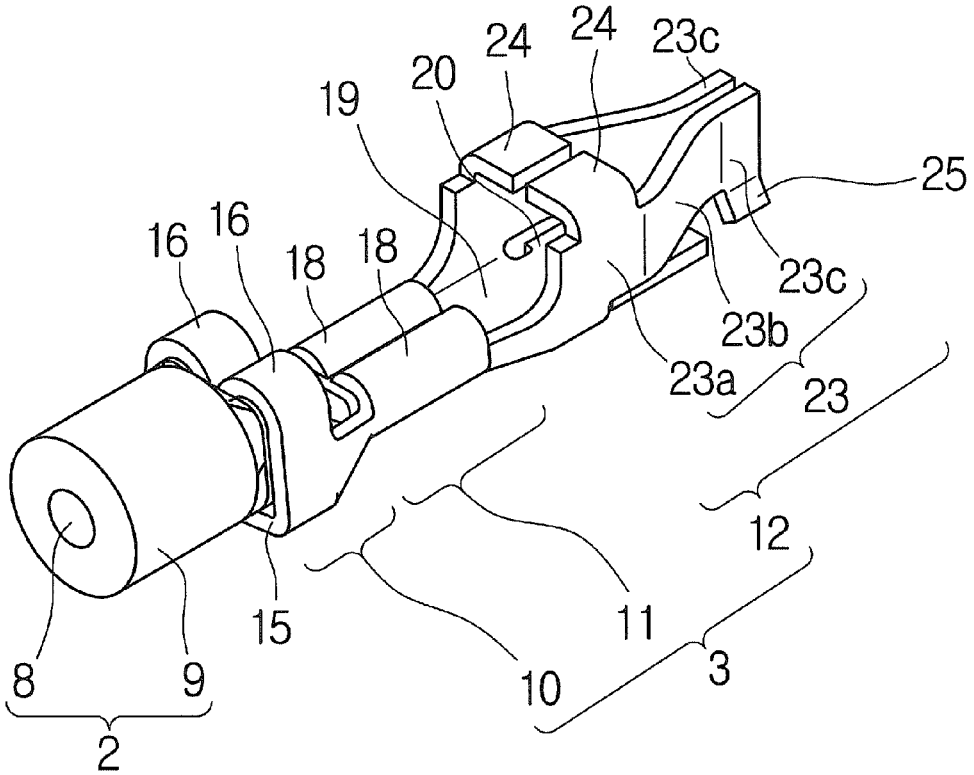
FIG. 3 is a perspective view of the plug (first embodiment)
Figure 3:
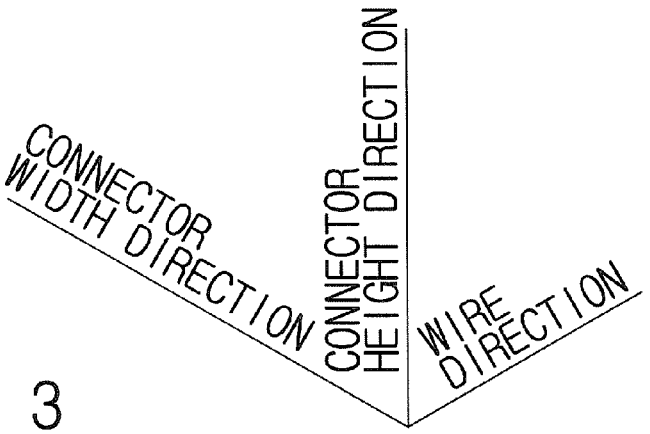

As shown in FIG. 3, the wire 2 includes a strand wire 8 serving as a central conductor, and an insulation 9. The strand wire 8 is coated with the insulation 9. Instead of the strand wire 8, a solid wire can be used as the central conductor of the wire 2.

(Plug 3)

Figure 4:
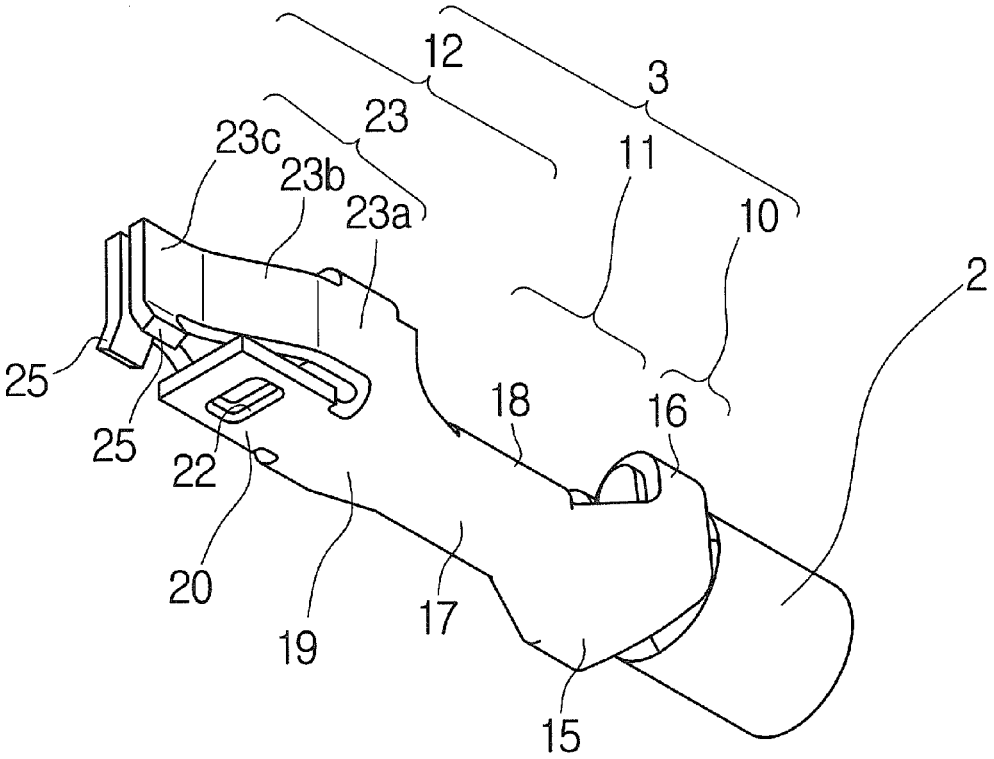
FIG. 4 is a perspective view of the plug when viewed from another angle (first embodiment)
Figure 4:
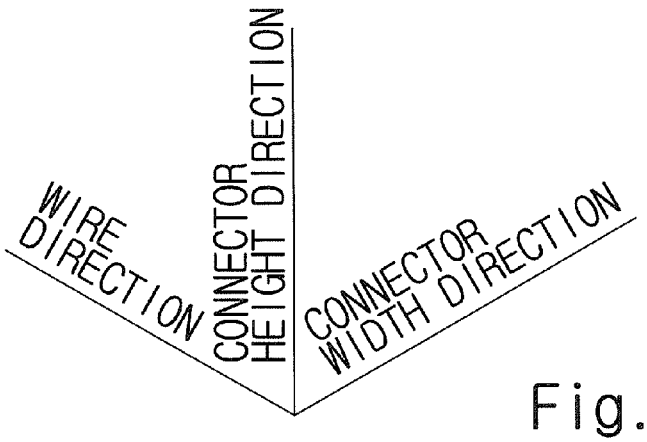

FIGS. 3 and 4 show the plug 3 in a state where the wire 2 is attached to the plug 3. As shown in FIGS. 3 and 4, the plug 3 is formed to be elongated along the wire direction. The plug 3 includes a wire holding portion 10, a wire connecting portion 11 (central conductor holding portion), and a plug body 12, which are formed in the stated order in the wire plug direction. The plug 3 is integrally formed with the wire holding portion 10, the wire connecting portion 11, and the plug body 12.

The wire holding portion 10 is a portion that crimps and holds the insulation 9 of the wire 2. The wire holding portion 10 includes a base plate portion 15 and a pair of holding portions 16. The base plate portion 15 is a flat plate-like portion orthogonal to the connector height direction. The pair of holding portions 16 are respectively connected to both ends in the connector width direction of the base plate portion 15 and protrude in the board separating direction. An end in the board separating direction of each holding portion 16 is bent by a dedicated crimp tool and is thus curved in the connector width center direction.

The wire connecting portion 11 is a portion that crimps and holds the strand wire 8 of the wire 2. The wire connecting portion 11 is electrically connected to the strand wire 8 of the wire 2. The wire connecting portion 11 includes a base plate portion 17 and a pair of holding portions 18. The base plate portion 17 is a flat plate-like portion orthogonal to the connector height direction. The base plate portion 17 is connected to an end in the wire plug direction of the base plate portion 15 of the wire holding portion 10. The pair of holding portions 18 are respectively connected to both ends in the connector width direction of the base plate portion 17 and protrude in the board separating direction. Each holding portion 18 is bent by a dedicated crimp tool and is thus curved in a C-shape in the connector width center direction. Each holding portion 18 is curved so as to swell out in the board separating direction.

The plug body 12 includes a base plate portion 19, an erect rod guide portion 20, a pair of contact beams 23, a pair of pushing plate portions 24, and a pair of contact piece guide portions 25.

The base plate portion 19 is a flat plate-like portion orthogonal to the connector height direction. The base plate portion 19 is connected to an end in the wire plug direction of the base plate portion 17 of the wire connecting portion 11.

The erect rod guide portion 20 is a flat plate-like portion orthogonal to the connector height direction. The erect rod guide portion 20 is connected to an end in the wire plug direction of the base plate portion 19. The erect rod guide portion 20 has an erect rod guide hole portion 22 (guide hole portion) formed therein. The erect rod guide hole portion 22 is formed so as to penetrate a substantially central portion of the erect rod guide portion 20 in the connector height direction.

The pair of contact beams 23, the pair of pushing plate portions 24, and the pair of contact piece guide portions 25 are each formed in a symmetrical shape in the connector width direction. Accordingly, only one of each pair will be described, and the description of the other one of each pair will be omitted.

The contact beam 23 is a portion that functions as a contact with the receptacle 6. The contact beam 23 is formed in a beam shape. The contact beam 23 is formed in a cantilever shape. The contact beam 23 is a cantilever supported by the base plate portion 19. The contact beam 23 is connected to an end in the connector width direction of the base plate portion 19, and is positioned so as to be erected at a right angle with respect to the base plate portion 19. The contact beam 23 is formed so as to extend in the wire plug direction when viewed from the base plate portion 19. The contact beam 23 includes a proximal end 23*a*, an inclined portion 23*b*, and a distal end 23*c*, which are formed in the stated order in the wire plug direction. The proximal end 23*a* is a flat plate-like portion that is connected to an end in the connector width direction of the base plate portion 19 and is orthogonal to the connector width direction. The inclined portion 23*b* is a flat plate-like portion that is connected to an end in the wire plug direction of the proximal end 23*a* and is inclined in the connector width center direction toward the wire plug direction. The distal end 23*c* is a flat plate-like portion that is connected to an end in the wire plug direction of the inclined portion 23*b* and is orthogonal to the connector width direction. Due to the presence of the inclined portion 23*b*, the distance between the distal end 23*c* of one of the contact beams 23 and the distal end 23*c* of the other contact beam 23 is smaller than the distance between the proximal end 23*a* of one of the contact beams 23 and the proximal end 23*a* of the other contact beam 23. The distance between the distal end 23*c* of one of the contact beams 23 and the distal end 23*c* of the other contact beam 23 is set to be smaller than the thickness of the receptacle 6. Specifically, the distance between the distal end 23*c* of one of the contact beams 23 and the distal end 23*c* of the other contact beam 23 is set to be smaller than the thickness of a contact piece 47 (also see FIG. 5) of the receptacle 6 which is described later. Due to the presence of the proximal end 23*a* and the inclined portion 23*b*, the distal end 23*c* is elastically displaceable in the connector width anti-center direction.

The pushing plate portion 24 is a flat plate-like portion that is connected to an end in the board separating direction of the proximal end 23*a* of the contact beam 23 and extends in the connector width center direction. The pushing plate portion 24 is orthogonal to the connector height direction. Accordingly, it can be said that the pushing plate portion 24 is disposed opposite to the board 4 with the contact beam 23 interposed therebetween. The distance between one of the pushing plate portions 24 and the other pushing plate portion 24 is set to be as small as possible.

The contact piece guide portion 25 is a flat plate-like portion that is connected to an end in the board approaching direction of the distal end 23*c* of the contact beam 23 and is inclined in the connector width anti-center direction toward the board approaching direction.

(Receptacle 6)

Figure 5:
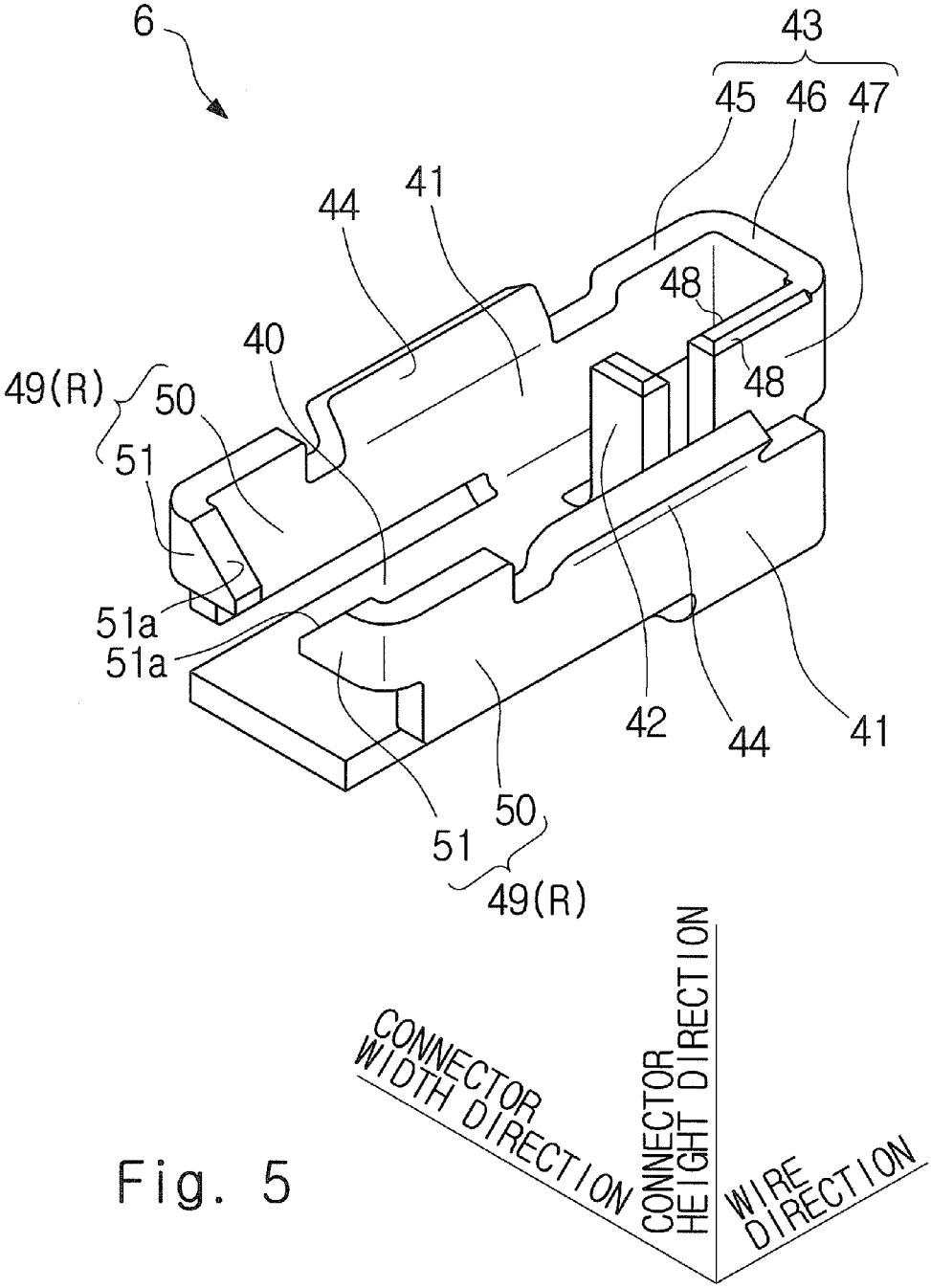
FIG. 5 is a perspective view of the receptacle (first embodiment)
Figure 6:
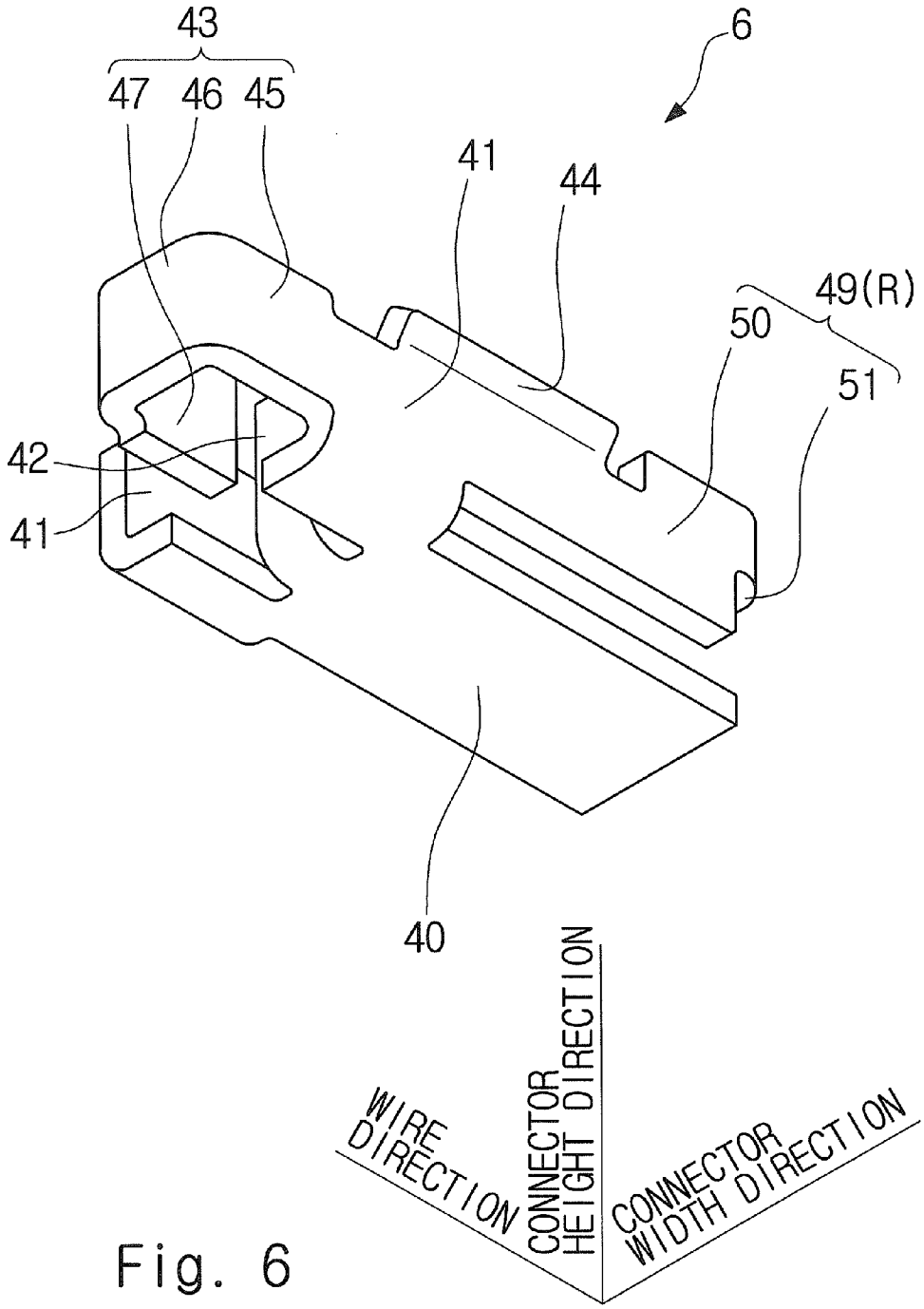
FIG. 6 is a perspective view of the receptacle when viewed from another angle (first embodiment)
Figure 7:
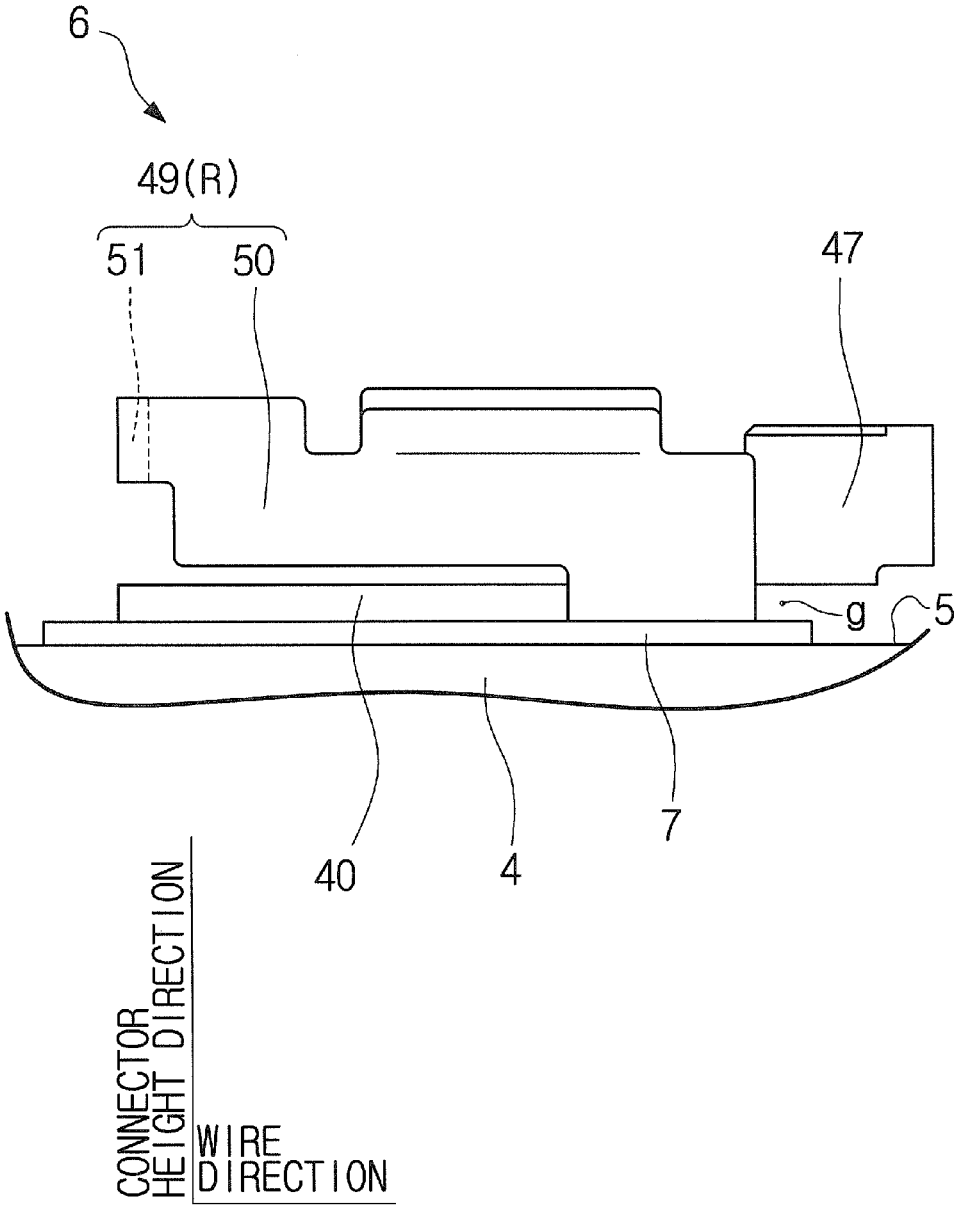
FIG. 7 is a side view of the receptacle (first embodiment)

As shown in FIGS. 5 to 7, the receptacle 6 is formed to be elongated in the wire direction. The receptacle 6 includes a base plate portion 40, a pair of side plate portions 41, an erect rod 42 (guide rod portion), a contact unit 43, a pair of guide inclined portions 44 (inclined portions), and a pair of lock units 49.

The base plate portion 40 is a portion that is soldered to the electrode pad 7 (see FIGS. 1 and 2) on the connector mounting surface 5 of the board 4. The base plate portion 40 is formed in a flat plate shape orthogonal to the connector height direction. The base plate portion 40 has a rectangular shape and is formed to be elongated along the wire direction.

The pair of side plate portions 41 is formed in a symmetrical shape in the connector width direction. Accordingly, only one of the pair will be described, and the description of the other one of the pair will be omitted. The side plate portion 41 is connected to an end in the connector width direction at an end in the wire plug direction of the base plate portion 40, and is formed to protrude in the board separating direction. The side plate portion 41 is positioned so as to be erected at a right angle with respect to the base plate portion 40. That is, the side plate portion 41 is in a position orthogonal to the connector width direction. The length of the side plate portion 41 in the wire direction is one-third of the length of the base plate portion 40 in the wire direction.

The erect rod 42 is a portion that is disposed at the center of the receptacle 6 in the connector width direction and is formed in a rod shape extending in the board separating direction from the base plate portion 40. The erect rod 42 is formed by lancing the end in the wire plug direction of the base plate portion 40. The erect rod 42 is positioned so as to be erected at a right angle with respect to the base plate portion 40.

The contact unit 43 is a portion that functions as a contact with the plug 3. The contact unit 43 is disposed at a location closer to a side in the wire plug direction than the base plate portion 40, the pair of side plate portions 41, and the erect rod 42. The contact unit 43 is supported by one of the side plate portion 41. The contact unit 43 includes a unit proximal end 45, a unit intermediate portion 46, and the contact piece 47. The unit proximal end 45 is a portion that is connected to an end in the wire plug direction of one of the side plate portions 41 and extends in the wire plug direction. The unit proximal end 45 is orthogonal to the connector width direction. The unit intermediate portion 46 is a portion that is connected to an end in the wire plug direction of the unit proximal end 45 and extends in the connector width center direction. The unit intermediate portion 46 is orthogonal to the wire direction. The unit intermediate portion 46 extends to the center in the connector width direction of the receptacle 6. The contact piece 47 is a portion that is connected to an end in the connector width center direction of the unit intermediate portion 46 and extends in the plug wire direction. The contact piece 47 is orthogonal to the connector width direction. At an end in the board separating direction of the contact piece 47, a pair of inclined surfaces 48 is formed in such a manner that the end in the board separating direction of the contact piece 47 is tapered in the board separating direction. Due to the presence of the unit proximal end 45, the unit intermediate portion 46, and the contact piece 47, the contact unit 43 forms a U-shape when viewed along the board approaching direction. As shown in FIG. 6, the contact piece 47 of the contact unit 43 is formed so as to be away from the base plate portion 40. As shown in FIG. 7, the contact piece 47 is supported by one of the side plate portions 41 in a slightly floating state relative to the base plate portion 40 so that a gap "g" is formed between the contact piece 47 and the electrode pad 7 when the receptacle 6 is soldered to the electrode pad 7 on the connector mounting surface 5 of the board 4. To put it briefly, the contact piece 47 is disposed at a location farther from the board 4 than the base plate portion 40.

The pair of lock units 49 constitutes a lock mechanism R. The pair of lock units 49 is formed in a symmetrical shape in the connector width direction. Accordingly, only one of the pair will be described, and the description of the other one of the pair will be omitted.

The lock unit 49 includes a lock beam 50 and a claw portion 51. The lock beam 50 is formed in a beam shape that is supported by the side plate portion 41. The lock beam 50 is formed in a cantilever shape that is supported by the side plate portion 41. The lock beam 50 is a flat plate-like portion that is connected to an end in the plug wire direction of the side plate portion 41 and extends in the plug wire direction. The lock beam 50 is orthogonal to the connector width direction. As shown in FIG. 7, an end in the plug wire direction of the lock beam 50 is positioned in the vicinity of an end in the plug wire direction of the base plate portion 40. The claw portion 51 is a portion that is connected to an end in the plug wire direction of the lock beam 50 and is formed so as to protrude in the connector width center direction. The claw portion 51 has an inclined surface 51*a* that is inclined in the board approaching direction toward the connector width center direction. In the structure described above, the claw portion 51 is elastically displaceable in the connector width anti-center direction due to the presence of the lock beam 50.

The pair of guide inclined portions 44 is formed in a symmetrical shape in the connector width direction. Accordingly, only one of the pair will be described, and the description of the other one of the pair will be omitted. The guide inclined portion 44 is connected to an end in the board separating direction of the side plate portion 41 and to an end in the board separating direction of the lock beam 50. The guide inclined portion 44 is formed so as to extend in the wire direction. The guide inclined portion 44 is inclined in the board approaching direction toward the connector width center direction. That is, the pair of guide inclined portions 44 is inclined so as to be spaced apart from each other toward the board separating direction.

(Mating Operation)

Figure 8:
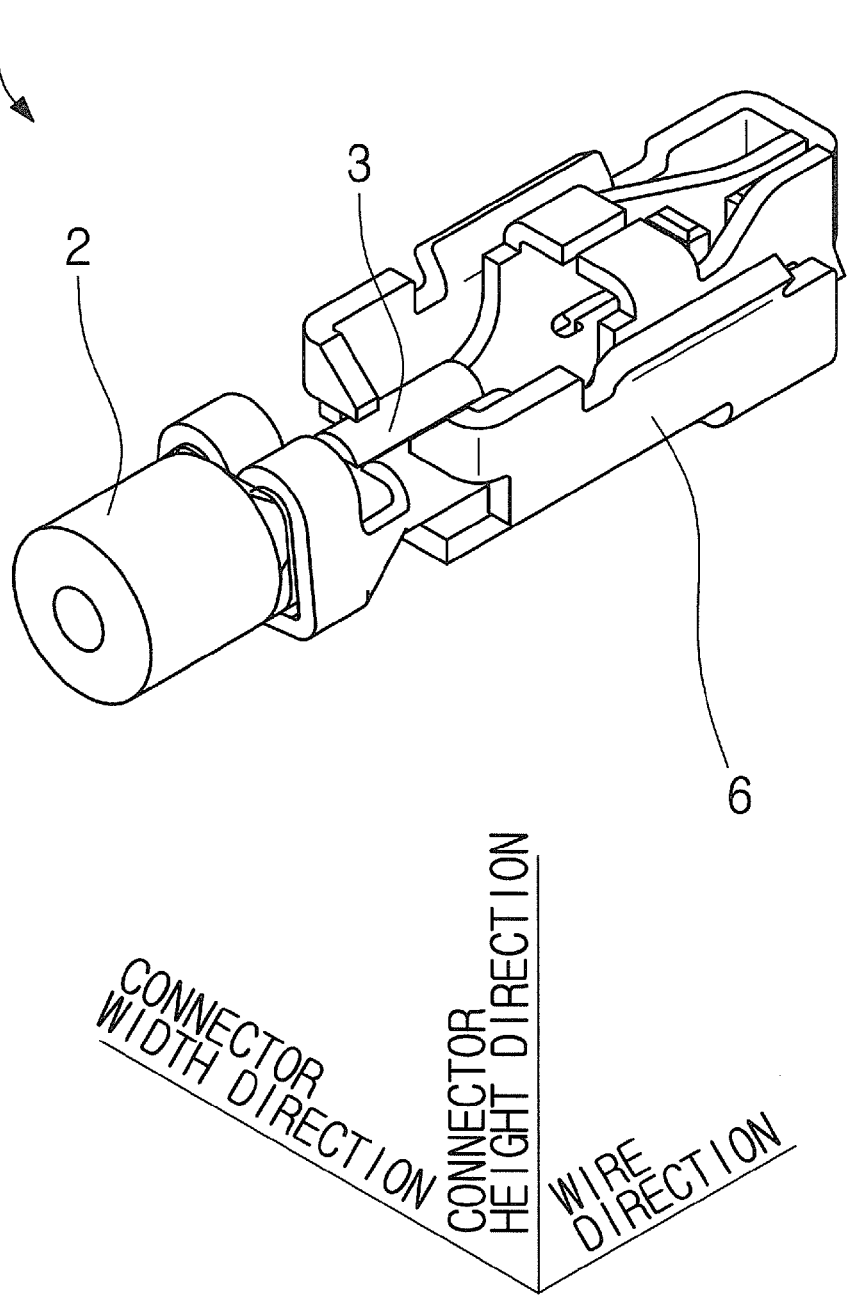
FIG. 8 is a perspective view of the wire-to-board connector in a state where the plug is attached to the receptacle (first embodiment)

Next, the mating operation for mating the plug 3 with the receptacle 6 will be described. For reference, FIG. 8 shows a state in which the plug 3 is mated with the receptacle 6.

First, as shown in FIG. 2, the wire 2 is attached to the plug 3, and the plug 3 is moved toward the receptacle 6. The direction of movement of the plug 3 toward the receptacle 6 is indicated by the above-mentioned mating direction P. At this time, the plug 3 is moved toward the receptacle 6 in such a manner that the erect rod 42 shown in FIG. 5 is inserted into the erect rod guide hole portion 22 shown in FIG. 4.

Then, due to the presence of the pair of guide inclined portions 44 of the receptacle 6 shown in FIG. 5, the position of the plug 3 in the connector width direction relative to the receptacle 6 is automatically adjusted. In the state where the position of the plug 3 in the connector width direction relative to the receptacle 6 is adjusted in this manner, the end in the board separating direction of the erect rod 42 is inserted into the erect rod guide hole portion 22 by moving the plug 3 in the wire direction relative to the receptacle 6 in a reciprocating manner, or by visual checking, thereby determining the position of the plug 3 in the wire direction and the connector width direction relative to the receptacle 6. Substantially at the same time, the pair of contact piece guide portions 25 shown in FIG. 4 contact the pair of inclined surfaces 48 of the contact piece 47 shown in FIG. 5, and the base plate portion 17 of the wire connecting portion 11 shown in FIG. 4 contacts the inclined surfaces 51*a* of the pair of claw portions 51 shown in FIG. 5.

In this state, when the plug 3 is pushed in the board approaching direction by using the pair of pushing plate portions 24 of the plug body 12 shown in FIG. 3, the plug 3 and the receptacle 6 behave in the following manner.

(1) The plug body 12 of the plug 3 shown in FIG. 4 is fitted between the pair of side plate portions 41 of the receptacle 6 shown in FIG. 5. As a result, the pair of side plate portions 41 of the receptacle 6 sandwich the plug body 12 of the plug 3 in the connector width direction.

(2) The erect rod 42 shown in FIG. 5 is deeply inserted into the erect rod guide hole portion 22 shown in FIG. 4.

(3) The contact piece 47 shown in FIG. 5 is inserted between the distal ends 23*c* of the pair of contact beams 23, while the pair of contact beams 23 shown in FIG. 4 is elastically deformed. As a result, the distal ends 23*c* of the pair of contact beams 23 of the plug 3 are allowed to reliably contact the contact piece 47 of the receptacle 6 by the spring restoring force of the contact beams 23.

(4) The wire connecting portion 11 shown in FIG. 4 pushes out the pair of lock beams 50 through the pair of inclined surfaces 51*a* shown in FIG. 5, and the pair of claw portions 51 is elastically displaced in the connector width anti-center direction. Then, when the wire connecting portion 11 passes over the pair of claw portions 51, the pair of claw portions 51 returns in the connector width center direction and the wire connecting portion 11 is caught on the pair of claw portions 51. As a result, the plug 3 is prevented from being disengaged from the receptacle 6 when the wire 2 is pulled in the board separating direction.

The first preferred embodiment of the present invention described above has the following features.

(1) The wire-to-board connector 1 includes the plug 3 (first terminal) which is attached to the wire 2, and the receptacle 6 (second terminal) which is mounted on the connector mounting surface 5 of the board 4. The plug 3 and the receptacle 6 are each formed of metal. The plug 3 is mated with the receptacle 6 to thereby connect the wire 2 to the board 4. The wire-to-board connector 1 has the following structure. When the plug 3 is mated with the receptacle 6, the wire direction corresponding to the longitudinal direction of the wire 2 in the vicinity of the plug 3 is parallel to the connector mounting surface 5 of the board 4. The mating direction P in which the plug 3 is mated with the receptacle 6 is a direction approaching the connector mounting surface 5 of the board 4. According to the structure described above, the workability that allows the plug 3 to be mated with the receptacle 6 is favorable.

(2) The mating direction P is a direction orthogonal to the connector mounting surface 5 of the board 4. According to the structure described above, the workability that allows the plug 3 to be mated with the receptacle 6 is more favorable.

(10) The receptacle 6 has the lock mechanism R that prevents disengagement of the plug 3 from the receptacle 6. In this embodiment, the lock mechanism R is implemented by the pair of lock units 49. The lock mechanism R may be formed in the plug 3 instead of the receptacle 6, or may be formed in both of the plug 3 and the receptacle 6.

(3) The receptacle 6 includes the base plate portion 40 which is opposed to the connector mounting surface 5 of the board 4, and the pair of side plate portions 41 which sandwich the plug 3 mated with the receptacle 6 in the connector width direction (wire orthogonal direction) orthogonal to the wire direction. According to the structure described above, the allowance in the connector width direction of the plug 3 with respect to the receptacle 6 is small, so that the plug 3 is reliably held by the receptacle 6.

(4) The receptacle 6 includes the erect rod 42 (guide rod portion) extending so as to be away from the connector mounting surface 5 of the board 4. The plug 3 has the erect rod guide hole portion 22 (guide hole portion) into which the erect rod 42 is inserted. According to the structure described above, when the plug 3 is mated with the receptacle 6, the effect of positioning the plug 3 relative to the receptacle 6 is exerted. Furthermore, according to the structure described above, the plug 3 is prevented from being disengaged from the receptacle 6 in the wire direction.

(5) The plug 3 includes the pair of contact beams 23 having a beam shape. The receptacle 6 includes the contact piece 47 that is inserted between the pair of contact beams 23. According to the structure described above, a reliable contact between the plug 3 and the receptacle 6 is achieved.

(6) The pair of contact beams 23 is formed in a cantilever shape.

(7) The contact piece 47 is formed so as to be away from the base plate portion 40. According to the structure described above, when the base plate portion 40 of the receptacle 6 is soldered to the connector mounting surface 5 of the board 4, the contact piece 47 is prevented from being contaminated by solder.

(8) The contact piece 47 is supported by one of the pair of side plate portions 41.

(9) The plug 3 includes the flat plate-like pushing plate portion 24 that is disposed opposite to the board 4 with the pair of contact beams 23 interposed therebetween and is orthogonal to the mating direction. According to the structure described above, when the plug 3 is mated with the receptacle 6, the plug 3 is pushed toward the receptacle 6 by using the pushing plate portion 24, thereby improving the workability.

(11) The receptacle 6 includes: the pair of lock beams 50 which are respectively supported by the pair of side plate portions 41 and extend in a beam shape in the wire direction; and the pair of claw portions 51 which are respectively supported by the pair of lock beams 50 and protrude so as to approach each other. The plug 3 is formed to be caught on the pair of claw portions 51 of the receptacle 6 when the plug 3 is mated with the receptacle 6. The pair of lock beams 50 and the pair of claw portions 51 constitute the lock mechanism R. According to the structure described above, since the pair of claw portions 51 is supported in an elastically displaceable manner, the plug 3 is locked by the receptacle 6 merely by pushing the plug 3 into the receptacle 6.

(12) The plug 3 includes the wire connecting portion 11 (central conductor holding portion) that holds the strand wire 8 (central conductor) of the wire 2. The wire connecting portion 11 of the plug 3 is formed to be caught on the pair of claw portions 51 of the receptacle 6 when the plug 3 is mated with the receptacle 6.

(13) The receptacle 6 includes the pair of guide inclined portions 44 (inclined portions) that are respectively connected to the pair of side plate portions 41 and are inclined so as to be gradually spaced apart from each other in a direction away from the connector mounting surface 5 of the board 4. According to the structure described above, when the plug 3 is mated with the receptacle 6, the effect of guiding and positioning the plug 3 between the pair of side plate portions 41 of the receptacle 6 is obtained.

Second Embodiment

Next, a second embodiment of the present invention will be described with reference to FIGS. 9 and 10. Here, differences between this embodiment and the first embodiment will be mainly described, while a repeat of previous descriptions is omitted as appropriate. Components corresponding to the components of the first embodiment described above are denoted by the same reference numerals as a rule.

The plug 3 of this embodiment is identical with the plug 3 of the first embodiment, so the description thereof is omitted.

(Receptacle 6)

Figure 9:
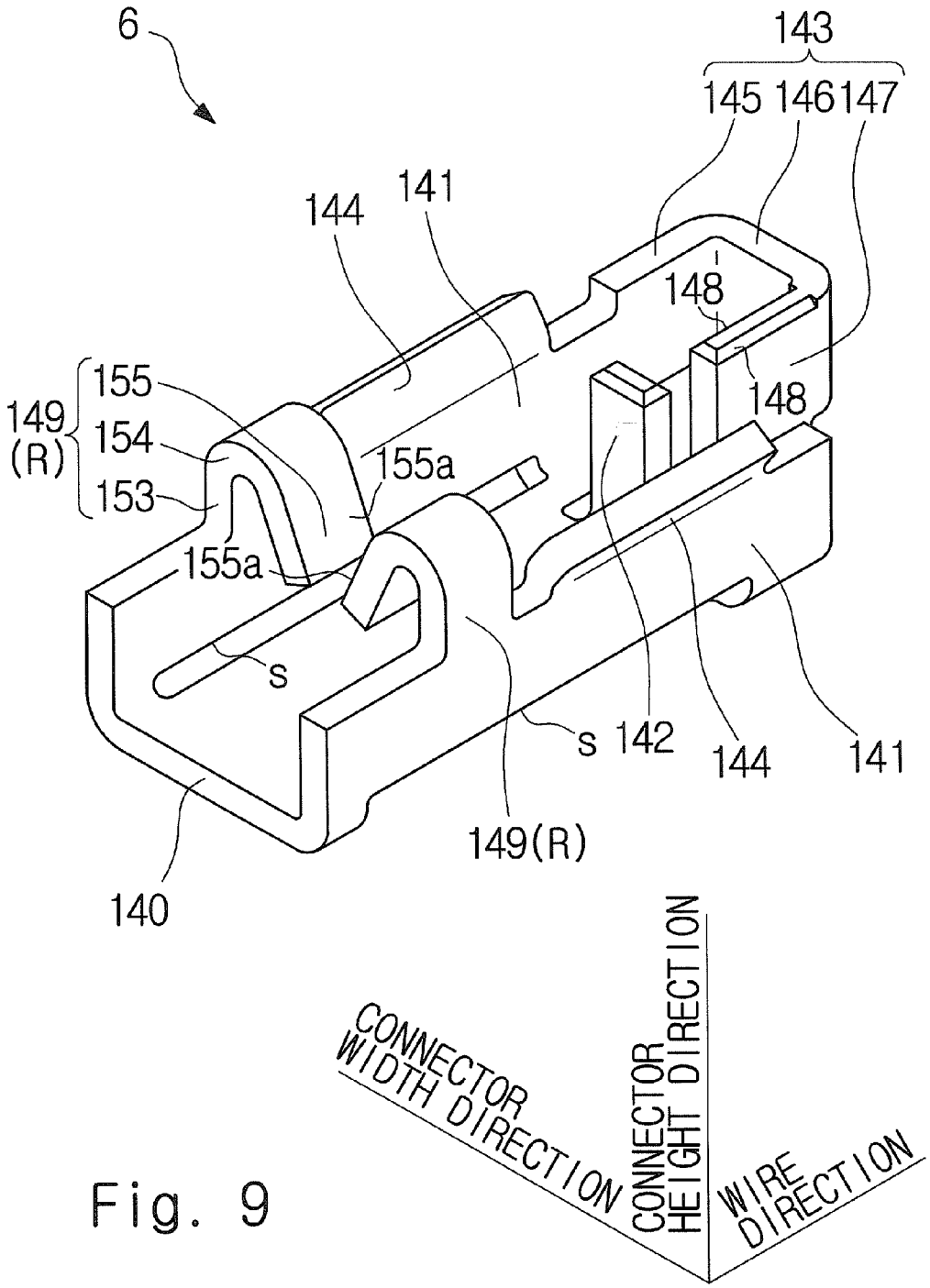
FIG. 9 is a perspective view of a receptacle (second embodiment)
Figure 10:
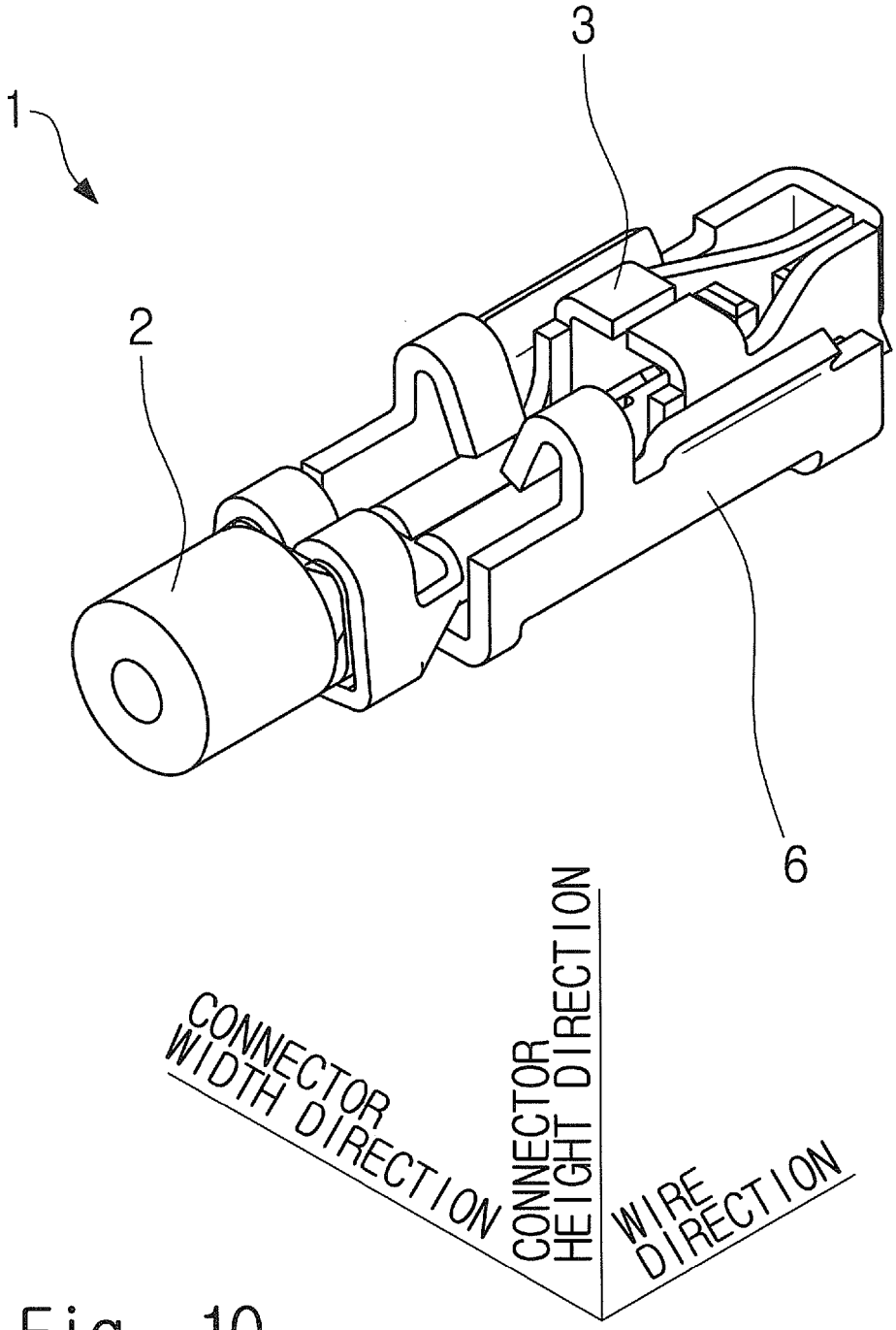
FIG. 10 is a perspective view of a wire-to-board connector in a state where a plug is attached to the receptacle (second embodiment)

As shown in FIG. 9, the receptacle 6 is formed to be elongated in the wire direction. The receptacle 6 includes a base plate portion 140, a pair of side plate portions 141, an erect rod 142 (guide rod portion), a contact unit 143, a pair of guide inclined portions 144 (inclined portions), and a pair of lock units 149.

The base plate portion 140 is a portion that is soldered to the electrode pad 7 (see FIGS. 1 and 2) of the connector mounting surface 5 of the board 4. The base plate portion 140 is formed in a flat plate shape that is orthogonal to the connector height direction. The base plate portion 140 has a rectangular shape and is formed so as to be tapered along the wire direction.

The pair of side plate portions 141 is formed in a symmetrical shape in the connector width direction. Accordingly, only one of the pair will be described, and the description of the other one of the pair will be omitted. The side plate portion 141 is connected to an end in the connector width direction of the base plate portion 140, and is formed to protrude in the board separating direction. The side plate portion 141 is connected to an end in the plug wire direction of the base plate portion 140 and to an end in the wire plug direction thereof. The side plate portion 141 and the base plate portion 140 are not connected to each other between the end in the plug wire direction of the base plate portion 140 and the end in the wire plug direction thereof, and a slit "s" is formed between the side plate portion 141 and the base plate portion 140. This slit "s" facilitates the elastic deformation of the side plate portion 141 so that it is inclined in the connector width anti-center direction. The side plate portion 141 is positioned so as to be erected at a right angle with respect to the base plate portion 140. That is, the side plate portion 141 is in a position orthogonal to the connector width direction. The length in the wire direction of the side plate portion 141 is equal to the length in the wire direction of the base plate portion 140.

The erect rod 142 is a portion that is disposed at the center in the connector width direction of the receptacle 6 and is formed in a rod shape extending in the board separating direction from the base plate portion 140. The erect rod 142 is formed by lancing the end in the wire plug direction of the base plate portion 140. The erect rod 142 is positioned so as to be erected at a right angle with respect to the base plate portion 140.

The contact unit 143 is a portion that functions as a contact with the plug 3. The contact unit 143 is disposed at a location closer to a side in the wire plug direction than the base plate portion 140, the pair of side plate portions 141, and the erect rod 142. The contact unit 143 is supported by one of the side plate portions 141. The contact unit 143 includes a unit proximal end 145, a unit intermediate portion 146, and a contact piece 147. The unit proximal end 145 is a portion that is connected to an end in the wire plug direction of one of the side plate portions 141 and extends in the wire plug direction. The unit proximal end 145 is orthogonal to the connector width direction. The unit intermediate portion 146 is a portion that is connected to an end in the wire plug direction of the unit proximal end 145 and extends in the connector width center direction. The unit intermediate portion 146 is orthogonal to the wire direction. The unit intermediate portion 146 extends to the center in the connector width direction of the receptacle 6. The contact piece 147 is a portion that is connected to an end in the connector width center direction of the unit intermediate portion 146 and extends in the plug wire direction. The contact piece 147 is orthogonal to the connector width direction. At an end in the board separating direction of the contact piece 147, a pair of inclined surfaces 148 is formed in such a manner that the end in the board separating direction of the contact piece 147 is tapered in the board separating direction. Due to the presence of the unit proximal end 145, the unit intermediate portion 146, and the contact piece 147, the contact unit 143 forms a U-shape when viewed along the board approaching direction. The contact piece 147 of the contact unit 143 is formed so as to be away from the base plate portion 140 (also see FIG. 6). The contact piece 147 is supported by one of the side plate portions 141 in a slightly floating state relative to the base plate portion 140 so that the gap "g" (also see FIG. 7) is formed between the contact piece 147 and the electrode pad 7 when the receptacle 6 is soldered to the electrode pad 7 on the connector mounting surface 5 of the board 4. To put it briefly, the contact piece 147 is disposed at a location farther from the board 4 than the base plate portion 140.

The pair of lock units 149 constitutes the lock mechanism R. The pair of lock units 149 is formed in a symmetrical shape in the connector width direction. Accordingly, only one of the pair will be described, and the description of the other one of the pair will be omitted.

The lock unit 149 includes a standing portion 153, a curved portion 154, and an inclined portion 155. The standing portion 153 is a flat plate-like portion that is connected to an end in the board separating direction of the side plate portion 141 and extends in the board separating direction. The standing portion 153 is orthogonal to the connector width direction. The standing portion 153 is disposed at a location slightly closer to the side in the plug wire direction relative to the center in the wire direction of the side plate portion 141. The curved portion 154 is a portion that is connected to an end in the board separating direction of the standing portion 153 and is curved in the connector width center direction. The inclined portion 155 is a portion that is connected to an end in the connector width center direction of the curved portion 154 and is inclined in the board approaching direction toward the connector width center direction. The inclined portion 155 has an inclined surface 155*a* that is inclined in the board approaching direction toward the connector width center direction. In the structure described above, due to the presence of the curved portion 154, the inclined portion 155 (inclined surface 155*a*) is elastically displaceable in the connector width anti-center direction. When the plug 3 is mated with the receptacle 6, the lock unit 149 is disposed so as to contact the wire connecting portion 11 (also see FIG. 3) of the plug 3.

The pair of guide inclined portions 144 is formed in a symmetrical shape in the connector width direction. Accordingly, only one of the pair will be described, and the description of the other one of the pair will be omitted. The guide inclined portion 144 is connected to an end in the board separating direction of the side plate portion 141 and is formed so as to extend in the wire direction. The guide inclined portion 144 is disposed at a location closer to a side in the wire plug direction than the lock unit 149. The guide inclined portion 144 is inclined in the board approaching direction toward the connector width center direction. That is, the pair of guide inclined portions 144 is inclined so as to be spaced apart from each other toward the board separating direction.

(Mating Operation)

Next, the mating operation for mating the plug 3 with the receptacle 6 will be described. For reference, FIG. 10 shows a state in which the plug 3 is mated with the receptacle 6.

First, the wire 2 is attached to the plug 3 (also see FIG. 2), and the plug 3 is moved toward the receptacle 6. The direction of movement of the plug 3 toward the receptacle 6 is indicated by the above-mentioned mating direction P. At this time, the plug 3 is moved toward the receptacle 6 in such a manner that the erect rod 142 shown in FIG. 9 is inserted into the erect rod guide hole portion 22 shown in FIG. 4.

Then, due to the presence of the pair of guide inclined portions 144 of the receptacle 6, the position of the plug 3 in the connector width direction relative to the receptacle 6 is automatically adjusted. In the state where the position of the plug 3 in the connector width direction relative to the receptacle 6 is adjusted in this manner, the end in the board separating direction of the erect rod 142 is inserted into the erect rod guide hole portion 22 by moving the plug 3 in the wire direction relative to the receptacle 6 in a reciprocating manner, thereby determining the position of the plug 3 in the wire direction and the connector width direction relative to the receptacle 6. Substantially at the same time, the pair of contact piece guide portions 25 shown in FIG. 4 contact the pair of inclined surfaces 148 of the contact piece 147 shown in FIG. 9, and the base plate portion 17 of the wire connecting portion 11 shown in FIG. 4 contacts the inclined surfaces 155*a* shown in FIG. 9.

In this state, when the plug 3 is pushed in the board approaching direction by using the pair of pushing plate portions 24 of the plug body 12 shown in FIG. 3, the plug 3 and the receptacle 6 behave in the following manner.

(1) The plug body 12 of the plug 3 shown in FIG. 4 is fitted between the pair of side plate portions 141 of the receptacle 6 shown in FIG. 9. As a result, the pair of side plate portions 141 of the receptacle 6 sandwich the plug body 12 of the plug 3 in the connector width direction.

(2) The erect rod 142 shown in FIG. 9 is deeply inserted into the erect rod guide hole portion 22 shown in FIG. 4.

(3) The contact piece 147 shown in FIG. 9 is inserted between the distal ends 23*c* of the pair of contact beams 23, while the pair of contact beams 23 shown in FIG. 4 is elastically deformed. As a result, the distal ends 23*c* of the pair of contact beams 23 of the plug 3 are allowed to reliably contact the contact piece 147 of the receptacle 6 by the spring restoring force of the contact beams 23.

(4) The wire connecting portion 11 shown in FIG. 4 pushes out the pair of inclined portions 155 through the pair of inclined surfaces 155*a* shown in FIG. 9, and the pair of inclined portions 155 is elastically displaced in the connector width anti-center direction. Then, when the wire connecting portion 11 passes over the pair of inclined surfaces 155*a*, the pair of inclined portions 155 returns in the connector width center direction and the wire connecting portion 11 is caught on the pair of inclined portions 155. As a result, the plug 3 is prevented from being disengaged from the receptacle 6 when the wire 2 is pulled in the board separating direction. The presence of the slit "s" shown in FIG. 9 facilitates the elastic deformation so that the side plate portions 141 are inclined in the connector width anti-center direction, thereby further facilitating the elastic displacement of the pair of inclined portions 155 in the connector width anti-center direction.

Third Embodiment

Next, a third embodiment of the present invention will be described with reference to FIGS. 11 to 15. Here, differences between this embodiment and the first embodiment will be mainly described, while a repeat of previous descriptions is omitted as appropriate. Components corresponding to the components of the first embodiment described above are denoted by the same reference numerals as a rule.

(Plug 3)

Figure 11:
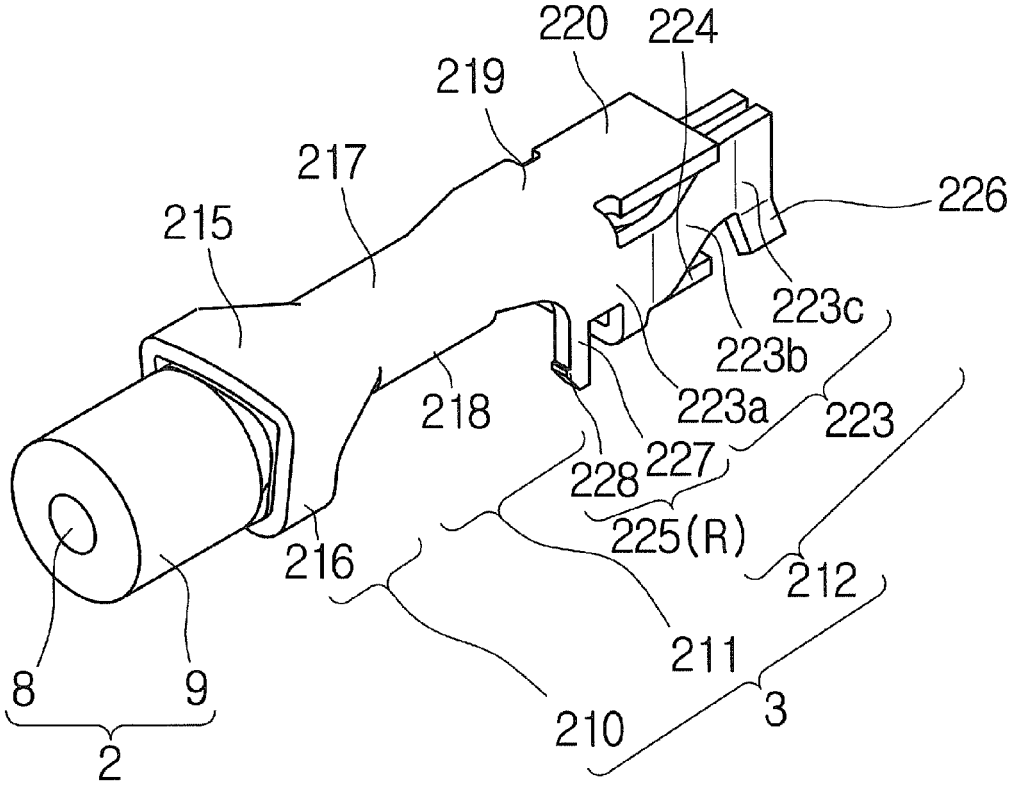
FIG. 11 is a perspective view of a plug (third embodiment)
Figure 11:
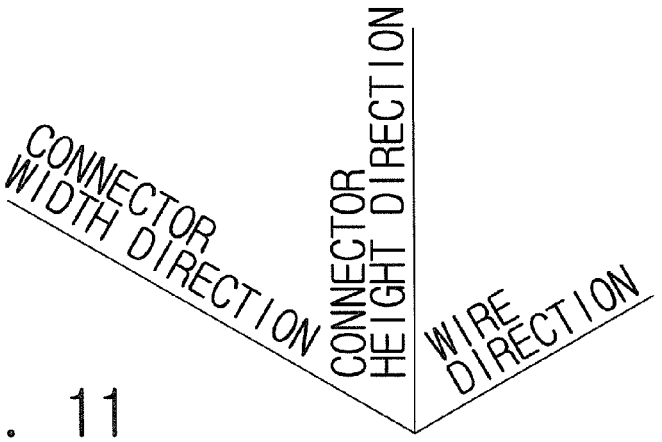
Figure 12:
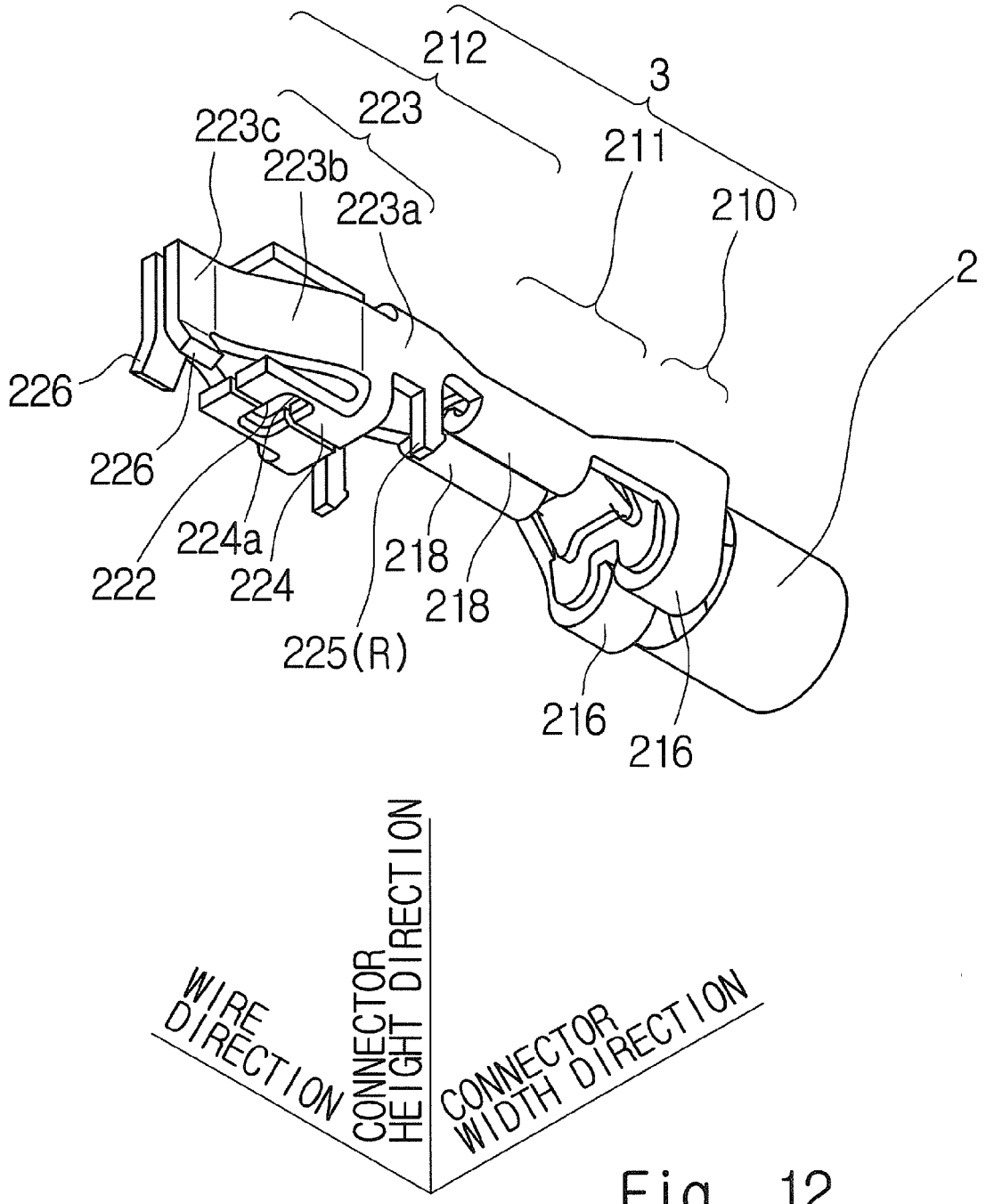
FIG. 12 is a perspective view of the plug when viewed from another angle (third embodiment)

FIGS. 11 and 12 show the plug 3 in a state where the wire 2 is attached to the plug 3. As shown in FIGS. 11 and 12, the plug 3 is formed to be elongated along the wire direction. The plug 3 includes a wire holding portion 210, a wire connecting portion 211 (central conductor holding portion), and a plug body 212, which are formed in the stated order in the wire plug direction. The plug 3 is integrally formed with the wire holding portion 210, the wire connecting portion 211, and the plug body 212.

The wire holding portion 210 is a portion that crimps and holds the insulation 9 of the wire 2. The wire holding portion 210 includes a base plate portion 215 and a pair of holding portions 216. The base plate portion 215 is a flat plate-like portion orthogonal to the connector height direction. The pair of holding portions 216 are respectively connected to both ends in the connector width direction of the base plate portion 215, and protrude in the board approaching direction. An end in the board approaching direction of each holding portion 216 is bent by a dedicated crimp tool, and is thus curved in the connector width center direction.

The wire connecting portion 211 is a portion that crimps and holds the strand wire 8 of the wire 2. The wire connecting portion 211 is electrically connected to the strand wire 8 of the wire 2. The wire connecting portion 211 includes a base plate portion 217 and a pair of holding portions 218. The base plate portion 217 is a flat plate-like portion orthogonal to the connector height direction. The base plate portion 217 is connected to an end in the wire plug direction of the base plate portion 215 of the wire holding portion 210. The pair of holding portions 218 are respectively connected to both ends in the connector width direction of the base plate portion 217, and protrude in the board approaching direction. Each holding portion 218 is bent by a dedicated crimp tool, and is thus curved in the connector width center direction. Each holding portion 218 is curved so as to swell out in the board separating direction.

The plug body 212 includes a base plate portion 219, a pushing plate portion 220, a pair of contact beams 223, a pair of erect rod guide portions 224, a pair of lock units 225, and a pair of contact piece guide portions 226.

The base plate portion 219 is a flat plate-like portion orthogonal to the connector height direction. The base plate portion 219 is connected to an end in the wire plug direction of the base plate portion 217 of the wire connecting portion 211.

The pushing plate portion 220 is a plate-like portion orthogonal to the connector height direction. The pushing plate portion 220 is connected to an end in the wire plug direction of the base plate portion 219.

The pair of contact beams 223, the pair of erect rod guide portions 224, the pair of lock units 225, and the pair of contact piece guide portions 226 are each formed in a symmetrical shape in the connector width direction. Accordingly, only one of each pair will be described, and the description of the other one of each pair will be omitted.

The contact beam 223 is a portion that functions as a contact with the receptacle 6. The contact beam 223 is formed in a beam shape. The contact beam 223 is formed in a cantilever shape. The contact beam 223 is a cantilever supported by the base plate portion 219. The contact beam 223 is connected to an end in the connector width direction of the base plate portion 219, and is positioned so as to be erected at a right angle with respect to the base plate portion 219. The contact beam 223 is formed so as to extend in the wire plug direction when viewed from the base plate portion 219. The contact beam 223 includes a proximal end 223*a*, an inclined portion 223*b*, and a distal end 223*c*, which are formed in the stated order in the wire plug direction. The proximal end 223*a* is a flat plate-like portion that is connected to an end in the connector width direction of the base plate portion 219 and is orthogonal to the connector width direction. The inclined portion 223*b* is a flat plate-like portion that is connected to an end in the wire plug direction of the proximal end 223*a* and is inclined in the connector width center direction toward the wire plug direction. The distal end 223*c* is a flat plate-like portion that is connected to an end in the wire plug direction of the inclined portion 223*b* and is orthogonal to the connector width direction. Due to the presence of the inclined portion 223*b*, the distance between the distal end 223*c* of one of the contact beams 223 and the distal end 223 of the other contact beam 223 is smaller than the distance between the proximal end 223*a* of one of the contact beams 223 and the proximal end 223*a* of the other contact beam 223. The distance between the distal end 223*c* of one of the contact beams 223 and the distal end 223*c* of the other contact beam 223 is set to be smaller than the thickness of the receptacle 6. Due to the presence of the proximal end 223*a* and the inclined portion 223*b*, the distal end 223*c* is elastically displaceable in the connector width anti-center direction. The contact beam 223 is disposed between the pushing plate portion 220 and the board 4 in the connector height direction. That is, it can be said that the pushing plate portion 220 is disposed opposite to the board 4 with the contact beam 223 interposed therebetween.

The erect rod guide portion 224 is a flat plate-like portion that is connected to an end in the board approaching direction of the proximal end 223*a* of the contact beam 223 and extends in the wire plug direction. The erect rod guide portion 224 is orthogonal to the connector height direction. At an end in the connector width center direction of the erect rod guide portion 224, a notch 224*a* which is opened in the connector width center direction is formed. The distance between one of the erect rod guide portions 224 and the other erect rod guide portion 224 is set to be as small as possible. The notch 224*a* of one of the erect rod guide portion 224 and the notch 224*a* of the other erect rod guide portion 224 constitute an erect rod guide hole portion 222 (guide hole portion).

The lock unit 225 includes a lock beam 227 and a claw portion 228. The lock beam 227 is a portion that is connected to the proximal end 223*a* of the contact beam 223 and extends in a rod shape in the board approaching direction. The lock beam 227 is formed in a cantilever shape that is supported by the proximal end 223*a*. The claw portion 228 is a portion that is connected to an end in the board approaching direction of the lock beam 227 and protrudes in the plug wire direction.

The contact piece guide portion 226 is a flat plate-like portion that is connected to an end in the board approaching direction of the distal end 223*c* of the contact beam 223 and is inclined in the connector width anti-center direction toward the board approaching direction.

(Receptacle 6)

Figure 13:
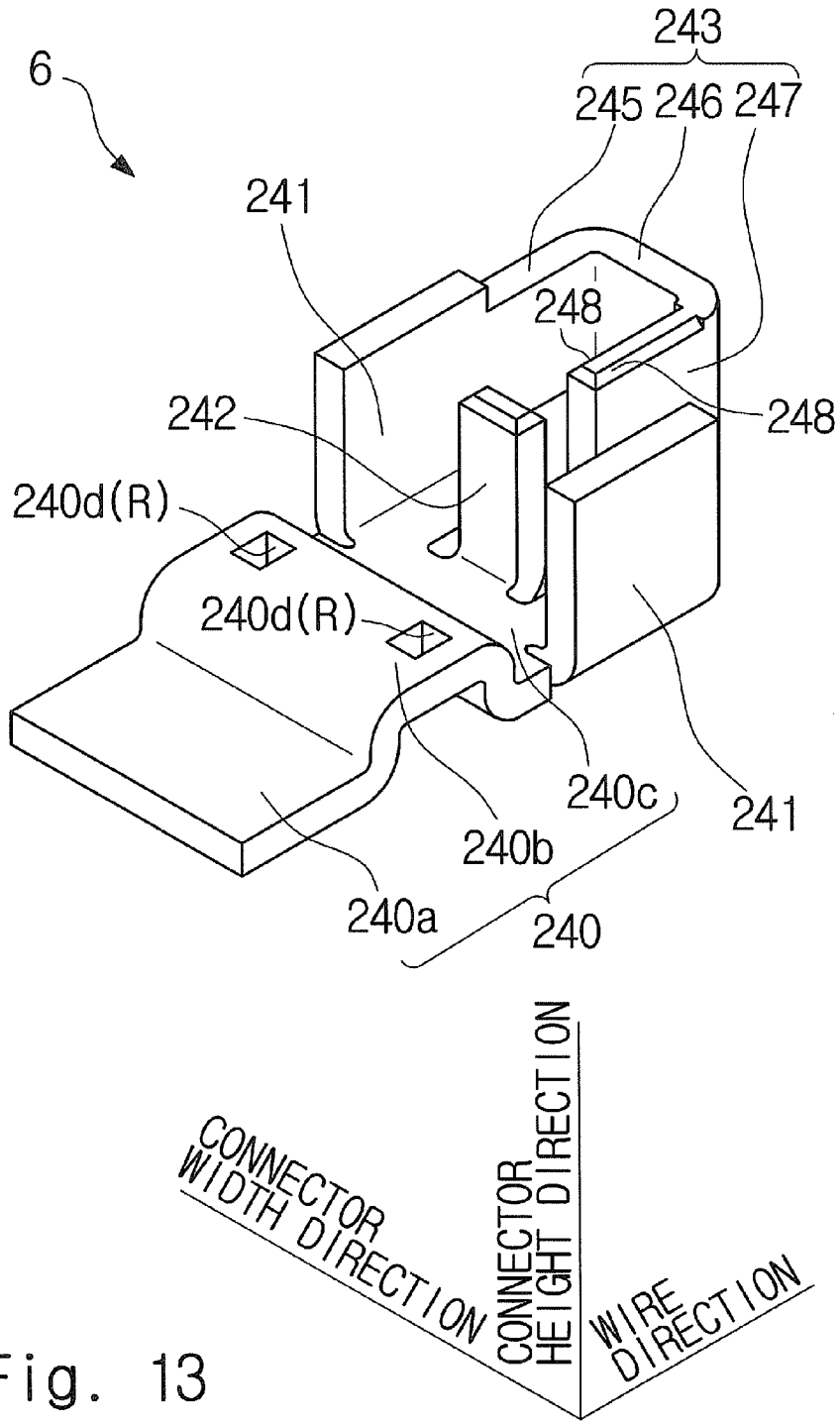
FIG. 13 is a perspective view of a receptacle (third embodiment)
Figure 14:
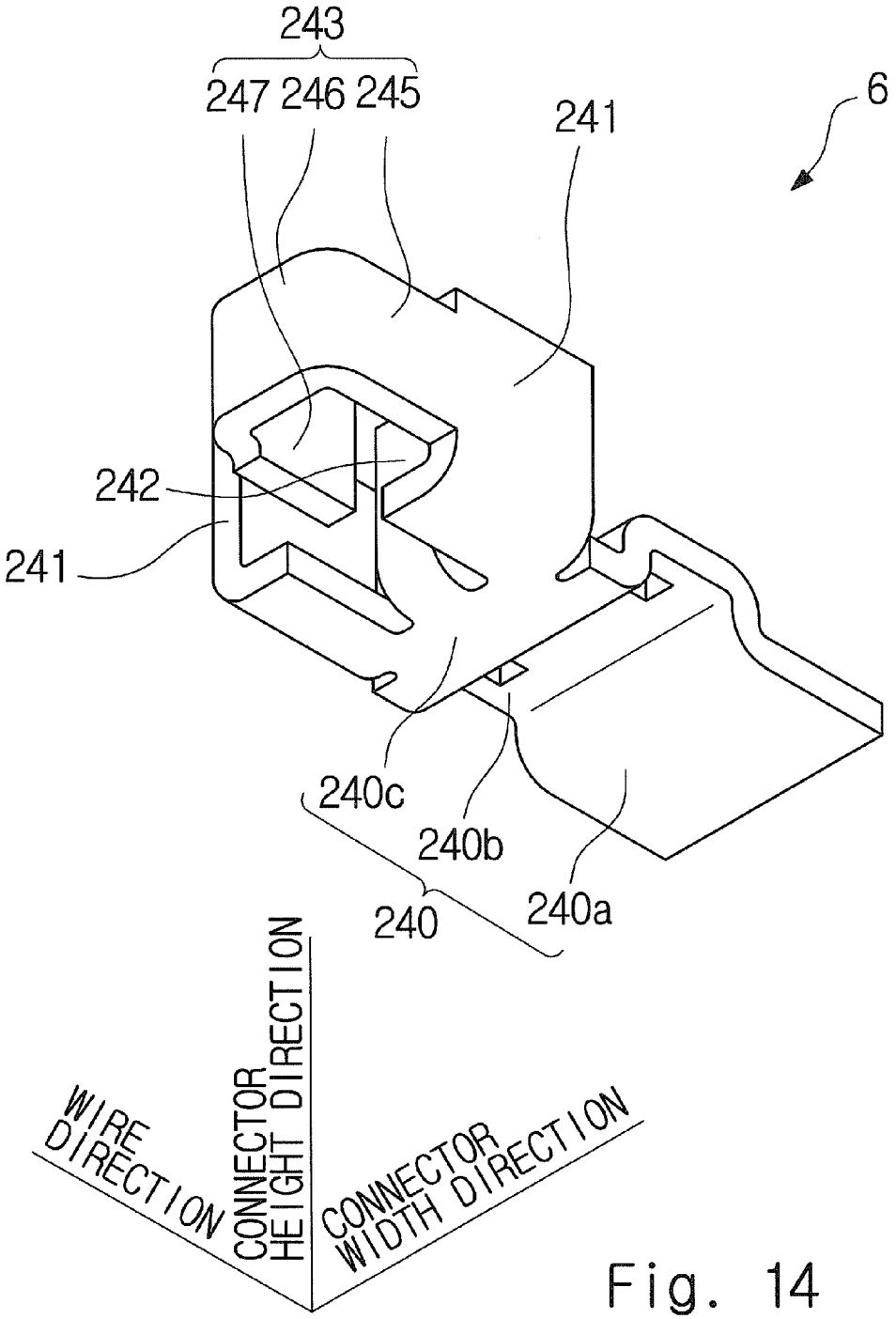
FIG. 14 is a perspective view of the receptacle when viewed from another angle (third embodiment)

As shown in FIGS. 13 and 14, the receptacle 6 is formed to be elongated in the wire direction. The receptacle 6 includes a base plate portion 240, a pair of side plate portions 241, an erect rod 242 (guide rod portion), and a contact unit 243.

The base plate portion 240 is a portion that is soldered to the electrode pad 7 (see FIGS. 1 and 2) on the connector mounting surface 5 of the board 4. The base plate portion 240 is formed to be elongated in the wire direction. The base plate portion 240 includes a first soldered portion 240*a*, a lock plate portion 240*b*, and a second soldered portion 240*c*, which are formed in the stated order in the wire plug direction. The first soldered portion 240*a* is formed in a flat plate shape orthogonal to the connector height direction. The lock plate portion 240*b* is connected to an end in the wire plug direction of the first soldered portion 240*a*, is slightly raised in the board separating direction relative to the first soldered portion 240*a*, and is formed in a flat plate shape orthogonal to the connector height direction. A pair of lock hole portions 240*d* are respectively formed at both ends in the connector width direction of the lock plate portion 240*b*. The second soldered portion 240*c* is connected to an end in the wire plug direction of the lock plate portion 240*b*, is slightly recessed in the board approaching direction relative to the lock plate portion 240*b*, and is formed in a flat plate shape orthogonal to the connector height direction. The first soldered portion 240*a* and the second soldered portion 240*c* are soldered to the electrode pad 7 on the connector mounting surface 5 of the board 4.

The pair of side plate portions 241 is formed in a symmetrical shape in the connector width direction. Accordingly, only one of the pair will be described, and the description of the other one of the pair will be omitted. The side plate portion 241 is connected to an end in the connector width direction of the second soldered portion 240*c* of the base plate portion 240, and is formed to protrude in the board separating direction. The side plate portion 241 is positioned so as to be erected at a right angle with respect to the base plate portion 240. That is, the side plate portion 241 is in a position orthogonal to the connector width direction.

The erect rod 242 is a portion that is disposed at the center in the connector width direction of the receptacle 6 and is formed in a rod shape extending in the board separating direction from the base plate portion 240. The erect rod 242 is formed by lancing an end in the wire plug direction of the second soldered portion 240*c* of the base plate portion 240. The erect rod 242 is positioned so as to be erected at a right angle with respect to the second soldered portion 240*c* of the base plate portion 240.

The contact unit 243 is a portion that functions as a contact with the plug 3. The contact unit 243 is disposed at a location closer to a side in the wire plug direction than the base plate portion 240, the pair of side plate portions 241, and the erect rod 242. The contact unit 243 is supported by one of the side plate portions 241. The contact unit 243 includes a unit proximal end 245, a unit intermediate portion 246, and a contact piece 247. The unit proximal end 245 is a portion that is connected to an end in the wire plug direction of one of the side plate portions 241. The unit proximal end 245 is orthogonal to the connector width direction. The unit intermediate portion 246 is a portion that is connected to an end in the wire plug direction of the unit proximal end 245 and extends in the connector width center direction. The unit intermediate portion 246 is orthogonal to the wire direction. The unit intermediate portion 246 extends to the center in the connector width direction of the receptacle 6. The contact piece 247 is a portion that is connected to an end in the connector width center direction of the unit intermediate portion 246 and extends in the plug wire direction. The contact piece 247 is orthogonal to the connector width direction. At an end in the board separating direction of the contact piece 247, a pair of inclined surfaces 248 is formed in such a manner that the end in the board separating direction of the contact piece 247 is tapered in the board separating direction. Due to the presence of the unit proximal end 245, the unit intermediate portion 246, and the contact piece 247, the contact unit 243 forms a U-shape when viewed along the board approaching direction. As shown in FIG. 14, the contact piece 247 of the contact unit 243 is formed so as to be away from the base plate portion 240. The contact piece 247 is supported by one of the side plate portions 241 in a slightly floating state relative to the base plate portion 240 so that the gap "g" (also see FIG. 7) is formed between the contact piece 247 and the electrode pad 7 when the receptacle 6 is soldered to the electrode pad 7 on the connector mounting surface 5 of the board 4. To put it briefly, the contact piece 247 is disposed at a location farther from the board 4 than the base plate portion 240.

(Mating Operation)

Figure 15:
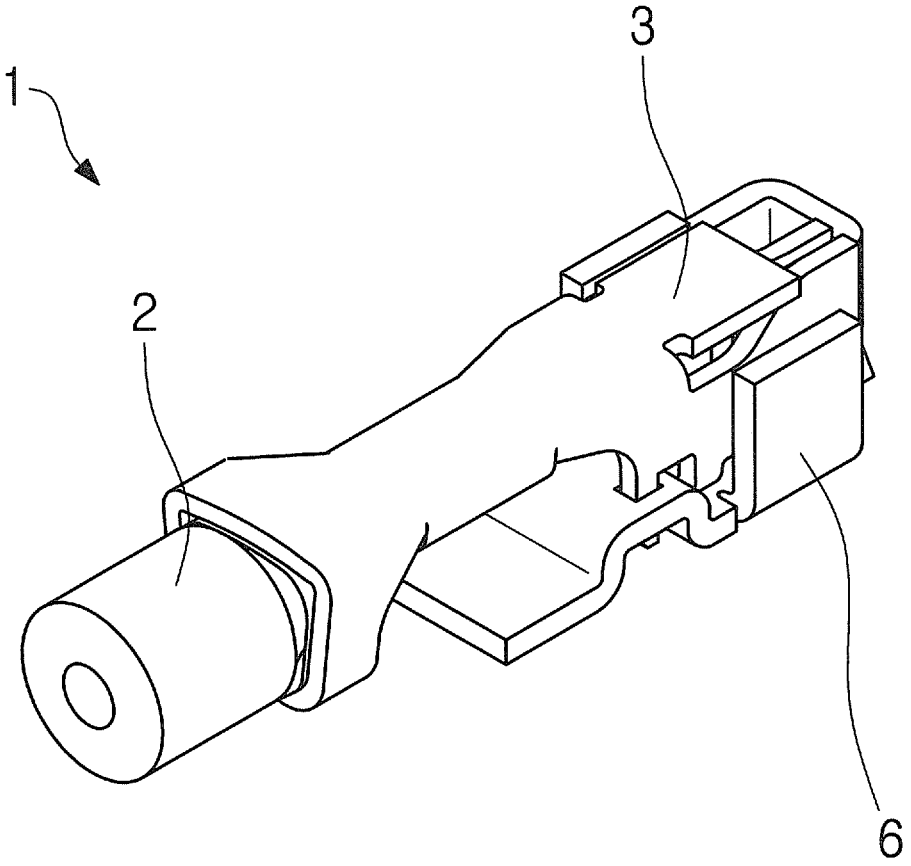
FIG. 15 is a perspective view of a wire-to-board connector in a state where the plug is attached to the receptacle (third embodiment)
Figure 15:
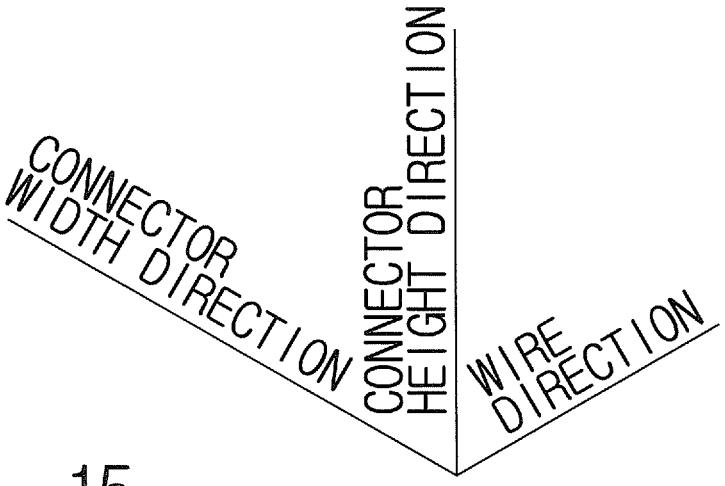

Next, the mating operation for mating the plug 3 with the receptacle 6 will be described. For reference, FIG. 15 shows a state in which the plug 3 is mated with the receptacle 6.

First, as shown in FIG. 2, the wire 2 is attached to the plug 3, and the plug 3 is moved toward the receptacle 6. The direction of movement of the plug 3 toward the receptacle 6 is indicated by the above-mentioned mating direction P. At this time, the plug 3 is moved toward the receptacle 6 in such a manner that the erect rod 242 shown in FIG. 13 is inserted into the erect rod guide hole portion 222 shown in FIG. 12.

When the erect rod 242 shown in FIG. 13 is inserted into the erect rod guide hole portion 222 shown in FIG. 12, the position of the plug 3 in the wire direction and the connector width direction relative to the receptacle 6 is determined. Substantially at the same time, the pair of contact piece guide portions 226 shown in FIG. 12 contacts the pair of inclined surfaces 248 of the contact piece 247 shown in FIG. 13, and the claw portions 228 of the pair of lock units 225 shown in FIG. 11 contact the periphery of the lock hole portions 240*d* of the pair of lock plate portions 240*b* shown in FIG. 13.

In this state, when the plug 3 is pushed in the board approaching direction by using the pair of pushing plate portions 220 of the plug body 12 shown in FIG. 11, the plug 3 and the receptacle 6 behave in the following manner.

(1) The plug body 212 of the plug 3 shown in FIG. 11 is fitted between the pair of side plate portions 241 of the receptacle 6 shown in FIG. 13. As a result, the pair of side plate portions 241 of the receptacle 6 sandwich the plug body 212 of the plug 3 in the connector width direction.

(2) The erect rod 242 shown in FIG. 13 is deeply inserted into the erect rod guide hole portion 222 shown in FIG. 12.

(3) The contact piece 247 shown in FIG. 13 is inserted between the distal ends 223*c* of the pair of contact beams 223, while the pair of contact beams 223 shown in FIG. 12 is elastically deformed. As a result, the distal ends 223*c* of the pair of contact beams 223 of the plug 3 are allowed to reliably contact the contact piece 147 of the receptacle 6 by the spring restoring force of the contact beams 223.

(4) The claw portion 228 of each lock unit 225 shown in FIG. 12 is inserted into the corresponding lock hole portion 240*d* of the lock plate portion 240*b* of the base plate portion 240 shown in FIG. 13, while the lock beam 227 of each lock unit 225 is elastically deformed. Then, each claw portion 228 is caught on the periphery of the corresponding lock hole portion 240*d*. As a result, the plug 3 is prevented from being disengaged from the receptacle 6 when the wire 2 is pulled in the board separating direction. In this embodiment, the lock mechanism R includes the claw portion 228 and the lock hole portion 240*d*.

Fourth Embodiment

Next, a fourth embodiment of the present invention will be described with reference to FIGS. 16 to 26. Here, differences between this embodiment and the first embodiment will be mainly described, while a repeat of previous descriptions is omitted as appropriate.

Figure 16:
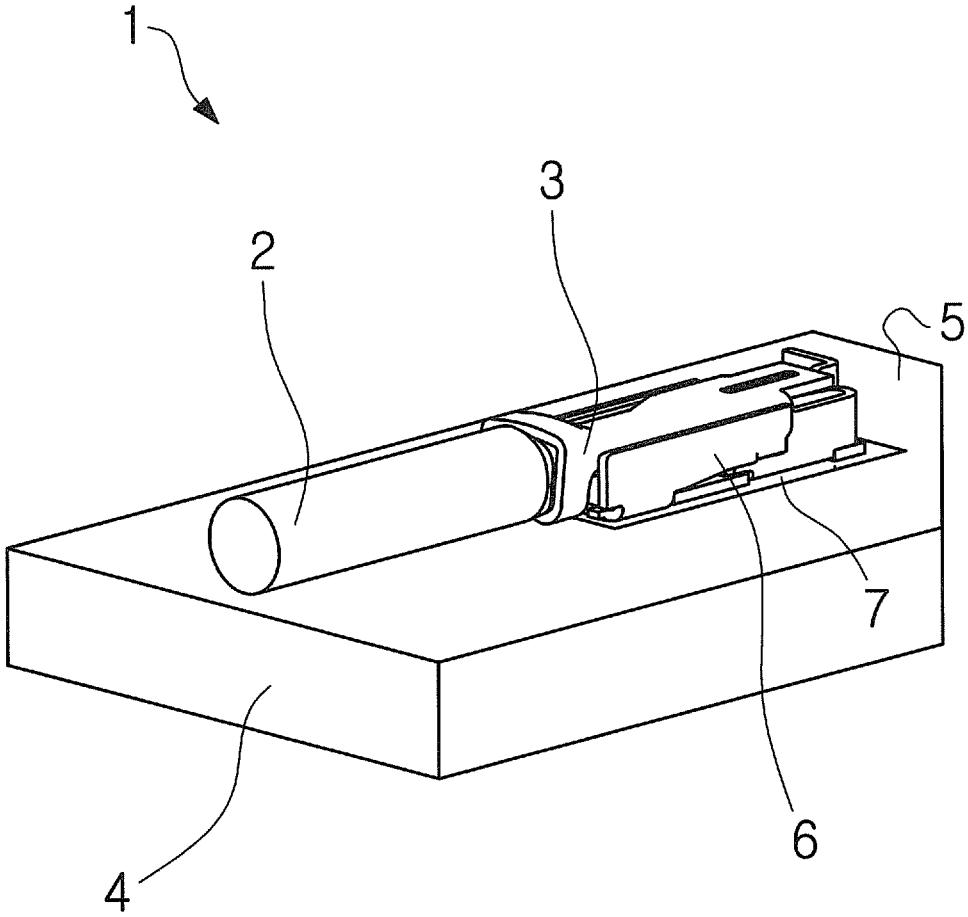
FIG. 16 is a perspective view of a wire-to-board connector in use (fourth embodiment)
Figure 16:
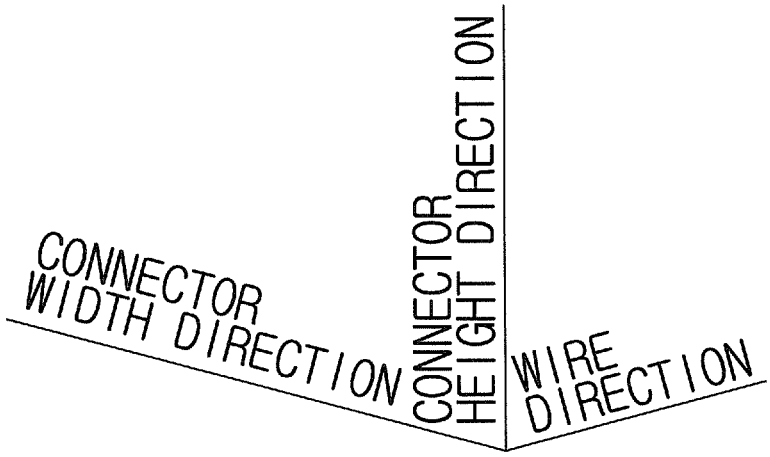
Figure 17:
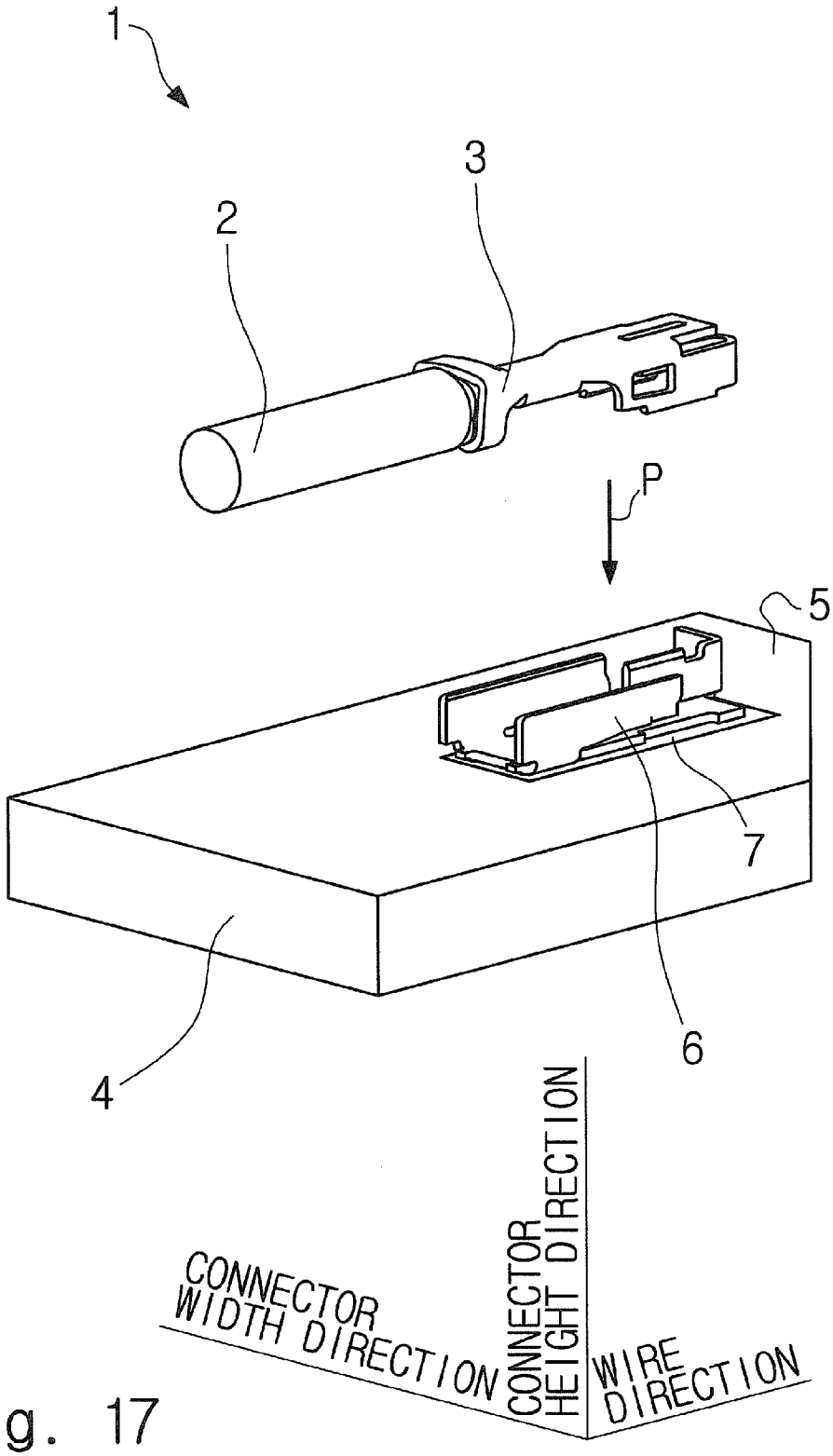
FIG. 17 is a perspective view of the wire-to-board connector in a state before a plug is attached to a receptacle (fourth embodiment)

As shown in FIGS. 16 and 17, the wire-to-board connector 1 includes the plug 3 which is attached to the wire 2, and the receptacle 6 which is mounted on the connector mounting surface 5 of the board 4. The plug 3 and the receptacle 6 are each formed of metal. The plug 3 and the receptacle 6 are formed by sheet metal bending. Each of the plug 3 and the receptacle 6 is a so-called insulator-less terminal (housing-less terminal) with no insulator. The plug 3 is mated with the receptacle 6, thereby allowing the wire 2 to be electrically connected to the board 4.

As shown in FIG. 17, the mating direction P in which the plug 3 is mated with the receptacle 6 is a direction approaching the connector mounting surface 5 of the board 4. Accordingly, the workability that allows the plug 3 to be mated with the receptacle 6 is favorable. In this embodiment, the mating direction P coincides with the board approaching direction. Accordingly, the workability that allows the plug 3 to be mated with the receptacle 6 is more favorable.

(Plug 3)

Figure 18:
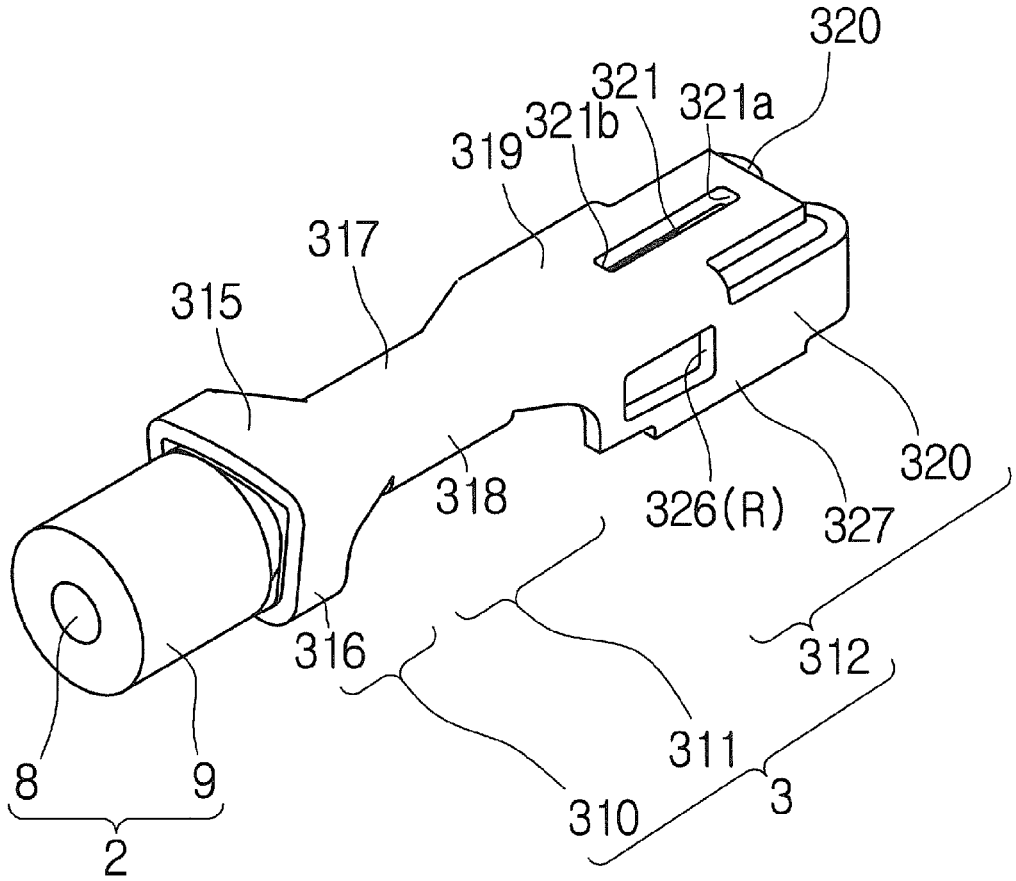
FIG. 18 is a perspective view of the plug (fourth embodiment)
Figure 18:
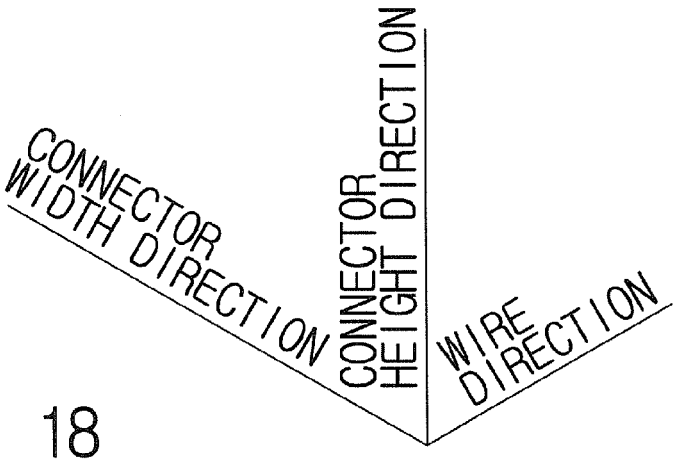
Figure 19:
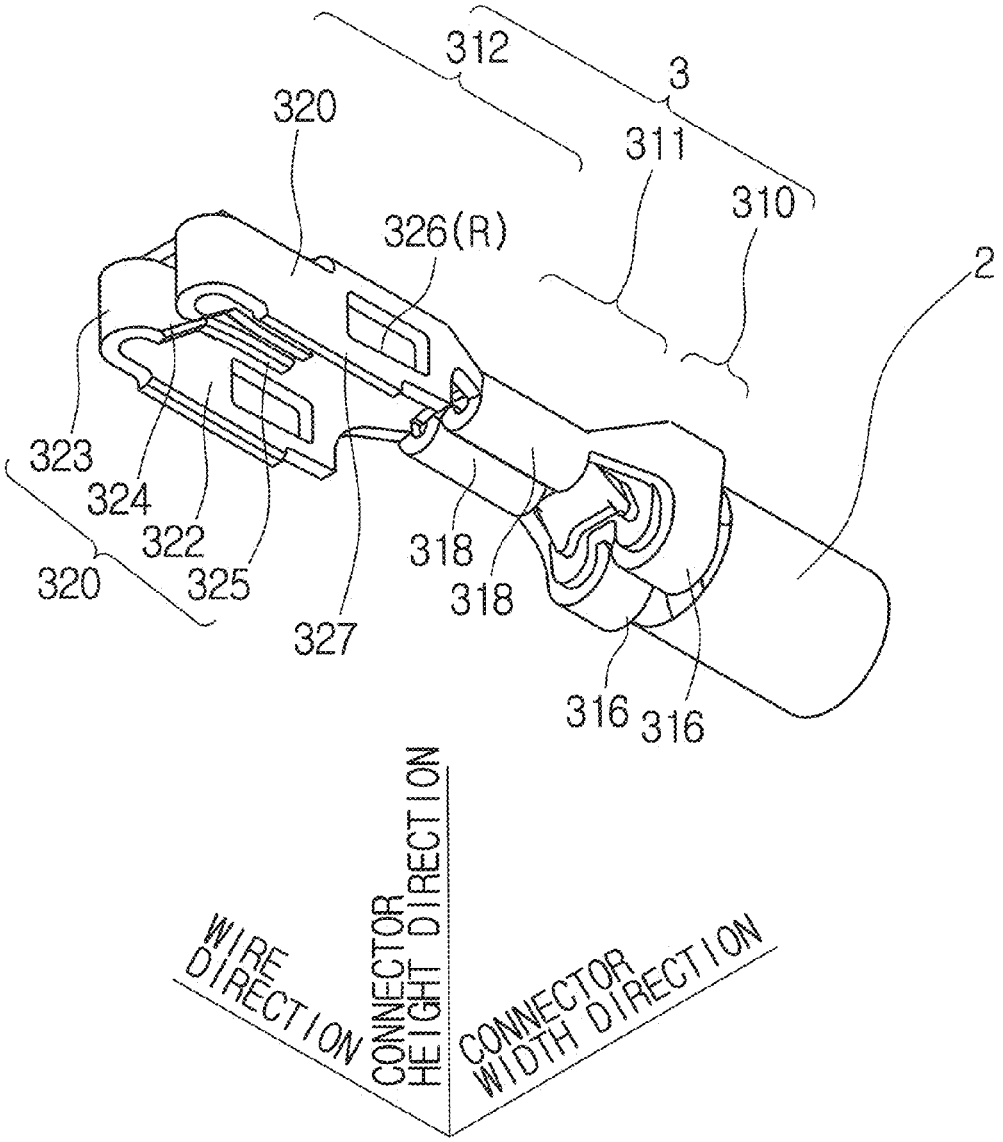
FIG. 19 is a perspective view of the plug when viewed from another angle (fourth embodiment)

FIGS. 18 and 19 show the plug 3 in a state where the wire 2 is attached to the plug 3. As shown in FIGS. 18 and 19, the plug 3 is formed to be elongated along the wire direction. The plug 3 includes a wire holding portion 310, a wire connecting portion 311 (central conductor holding portion), and a plug body 312, which are formed in the stated order in the wire plug direction. The plug 3 is integrally formed with the wire holding portion 310, the wire connecting portion 311, and the plug body 312.

The wire holding portion 310 is a portion that crimps and holds the insulation 9 of the wire 2. The wire holding portion 310 includes a base plate portion 315 and a pair of holding portions 316. The base plate portion 315 is a flat plate-like portion orthogonal to the connector height direction. The pair of holding portions 316 are respectively connected to both ends in the connector width direction of the base plate portion 315, and protrude in the board approaching direction. An end in the board approaching direction of each holding portion 316 is bent by a dedicated crimp tool, and is thus curved in the connector width center direction.

The wire connecting portion 311 is a portion that crimps and holds the strand wire 8 of the wire 2. The wire connecting portion 311 is electrically connected to the strand wire 8 of the wire 2. The wire connecting portion 311 includes a base plate portion 317 and a pair of holding portions 318. The base plate portion 317 is a flat plate-like portion orthogonal to the connector height direction. The base plate portion 317 is connected to an end in the wire plug direction of the base plate portion 315 of the wire holding portion 310. The pair of holding portions 318 are respectively connected to both ends in the connector width direction of the base plate portion 317 and protrude in the board approaching direction. Each holding portion 318 is bent by a dedicated crimp tool, and is thus curved in a C-shape toward the connector width center direction. Each holding portion 318 is curved so as to swell out in the board approaching direction.

The plug body 312 includes a base plate portion 319, a pair of contact beams 320, and a pair of protrusions 327.

The base plate portion 319 is a flat plate-like portion that is connected to an end in the wire plug direction of the base plate portion 317 of the wire connecting portion 311 and extends in the wire plug direction. The base plate portion 319 is orthogonal to the connector height direction. At the center in the connector width direction of the base plate portion 319, a slit 321 which extends in the wire direction is formed. The base plate portion 319 includes a distal end inner wall surface 321*a* which defines a space in the wire plug direction of the slit 321, and a proximal end inner wall surface 321*b* which defines a space in the plug wire direction of the slit 321.

The pair of contact beams 320 and the pair of protrusions 327 are each formed in a symmetrical shape in the connector width direction. Accordingly, only one of each pair will be described, and the description of the other one of each pair will be omitted.

The contact beam 320 is a portion that functions as a contact with the receptacle 6. The contact beam 320 is formed in a beam shape. The contact beam 320 is formed in a cantilever shape. The contact beam 320 is a cantilever supported by the base plate portion 319. The contact beam 320 is connected to an end in the connector width direction of the base plate portion 319 and is positioned so as to be erected at a right angle with respect to the base plate portion 319. The contact beam 320 is a cantilever which is formed in a U-shape that is opened in the plug wire direction when viewed along the board separating direction. The contact beam 320 includes a side plate portion 322, a curved portion 323, an inclined portion 324, and a contact portion 325.

Figure 20:
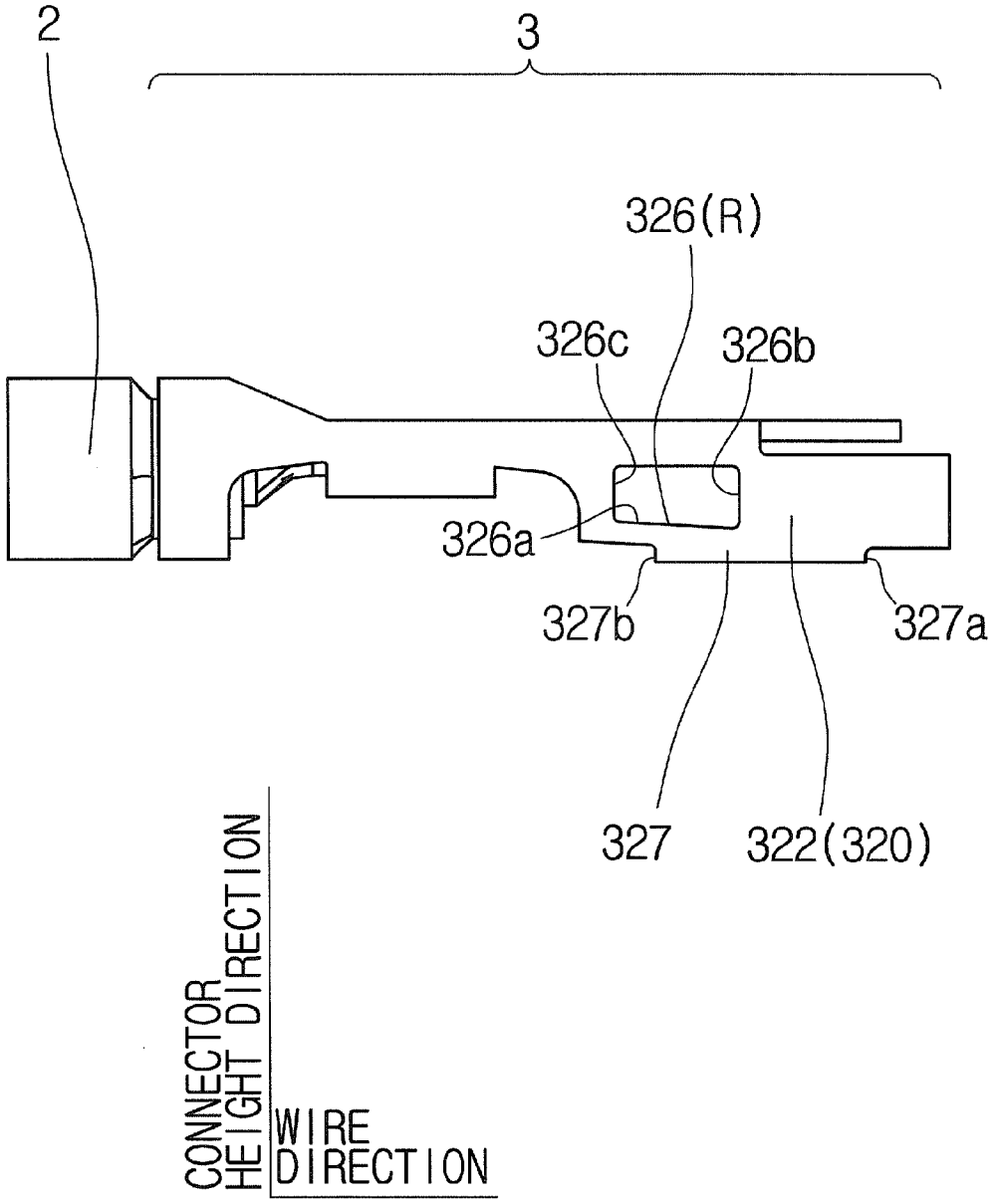
FIG. 20 is a side view of the plug (fourth embodiment)

The side plate portion 322 is a portion that is connected to an end in the connector width direction of the base plate portion 319 and extends in the wire plug direction. The side plate portion 322 is orthogonal to the connector width direction. As shown in FIG. 20, a lock hole portion 326 having a rectangular shape is formed on a side in the plug wire direction of the side plate portion 322. The side plate portion 322 includes a board-side inner wall surface 326*a* which defines a space in the board approaching direction of the lock hole portion 326, a plug-side inner wall surface 326*b* which defines a space in the wire plug direction of the lock hole portion 326, and a wire-side inner wall surface 326*c* which defines a space in the plug wire direction of the lock hole portion 326. The board-side inner wall surface 326*a* is formed so as to be inclined in the board approaching direction toward the wire plug direction. The plug-side inner wall surface 326*b* and the wire-side inner wall surface 326*c* are orthogonal to the wire direction.

The curved portion 323 is a portion that is connected to an end in the wire plug direction of the side plate portion 322 and is curved in a C-shape toward the connector width center direction.

The inclined portion 324 is a portion that is connected to an end on a side opposite to the side plate portion 322 of the curved portion 323 and extends in the plug wire direction. The inclined portion 324 is inclined in the connector width center direction toward the plug wire direction when viewed along the board separating direction.

The contact portion 325 is a portion that is connected to an end in the plug wire direction of the inclined portion 324 and extends in the plug wire direction. The distance between the contact portion 325 of one of the contact beams 320 and the contact portion 325 of the other contact beam 320 is set to be smaller than the thickness of the receptacle 6. Due to the presence of the inclined portion 324 and the curved portion 323, the contact portion 325 is elastically deformable in the connector width anti-center direction.

The protrusion 327 is a portion that protrudes in the board approaching direction in a central portion in the wire direction of the side plate portion 322. As shown in FIG. 20, the protrusion 327 includes a plug-side end face 327*a* which is an end face in the wire plug direction of the protrusion 327, and a wire-side end face 327*b* which is an end face in the plug wire direction of the protrusion 327.

(Receptacle 6)

Figure 21:
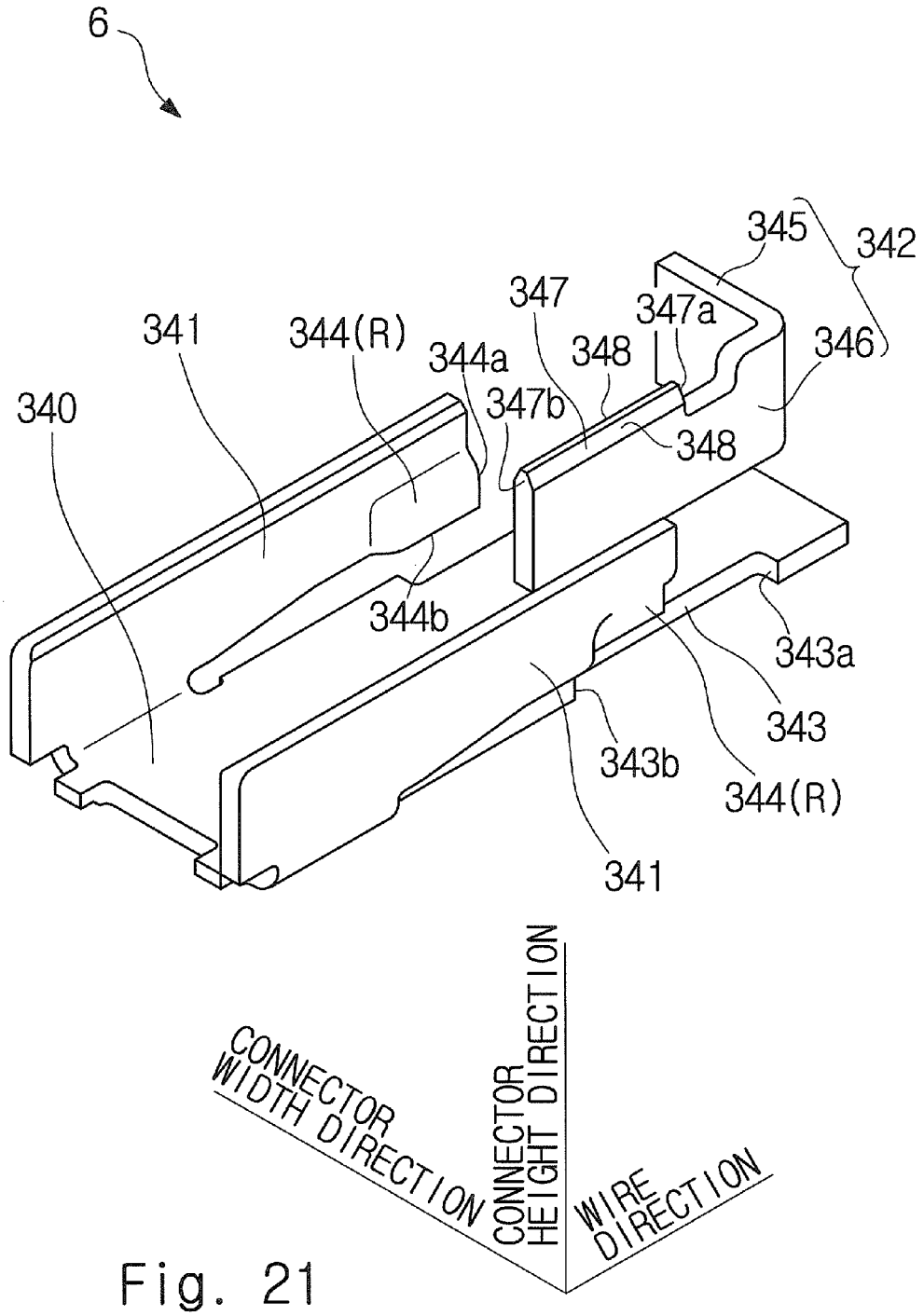
FIG. 21 is a perspective view of the receptacle (fourth embodiment)
Figure 22:
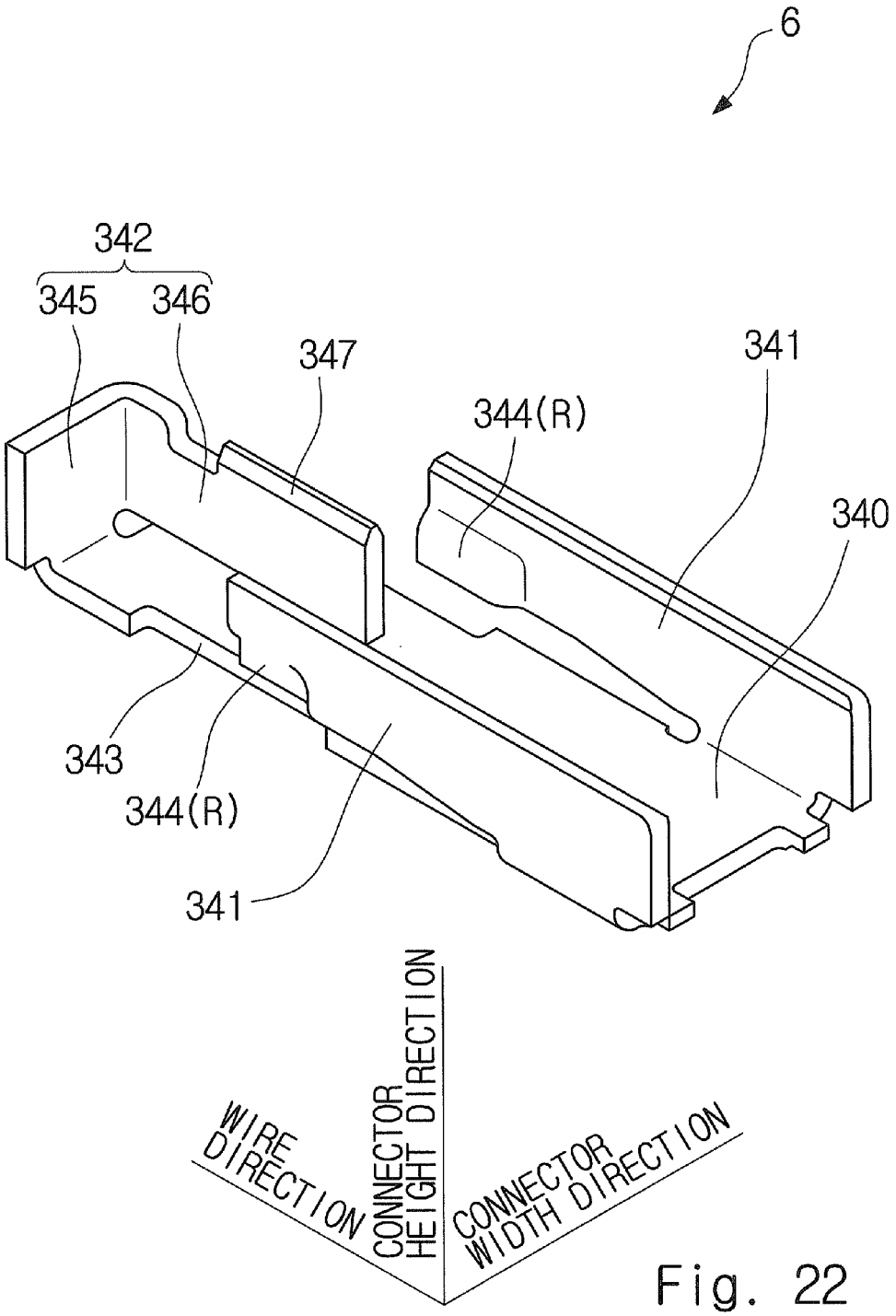
FIG. 22 is a perspective view of the receptacle when viewed from another angle (fourth embodiment)

As shown in FIGS. 21 and 22, the receptacle 6 is formed to be elongated in the wire direction. The receptacle 6 includes a base plate portion 340, a pair of lock beams 341, and a contact unit 342.

The base plate portion 340 is a portion that is soldered to the electrode pad 7 (see FIGS. 16 and 17) on the connector mounting surface 5 of the board 4. The base plate portion 340 is formed to be elongated in the wire direction. The base plate portion 340 is orthogonal to the connector height direction. Notches 343 which are opened in the connector width anti-center direction are respectively formed at both ends in the connector width direction of the base plate portion 340. The pair of notches 343 is formed on a side in the wire plug direction of the base plate portion 340. The base plate portion 340 includes a plug-side inner wall surface 343*a* which defines a space in the wire plug direction of the notches 343, and a wire-side inner wall surface 343*b* which defines an area on the side in the wire plug direction of the notches 343.

The pair of lock beams 341 is formed in a symmetrical shape in the connector width direction. Accordingly, only one of the pair will be described, and the description of the other one of the pair will be omitted. The lock beam 341 is connected to an end in the plug wire direction of the base plate portion 340 and is formed so as to extend in the wire plug direction. The lock beam 341 is positioned so as to be erected at a right angle with respect to the base plate portion 340. The lock beam 341 is orthogonal to the connector width direction. At an end in the wire plug direction of the lock beam 341, a lock raised portion 344 that is raised in the connector width center direction is formed. The lock raised portion 344 is formed at an end in the board approaching direction of the end in the wire plug direction of the lock beam 341. The lock raised portion 344 includes a plug-side end face 344*a* that faces in the wire plug direction, and a board-side end face 344*b* that faces in the board approaching direction. The lock raised portion 344 is elastically displaceable in the connector width anti-center direction, while the lock beam 341 is elastically deformed. Note that the length in the wire direction of the lock beam 341 is three-quarters of the length in the wire direction of the base plate portion 340.

Figure 23:
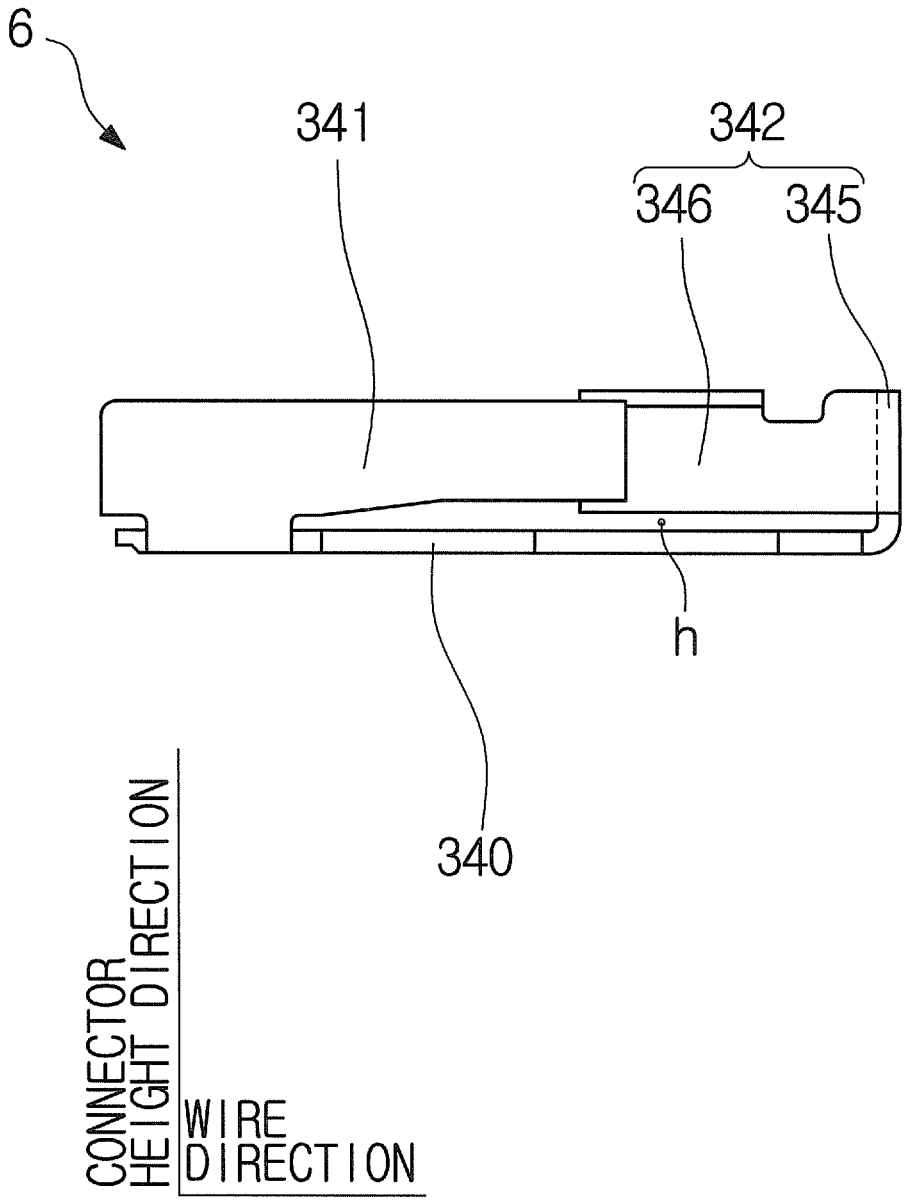
FIG. 23 is a side view of the receptacle (fourth embodiment)

The contact unit 342 is a portion that functions as a contact with the plug 3. The contact unit 342 is supported by the base plate portion 340. The contact unit 342 includes a unit proximal end 345 and a contact piece 346. The unit proximal end 345 is a portion that is connected to an end in the wire plug direction of the base plate portion 340 and protrudes in the board separating direction. The unit proximal end 345 is connected to a portion on one side in the connector width direction of the end in the wire plug direction of the base plate portion 340. The unit proximal end 345 is orthogonal to the wire direction. The contact piece 346 is connected to an end in the connector width center direction of the unit proximal end 345 and is formed so as to extend in the plug wire direction. The contact piece 346 is orthogonal to the connector width direction. The contact piece 346 has a tapered portion 347 that protrudes in the board separating direction. The tapered portion 347 is formed at an end in the board separating direction of the contact piece 346. The tapered portion 347 is formed on a side in the plug wire direction of the contact piece 346. The tapered portion 347 has a pair of inclined surfaces 348 in such a manner that the tapered portion 347 is tapered in the board separating direction. The tapered portion 347 includes a plug-side end face 347*a* that faces in the wire plug direction, and a wire-side end face 347*b* that faces in the plug wire direction. Due to the presence of the unit proximal end 345 and the contact piece 346, the contact unit 342 forms an L-shape when viewed along the board approaching direction. As shown in FIG. 23, the contact piece 346 of the contact unit 342 is formed so as to be away from the base plate portion 340. That is, a gap "h" is formed between the contact piece 346 of the contact unit 342 and the base plate portion 340. To put it briefly, the contact piece 346 is disposed at a location farther from the board 4 than the base plate portion 340.

(Mating Operation)

Figure 24:
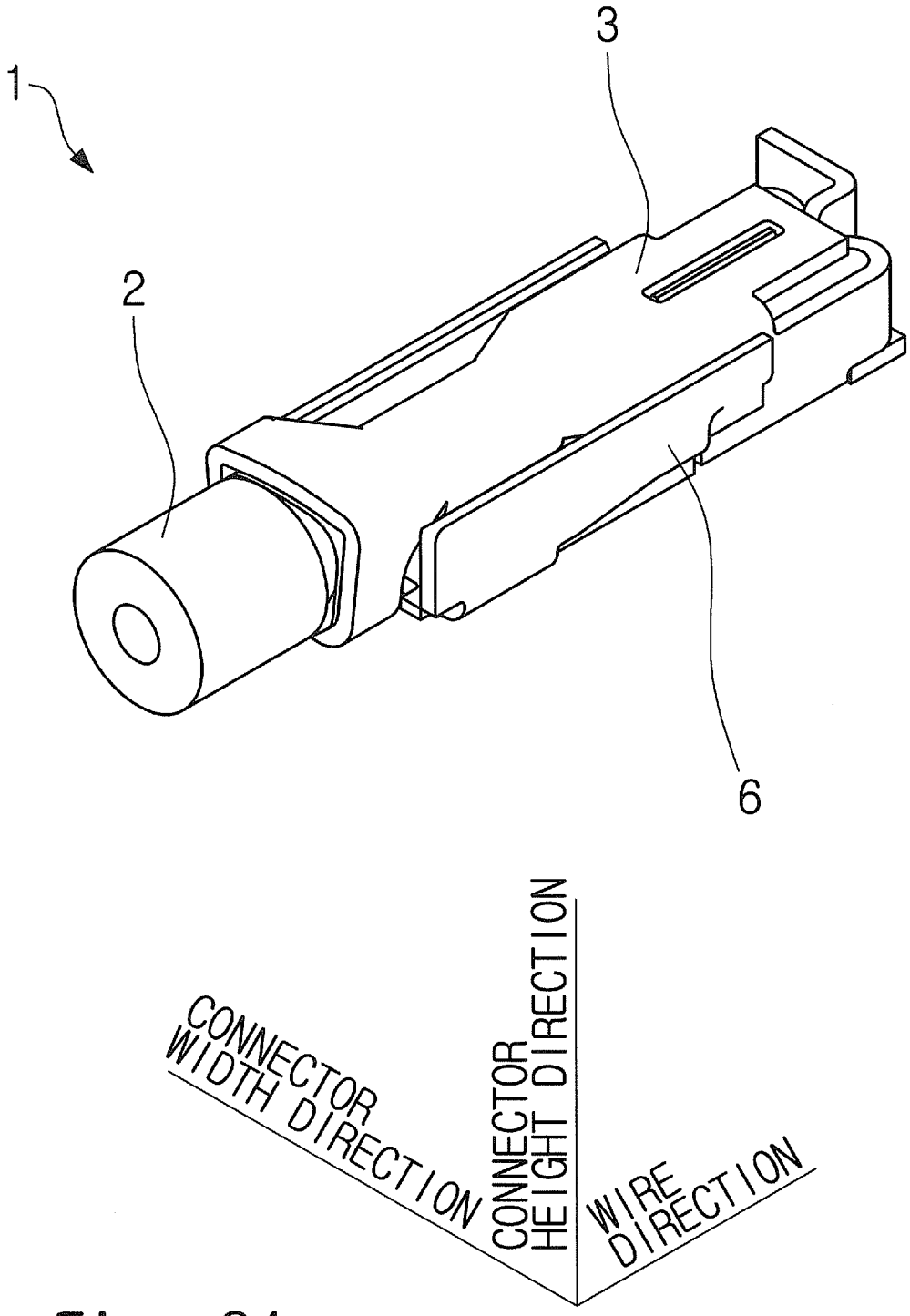
FIG. 24 is a perspective view of the wire-to-board connector in a state where the plug is attached to the receptacle (fourth embodiment)
Figure 25:
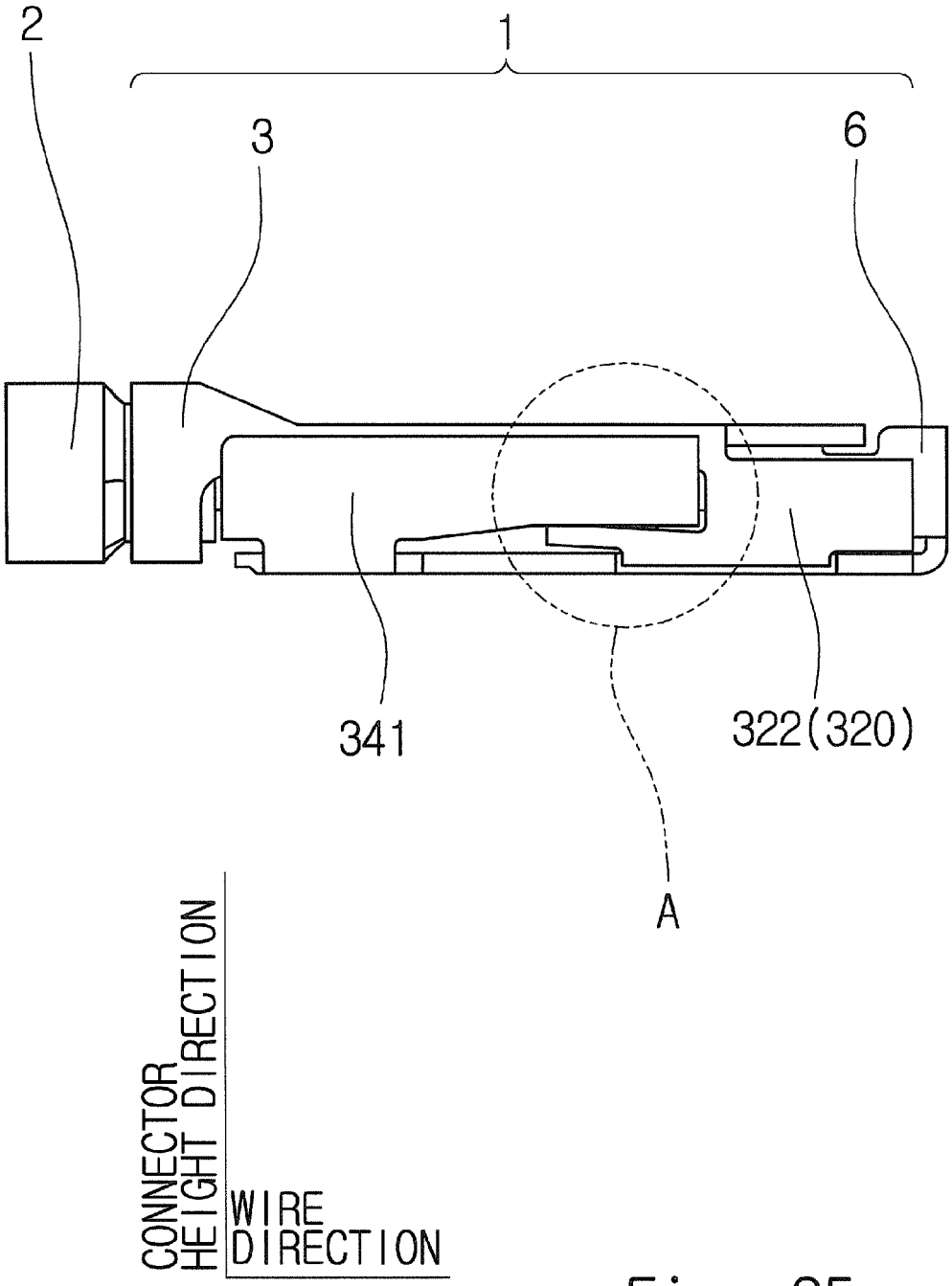
FIG. 25 is a side view of the wire-to-board connector (fourth embodiment)

Next, the mating operation for mating the plug 3 with the receptacle 6 will be described. For reference, FIGS. 24 and 25 show a state in which the plug 3 is mated with the receptacle 6.

First, as shown in FIG. 17, the wire 2 is attached to the plug 3, and the plug 3 is moved toward the receptacle 6. The direction of movement of the plug 3 toward the receptacle 6 is indicated by the above-mentioned mating direction P. At this time, the plug 3 is moved toward the receptacle 6 in such a manner that the side plate portions 322 of the pair of contact beams 320 of the plug body 312 of the plug 3 shown in FIG. 18 are fitted between the pair of lock beams 341 of the receptacle 6 shown in FIG. 21.

Then, the pair of contact portions 325 shown in FIG. 19 contacts the pair of inclined surfaces 348 of the tapered portion 347 shown in FIG. 21, and the pair of side plate portions 322 shown in FIG. 19 contacts the pair of lock raised portions 344 shown in FIG. 21.

In this state, when the plug 3 is pushed in the board approaching direction by using the base plate portion 319 of the plug body 312 shown in FIG. 18, the plug 3 and the receptacle 6 behave in the following manner.

(1) The contact piece 346 shown in FIG. 21 is inserted between the contact portions 325 of the pair of contact beams 320, while the pair of contact beams 320 shown in FIG. 19 is elastically deformed. As a result, the contact portions 325 of the pair of contact beams 320 of the plug 3 are allowed to reliably contact the contact piece 326 of the receptacle 6 by the spring restoring force of the contact beams 320.

(2) Eventually, the tapered portion 347 of the contact piece 346 shown in FIG. 21 is inserted into the slit 321 of the base plate portion 319 shown in FIG. 18. At this time, the plug-side end face 347*a* of the tapered portion 347 shown in FIG. 21 is opposed to the distal end inner wall surface 321*a* of the base plate portion 319 shown in FIG. 18. The wire-side end face 347*b* of the tapered portion 347 shown in FIG. 21 is opposed to the proximal end inner wall surface 321*b* of the base plate portion 319 shown in FIG. 18. This constrains the movement of the plug 3 in the wire direction relative to the receptacle 6.

Figure 26:
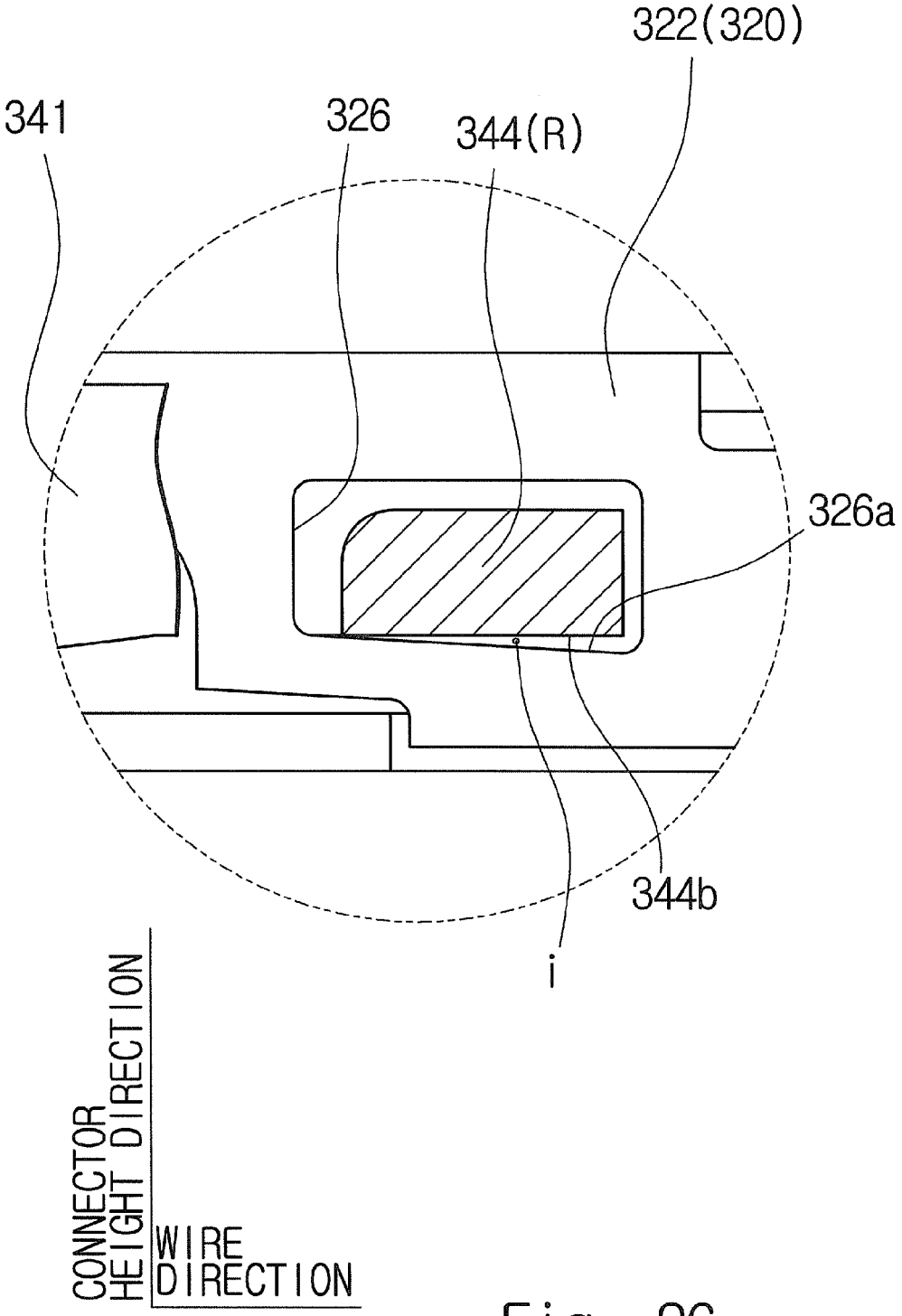
FIG. 26 is an enlarged view of a portion "A" shown in FIG. 25, and shows a lock raised portion accommodated in a lock hole portion (fourth embodiment)

(3) The pair of side plate portions 322 shown in FIG. 19 pushes out the pair of lock beams 341 through the pair of lock raised portions 344 shown in FIG. 21, and the pair of lock raised portions 344 is elastically displaced in the connector width anti-center direction. Then, the pair of lock raised portions 344 returns in the connector width center direction, and the pair of lock raised portions 344 are respectively accommodated in the pair of lock hole portions 326. The board-side end face 344*b* of the lock raised portion 344 shown in FIG. 21 is opposed to the board-side inner wall surface 326*a* of the lock hole portion 326 shown in FIG. 20. As a result, the plug 3 is prevented from being disengaged from the receptacle 6 when the wire 2 is pulled in the board separating direction. In this embodiment, the lock mechanism R is implemented by the lock raised portions 344 of the lock beams 341 shown in FIG. 21 and the lock hole portions 326 shown in FIG. 20. As shown in FIG. 26, the board-side inner wall surface 326*a* of the side plate portion 322 is inclined in the board approaching direction toward the wire plug direction. On the other hand, the board-side end face 344*b* of the lock raised portion 344 is orthogonal to the connector height direction. Accordingly, the gap "i" between the board-side end face 344*b* of the lock raised portion 344 and the board-side inner wall surface 326*a* of the side plate portion 322 becomes narrow toward the plug wire direction. As a result, when the wire 2 is pulled in the board separating direction, the rotation of the plug 3 within the receptacle 6 in such a manner that the wire holding portion 310 is disposed in the board separating direction can be effectively suppressed.

(4) When the lock raised portion 344 is accommodated in the lock hole portion 326, the plug-side end face 344*a* of the lock raised portion 344 shown in FIG. 21 is opposed to the plug-side inner wall surface 326*b* of the lock hole portion 326 shown in FIG. 20. As a result, the movement of the plug 3 in the wire plug direction relative to the receptacle 6 is constrained.

(5) The protrusion 327 shown in FIG. 20 is accommodated in the notch 343 shown in FIG. 21. The plug-side end face 327*a* of the protrusion 327 shown in FIG. 20 is opposed to the plug-side inner wall surface 343*a* of the notch 343 shown in FIG. 21, and the wire-side end face 327*b* of the protrusion 327 shown in FIG. 20 is opposed to the wire-side inner wall surface 343*b* of the notch 343 shown in FIG. 21. As a result, the movement of the plug 3 in the wire direction relative to the receptacle 6 is constrained.

Fifth Embodiment

Next, a fifth embodiment of the present invention will be described with reference to FIGS. 27 to 31. Here, differences between this embodiment and the fourth embodiment will be mainly described, while a repeat of previous descriptions is omitted as appropriate. Components corresponding to the components of the fourth embodiment described above are denoted by the same reference numerals as a rule.

(Plug 3)

Figure 27:
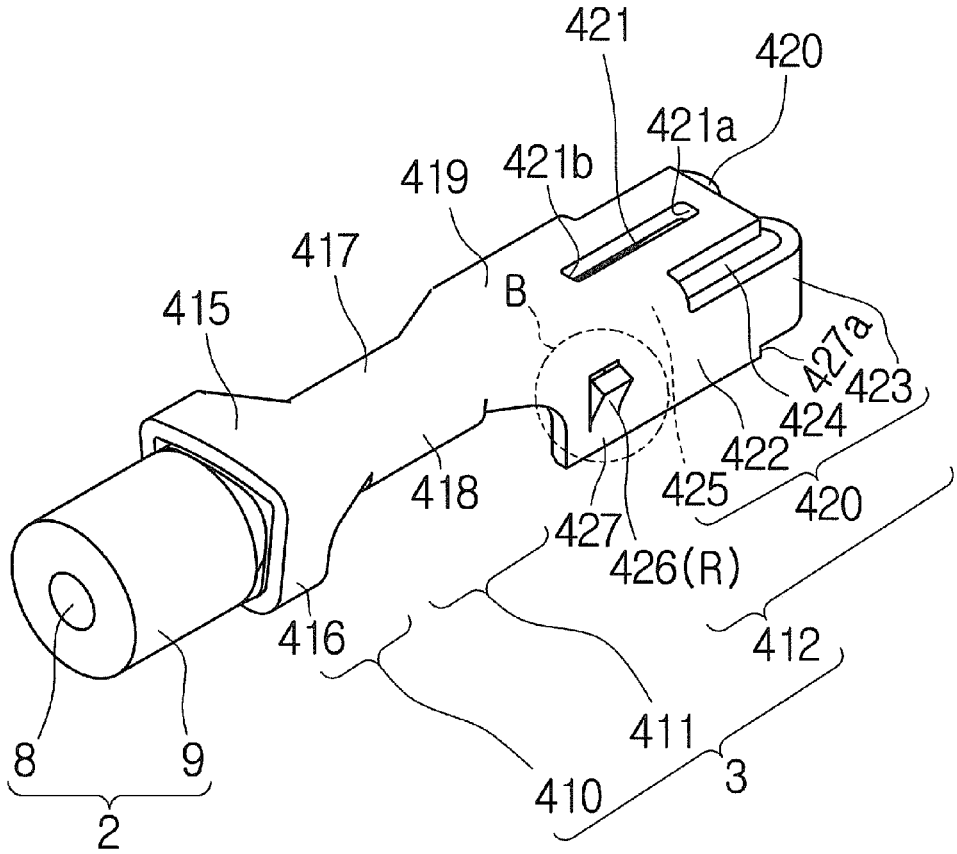
FIG. 27 is a perspective view of a plug (fifth embodiment)
Figure 27:
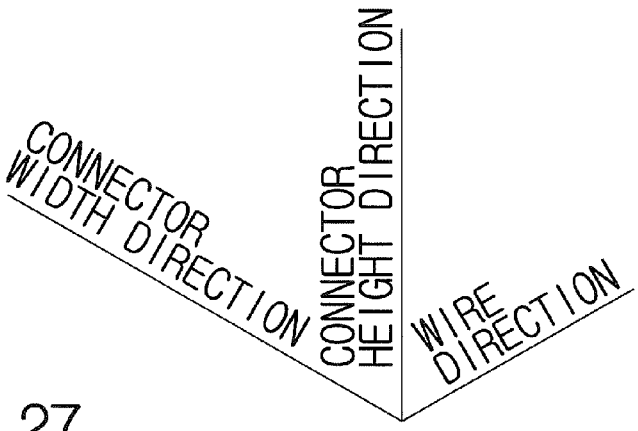

FIG. 27 shows the plug 3 in a state where the wire 2 is attached to the plug 3. As shown in FIG. 27, the plug 3 is formed to be elongated along the wire direction. The plug 3 includes a wire holding portion 410, a wire connecting portion 411 (central conductor holding portion), and a plug body 412, which are formed in the stated order in the wire plug direction. The plug 3 is integrally formed with the wire holding portion 410, the wire connecting portion 411, and the plug body 412.

The wire holding portion 410 is a portion that crimps and holds the insulation 9 of the wire 2. The wire holding portion 410 includes a base plate portion 415 and a pair of holding portions 416. The base plate portion 415 is a flat plate-like portion orthogonal to the connector height direction. The pair of holding portions 416 are respectively connected to both ends in the connector width direction of the base plate portion 415, and protrude in the board approaching direction. An end in the board approaching direction of each holding portion 416 is bent by a dedicated crimp tool, and is thus curved in the connector width center direction.

The wire connecting portion 411 is a portion that crimps and holds the strand wire 8 of the wire 2. The wire connecting portion 411 is electrically connected to the strand wire 8 of the wire 2. The wire connecting portion 411 includes a base plate portion 417 and a pair of holding portions 418. The base plate portion 417 is a flat plate-like portion orthogonal to the connector height direction. The base plate portion 417 is connected to an end in the wire plug direction of the base plate portion 415 of the wire holding portion 410. The pair of holding portions 418 are respectively connected to both ends in the connector width direction of the base plate portion 417, and protrude in the board approaching direction. Each holding portion 418 is bent by a dedicated crimp tool, and is thus curved in a C-shape toward the connector width center direction. Each holding portion 418 is curved so as to swell out in the board approaching direction.

The plug body 312 includes a base plate portion 419 and a pair of contact beams 420.

The base plate portion 419 is a flat plate-like portion that is connected to an end in the wire plug direction of the base plate portion 417 of the wire connecting portion 411 and extends in the wire plug direction. The base plate portion 419 is orthogonal to the connector height direction. At the center in the connector width direction of the base plate portion 419, a slit 421 which extends in the wire direction is formed. The base plate portion 419 includes a distal end inner wall surface 421*a* which defines a space in the wire plug direction of the slit 421, and a proximal end inner wall surface 421*b* which defines a space in the plug wire direction of the slit 421.

The pair of contact beams 420 is formed in a symmetrical shape in the connector width direction. Accordingly, only one of the pair will be described, and the description of the other one of the pair will be omitted.

The contact beam 420 is a portion that functions as a contact with the receptacle 6. The contact beam 420 is formed in a beam shape. The contact beam 420 is formed in a cantilever shape. The contact beam 420 is a cantilever supported by the base plate portion 419. The contact beam 420 is connected to an end in the connector width direction of the base plate portion 419, and is positioned so as to be erected at a right angle with respect to the base plate portion 419. The contact beam 420 is a cantilever which is formed in a U-shape that is opened in the plug wire direction when viewed along the board separating direction. The contact beam 420 includes a side plate portion 422, a curved portion 423, an inclined portion 424, and a contact portion 425. The shape of the contact beam 420 is completely identical with the shape of the contact beam 320 of the fourth embodiment. As for the inclined portion 424 and the contact portion 425, also refer to the inclined portion 324 and the contact portion 325 shown in FIG. 19.

Figure 28:
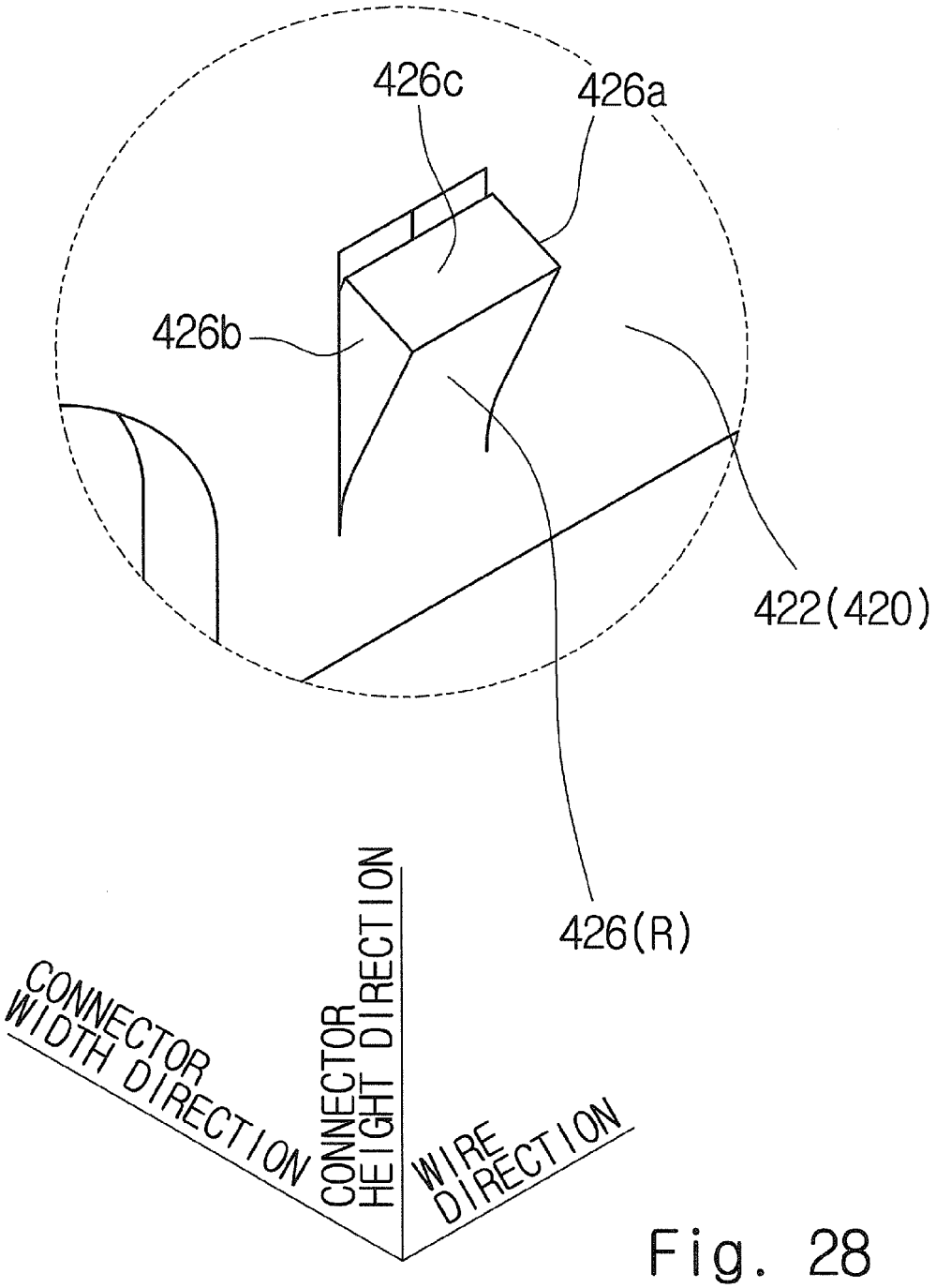
FIG. 28 is an enlarged view of a portion "B" shown in FIG. 27 (fifth embodiment)

The side plate portion 422 is a portion that is connected to an end in the connector width direction of the base plate portion 419 and extends in the wire plug direction. The side plate portion 422 is orthogonal to the connector width direction. On a side in the plug wire direction of the side plate portion 422, a lock claw portion 426 which rolls back in the connector width anti-center direction is formed. The lock claw portion 426 is formed by lancing a portion which is located on a side in the plug wire direction of the side plate portion 422. The lock claw portion 426 is formed as a cantilever which rolls back in the connector width anti-center direction toward the board separating direction. As shown in FIG. 28, the lock claw portion 426 includes a plug-side end face 426*a* that faces in the wire plug direction, a wire-side end face 426*b* that faces in the plug wire direction, and a distal end face 426*c* that faces in substantially the board separating direction. The side plate portion 422 includes a protrusion 427 that protrudes in the board approaching direction. The protrusion 427 includes a plug-side end face 427*a* which is an end face in the wire plug direction of the protrusion 427.

The curved portion 423 is a portion that is connected to an end in the wire plug direction of the side plate portion 422 and is curved in a C-shape toward the connector width center direction.

The inclined portion 424 is a portion that is connected to an end on a side opposite to the side plate portion 422 of the curved portion 423 and extends in the plug wire direction. The inclined portion 424 is inclined in the connector width center direction toward the plug wire direction.

The contact portion 425 is a portion that is connected to an end in the plug wire direction of the inclined portion 424 and extends in the plug wire direction. The distance between the contact portion 425 of one of the contact beams 420 and the contact portion 425 of the other contact beam 420 is set to be smaller than the thickness of the receptacle 6. Due to the presence of the inclined portion 424 and the curved portion 423, the contact portion 425 is elastically deformable in the connector width anti-center direction.

(Receptacle 6)

Figure 29:
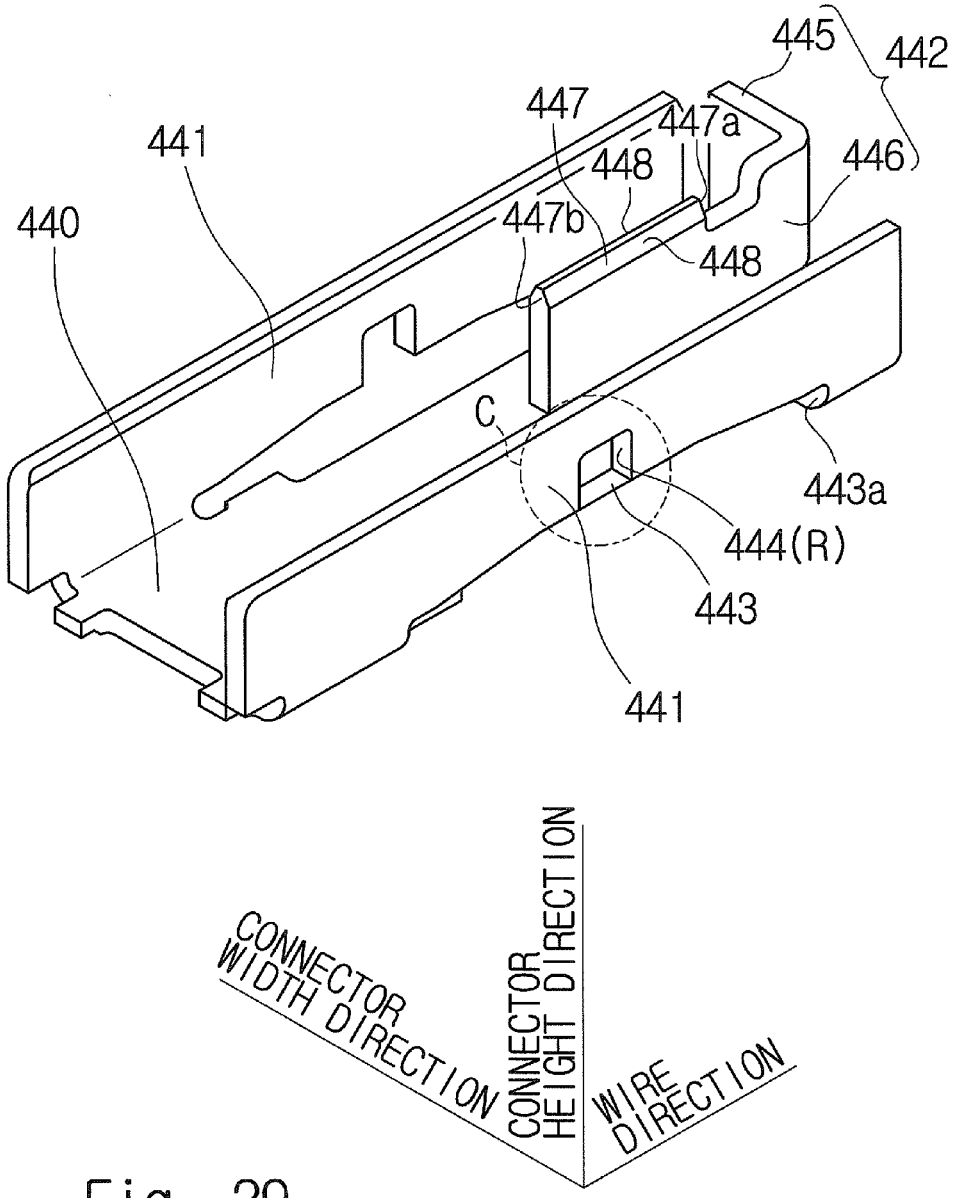
FIG. 29 is a perspective view of a receptacle (fifth embodiment)

As shown in FIG. 29, the receptacle 6 is formed to be elongated in the wire direction. The receptacle 6 includes a base plate portion 440, a pair of side plate portions 441, and a contact unit 442.

The base plate portion 440 is a portion that is soldered to the electrode pad 7 (see FIGS. 16 and 17) of the connector mounting surface 5 of the board 4. The base plate portion 440 is formed to be elongated in the wire direction. The base plate portion 440 is orthogonal to the connector height direction. Notches 443 which are opened in the connector width anti-center direction are respectively formed at both ends in the connector width direction of the base plate portion 440. The pair of notches 443 is formed at the center in the wire direction of the base plate portion 440. The base plate portion 440 includes a plug-side inner wall surface 443*a* which defines a space in the wire plug direction of the notches 443.

Figure 30:
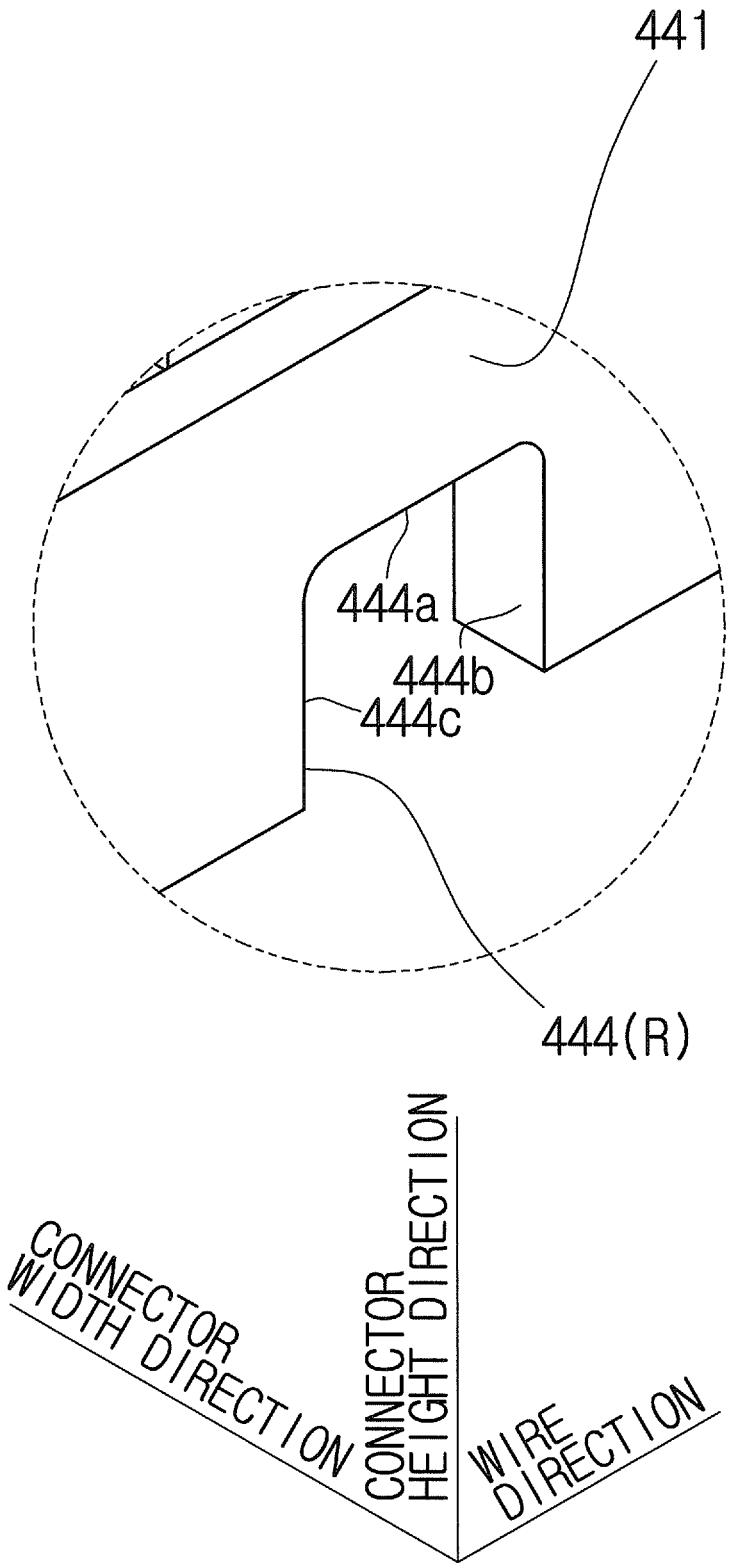
FIG. 30 is an enlarged view of a portion "C" shown in FIG. 29, in which illustration of a base plate portion is omitted for convenience of explanation (fifth embodiment)

The pair of side plate portions 441 is formed in a symmetrical shape in the connector width direction. Accordingly, only one of the pair will be described, and the description of the other one of the pair will be omitted. The side plate portion 441 is connected to an end in the plug wire direction of the base plate portion 440 and to an end in the wire plug direction thereof, and is formed so as to extend in the wire direction. The side plate portion 441 is positioned so as to be erected at a right angle with respect to the base plate portion 440. The side plate portion 441 is orthogonal to the connector width direction. The side plate portion 441 is elastically deformable so as to fall down in the connector width anti-center direction. At the center in the wire direction of the side plate portion 441, a lock notch portion 444 which is opened in the board approaching direction is formed. The lock notch portion 444 is formed at an end in the board approaching direction of the side plate portion 441. The lock notch portion 444 is formed in a rectangular shape when viewed along the connector width center direction. As shown in FIG. 30, the side plate portion 441 includes a lock surface 444*a* which defines a space in the board separating direction of the lock notch portion 444, a plug-side inner wall surface 444*b* which defines a space in the wire plug direction of the lock notch portion 444, and a wire-side inner wall surface 444*c* which defines a space in the plug wire direction of the lock notch portion 444. The lock surface 444*a* is orthogonal to the connector height direction. The plug-side inner wall surface 444*b* and the wire-side inner wall surface 444*c* are orthogonal to the wire direction. The length in the wire direction of the side plate portion 441 is substantially equal to the length in the wire direction of the base plate portion 440.

The contact unit 442 is a portion that functions as a contact with the plug 3. The contact unit 442 is supported by the base plate portion 440. The contact unit 442 includes a unit proximal end 445 and a contact piece 446. The unit proximal end 445 is a portion that is connected to an end in the wire plug direction of the base plate portion 440 and protrudes in the board separating direction. The unit proximal end 445 is connected to a portion on one side in the connector width direction of the end in the wire plug direction of the base plate portion 440. The unit proximal end 445 is orthogonal to the wire direction. The contact piece 446 is connected to an end in the connector width center direction of the unit proximal end 445, and is formed so as to extend in the plug wire direction. The contact piece 446 is orthogonal to the connector width direction. The contact piece 446 has a tapered portion 447 that protrudes in the board separating direction. The tapered portion 447 is formed at an end in the board separating direction of the contact piece 446. The tapered portion 447 is formed on a side in the plug wire direction of the contact piece 446. The tapered portion 447 has a pair of inclined surfaces 448 which is formed in such a manner that the tapered portion 447 is tapered in the board separating direction. The tapered portion 447 includes a plug-side end face 447*a* that faces in the wire plug direction, and a wire-side end face 447*b* that faces in the plug wire direction. Due to the presence of the unit proximal end 445 and the contact piece 446, the contact unit 442 forms an L-shape when viewed along the board approaching direction. The contact piece 446 of the contact unit 442 is formed so as to be away from the base plate portion 440. That is, the gap "h" (also see FIG. 23) is formed between the contact piece 446 of the contact unit 442 and the base plate portion 440. To put it briefly, the contact piece 446 is disposed at a location farther from the board 4 than the base plate portion 440.

(Mating Operation)

Figure 31:
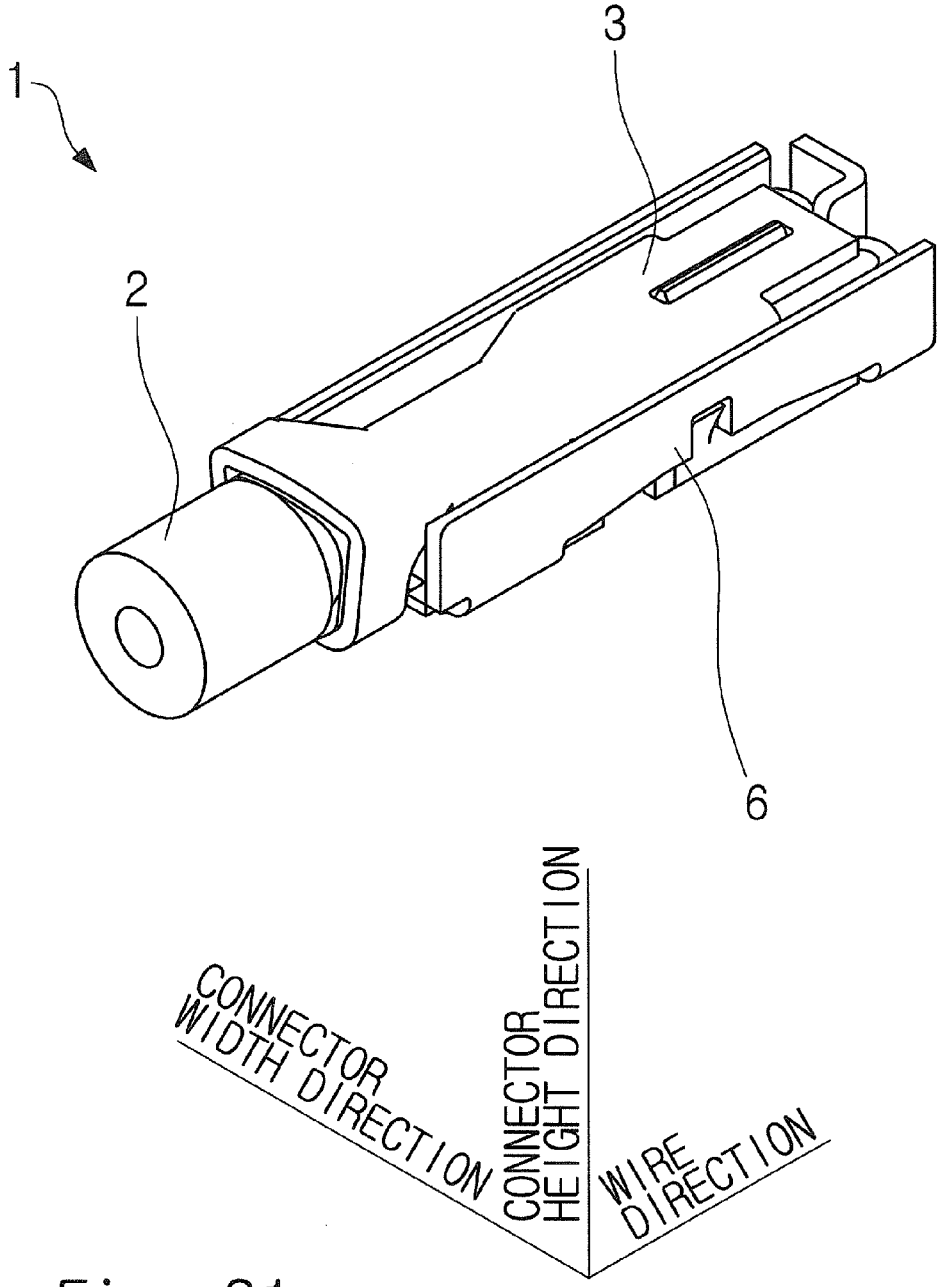
FIG. 31 is a perspective view of a wire-to-board connector in a state where the plug is attached to the receptacle (fifth embodiment)

Next, the mating operation for mating the plug 3 with the receptacle 6 will be described. For reference, FIG. 31 shows a state in which the plug 3 is mated with the receptacle 6.

First, as shown in FIG. 17, the wire 2 is attached to the plug 3, and the plug 3 is moved toward the receptacle 6. The direction of movement of the plug 3 toward the receptacle 6 is indicated by the above-mentioned mating direction P. At this time, the plug 3 is moved toward the receptacle 6 in such a manner that the side plate portions 422 of the pair of contact beams 420 of the plug body 412 of the plug 3 shown in FIG. 27 are fitted between the pair of side plate portions 441 of the receptacle 6 shown in FIG. 29.

Then, the pair of contact portions 425 shown in FIG. 27 contacts the pair of inclined surfaces 448 of the contact piece 446 shown in FIG. 29, and the pair of lock claw portions 426 shown in FIG. 27 contacts the pair of side plate portions 441 shown in FIG. 29.

In this state, when the plug 3 is pushed in the board approaching direction by using the base plate portion 419 of the plug body 412 shown in FIG. 27, the plug 3 and the receptacle 6 behave in the following manner.

(1) The contact piece 446 shown in FIG. 29 is inserted between the contact portions 425 of the pair of contact beams 420, while the pair of contact beams 420 shown in FIG. 27 is elastically deformed. As a result, the contact portions 425 of the pair of contact beams 420 of the plug 3 are allowed to reliably contact the contact piece 446 of the receptacle 6 by the spring restoring force of the contact beams 420.

(2) Eventually, the tapered portion 447 of the contact piece 446 shown in FIG. 29 is inserted into the slit 421 of the base plate portion 419 shown in FIG. 27. At this time, the plug-side end face 447*a* of the tapered portion 447 shown in FIG. 29 is opposed to the distal end inner wall surface 421*a* of the base plate portion 419 shown in FIG. 27. The wire-side end face 447*b* of the tapered portion 447 shown in FIG. 29 is opposed to the proximal end inner wall surface 421*b* of the base plate portion 419 shown in FIG. 27. As a result, the movement of the plug 3 in the wire direction relative to the receptacle 6 is constrained.

(3) The pair of lock claw portions 426 shown in FIG. 27 pushes out the pair of side plate portions 441 shown in FIG. 29, and the pair of side plate portions 441 is elastically displaced in the connector width anti-center direction. Then, when the pair of lock claw portions 426 enters into the lock notch portion 444, the pair of side plate portions 441 returns in the connector width center direction by the spring restoring force and the pair of lock claw portions 426 are respectively accommodated in the pair of lock notch portions 444. The distal end face 426*c* of the lock claw portion 426 shown in FIG. 28 is opposed to the lock surface 444*a* of the lock notch portion 444 shown in FIG. 30. As a result, the plug 3 is prevented from being disengaged from the receptacle 6 when the wire 2 is pulled in the board separating direction. In this embodiment, the lock mechanism R is implemented by the lock claw portions 426 shown in FIG. 27 and the lock notch portions 444 shown in FIG. 29.

(4) When the lock claw portion 426 is accommodated in the lock notch portion 444, the plug-side end face 426*a* of the lock claw portion 426 shown in FIG. 28 is opposed to the plug-side inner wall surface 444*b* of the lock notch portion 444 shown in FIG. 30. At the same time, the wire-side end face 426*b* of the lock claw portion 426 shown in FIG. 28 is opposed to the wire-side inner wall surface 444*c* of the lock notch portion 444 shown in FIG. 30. As a result, the movement of the plug 3 in the wire direction relative to the receptacle 6 is constrained.

(5) The protrusion 427 shown in FIG. 27 is accommodated in the notch 443 shown in FIG. 29, and the plug-side end face 427*a* of the protrusion 427 shown in FIG. 27 is opposed to the plug-side inner wall surface 443*a* of the notch 443 shown in FIG. 29. As a result, the movement of the plug 3 in the wire plug direction relative to the receptacle 6 is constrained.

Sixth Embodiment

Next, a sixth embodiment of the present invention will be described with reference to FIGS. 32 to 35. Here, differences between this embodiment and the fourth embodiment will be mainly described, while a repeat of previous descriptions is omitted as appropriate. Components corresponding to the components of the fourth embodiment described above are denoted by the same reference numerals as a rule.

(Plug 3)

Figure 32:
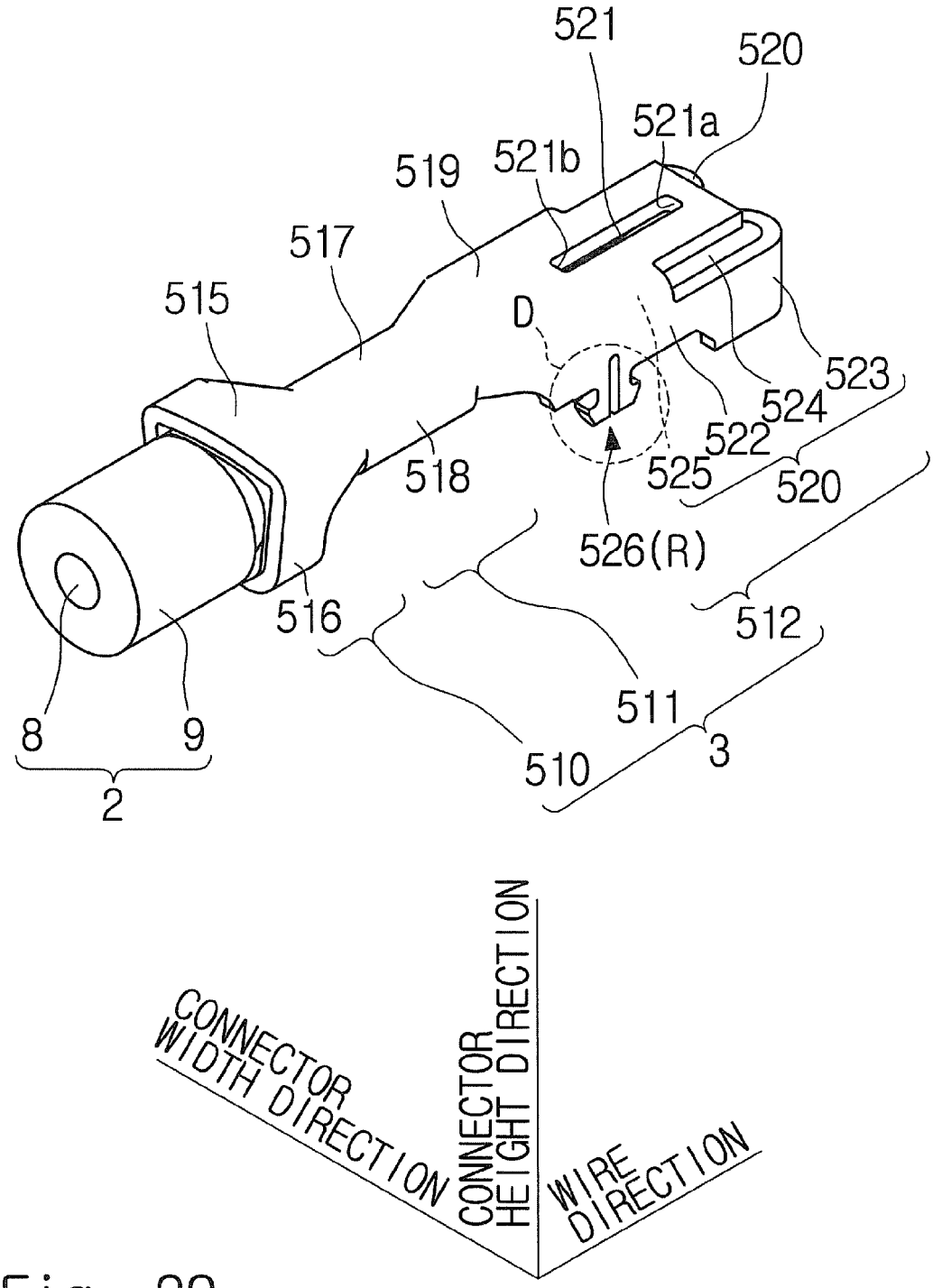
FIG. 32 is a perspective view of a plug (sixth embodiment)

FIG. 32 shows the plug 3 in a state where the wire 2 is attached to the plug 3. As shown in FIG. 32, the plug 3 is formed to be elongated along the wire direction. The plug 3 includes a wire holding portion 510, a wire connecting portion 511 (central conductor holding portion), and a plug body 512, which are formed in the stated order in the wire plug direction. The plug 3 is integrally formed with the wire holding portion 510, the wire connecting portion 511, and the plug body 512.

The wire holding portion 510 is a portion that crimps and holds the insulation 9 of the wire 2. The wire holding portion 510 includes a base plate portion 515 and a pair of holding portions 516. The base plate portion 515 is a flat plate-like portion orthogonal to the connector height direction. The pair of holding portions 516 are respectively connected to both ends in the connector width direction of the base plate portion 515, and protrude in the board approaching direction. An end in the board approaching direction of each holding portion 516 is bent by a dedicated crimp tool, and is thus curved in the connector width center direction.

The wire connecting portion 511 is a portion that crimps and holds the strand wire 8 of the wire 2. The wire connecting portion 511 is electrically connected to the strand wire 8 of the wire 2. The wire connecting portion 511 includes a base plate portion 517 and a pair of holding portions 518. The base plate portion 517 is a flat plate-like portion orthogonal to the connector height direction. The base plate portion 517 is connected to an end in the wire plug direction of the base plate portion 515 of the wire holding portion 510. The pair of holding portions 518 are respectively connected to both ends in the connector width direction of the base plate portion 517, and protrude in the board approaching direction. Each holding portion 518 is bent by a dedicated crimp tool, and is thus curved in a C-shape toward the connector width center direction. Each holding portion 518 is curved so as to swell out in the board approaching direction.

The plug body 512 includes a base plate portion 519, a pair of contact beams 520, and a pair of lock units 526.

The base plate portion 519 is a flat plate-like portion that is connected to an end in the wire plug direction of the base plate portion 517 of the wire connecting portion 511 and extends in the wire plug direction. The base plate portion 519 is orthogonal to the connector height direction. At the center in the connector width direction of the base plate portion 519, a slit 521 which extends in the wire direction is formed. The base plate portion 519 includes a distal end inner wall surface 521*a* which defines a space in the wire plug direction of the slit 521, and a proximal end inner wall surface 521*b* which defines a space in the plug wire direction of the slit 521.

The pair of contact beams 520 and the pair of lock units 526 are each formed in a symmetrical shape in the connector width direction. Accordingly, only one of each pair will be described, and the description of the other one of each pair will be omitted.

The contact beam 520 is a portion that functions as a contact with the receptacle 6. The contact beam 520 is formed in a beam shape. The contact beam 520 is formed in a cantilever shape. The contact beam 520 is a cantilever supported by the base plate portion 519. The contact beam 520 is connected to an end in the connector width direction of the base plate portion 519, and is positioned so as to be erected at a right angle with respect to the base plate portion 519. The contact beam 520 is a cantilever which is formed in a U-shape that is opened in the plug wire direction when viewed along the board separating direction. The contact beam 520 includes a side plate portion 522, a curved portion 523, an inclined portion 524, and a contact portion 525. The shape of each contact beam 520 is completely identical with the shape of the contact beam 320 of the fourth embodiment. As for the inclined portion 524 and the contact portion 525, also refer to the inclined portion 324 and the contact portion 325 shown in FIG. 19.

The side plate portion 522 is a portion that is connected to an end in the connector width direction of the base plate portion 519 and extends in the wire plug direction. The side plate portion 522 is orthogonal to the connector width direction.

The curved portion 523 is a portion that is connected to an end in the wire plug direction of the side plate portion 522 and is curved in a C-shape toward the connector width center direction.

The inclined portion 524 is a portion that is connected to an end on a side opposite to the side plate portion 522 of the curved portion 523 and extends in the plug wire direction. The inclined portion 524 is inclined in the connector width center direction toward the plug wire direction.

The contact portion 525 is a portion that is connected to an end in the plug wire direction of the inclined portion 524 and extends in the plug wire direction. The distance between the contact portion 525 of one of the contact beams 520 and the contact portion 525 of the other contact beam 520 is set to be smaller than the thickness of the receptacle 6. Due to the presence of the inclined portion 524 and the curved portion 523, the contact portion 525 is elastically deformable in the connector width anti-center direction.

Figure 33:
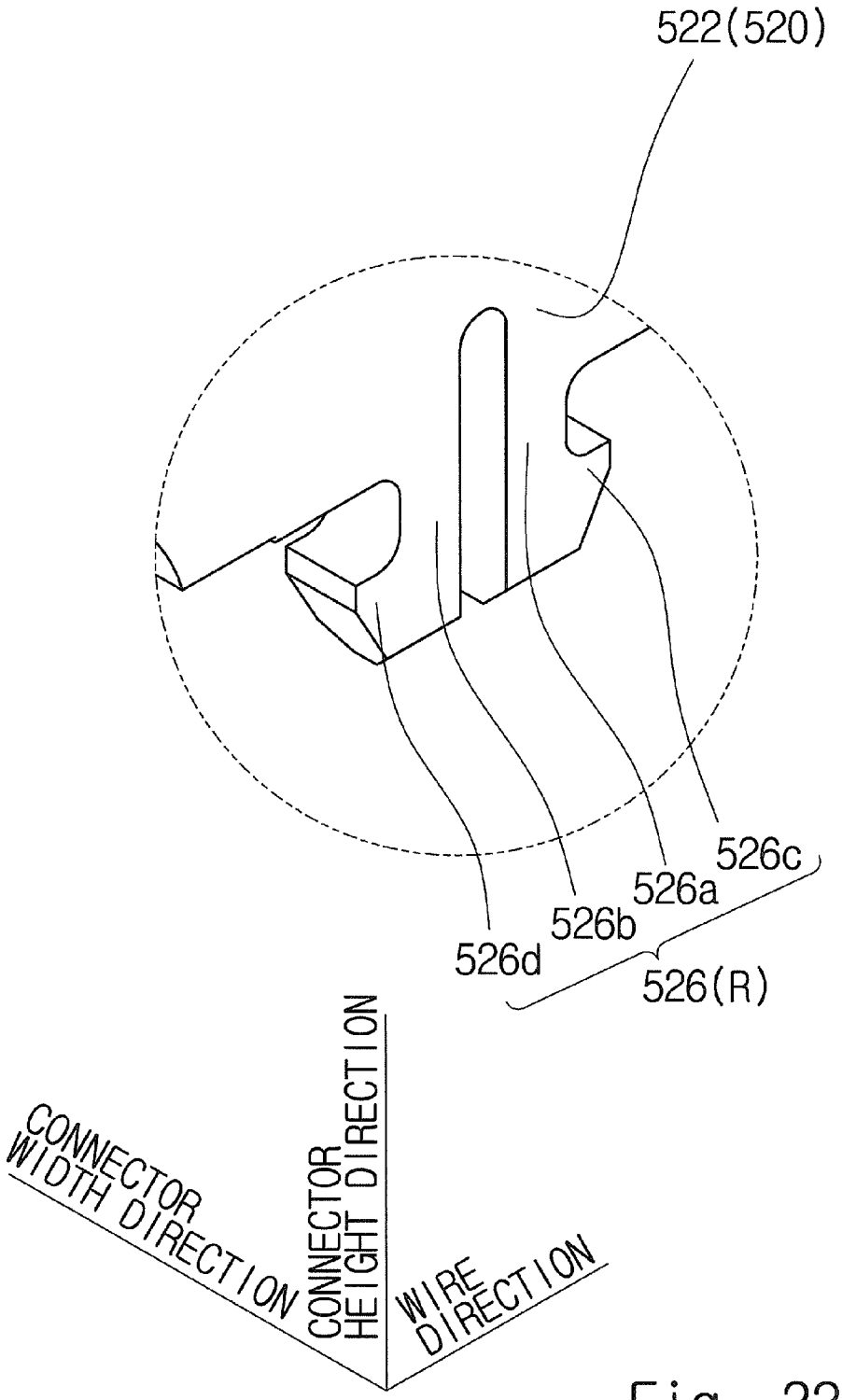
FIG. 33 is an enlarged view of a portion "D" shown in FIG. 32 (sixth embodiment)

As shown in FIG. 33, the lock unit 526 includes a lock beam 526*a*, a lock beam 526*b*, a claw portion 526*c*, and a claw portion 526*d*. The lock beam 526*a* and the lock beam 526*b* are cantilevers that are each connected to an end in the plug wire direction of the contact beam 520 and extend in the board approaching direction. The lock beam 526*a* is disposed at a location closer to a side in the wire plug direction than the lock beam 526*b*. The claw portion 526*c* is a portion that is connected to an end in the board approaching direction of the lock beam 526*a* and protrudes in the wire plug direction. The claw portion 526*d* is a portion that is connected to an end in the board approaching direction of the lock beam 526*b* and protrudes in the plug wire direction.

(Receptacle 6)

Figure 34:
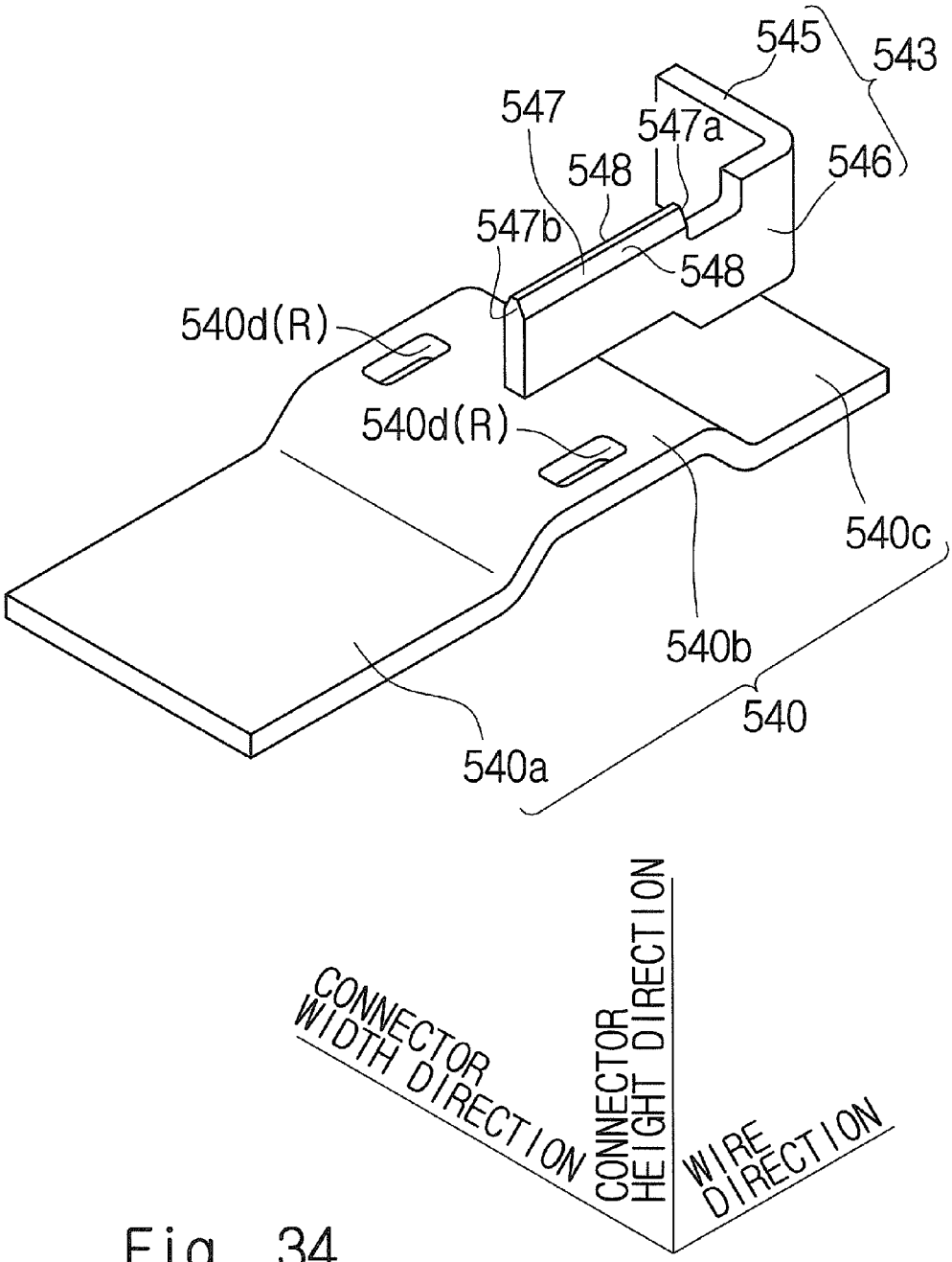
FIG. 34 is a perspective view of a receptacle (sixth embodiment)

As shown in FIG. 34, the receptacle 6 is formed to be elongated in the wire direction. The receptacle 6 includes a base plate portion 540 and a contact unit 543.

The base plate portion 340 is a portion that is soldered to the electrode pad 7 (see FIGS. 16 and 17) on the connector mounting surface 5 of the board 4. The base plate portion 540 is formed to be elongated in the wire direction. The base plate portion 540 includes a first soldered portion 540*a*, a lock plate portion 540*b*, and a second soldered portion 540*c*, which are formed in the stated order in the wire plug direction. The first soldered portion 540*a* is formed in a flat plate shape orthogonal to the connector height direction. The lock plate portion 540*b* is connected to an end in the wire plug direction of the first soldered portion 540*a*, is slightly raised in the board separating direction relative to the first soldered portion 540*a*, and is formed in a flat plate shape orthogonal to the connector height direction. A pair of lock hole portions 540*d* are respectively formed at both ends in the connector width direction of the lock plate portion 540*b*. The second soldered portion 540*c* is connected to an end in the wire plug direction of the lock plate portion 540*b*, is slightly recessed in the board approaching direction relative to the lock plate portion 540*b*, and is formed in a flat plate shape orthogonal to the connector height direction. The first soldered portion 540*a* and the second soldered portion 540*c* are soldered to the electrode pad 7 on the connector mounting surface 5 of the board 4.

The contact unit 543 is a portion that functions as a contact with the plug 3. The contact unit 543 is supported by the base plate portion 540. The contact unit 543 includes a unit proximal end 545 and a contact piece 546. The unit proximal end 545 is a portion that is connected to an end in the wire plug direction of the base plate portion 540 and protrudes in the board separating direction. The unit proximal end 545 is connected to a portion on one side in the connector width direction of the end in the wire plug direction of the base plate portion 540. The unit proximal end 545 is orthogonal to the wire direction. The contact piece 546 is connected to an end in the connector width center direction of the unit proximal end 545, and is formed so as to extend in the plug wire direction. The contact piece 546 is orthogonal to the connector width direction. The contact piece 546 has a tapered portion 547 that protrudes in the board separating direction. The tapered portion 547 is formed at an end in the board separating direction of the contact piece 546. The tapered portion 547 is formed on a side in the plug wire direction of the contact piece 546. The tapered portion 547 has a pair of inclined surfaces 548 which is formed in such a manner that the tapered portion 547 is tapered in the board separating direction. The tapered portion 547 includes a plug-side end face 547*a* that faces in the wire plug direction, and a wire-side end face 547*b* that faces in the plug wire direction. Due to the presence of the unit proximal end 545 and the contact piece 546, the contact unit 543 forms an L-shape when viewed along the board approaching direction. The contact piece 546 of the contact unit 543 is formed at a location apart from the base plate portion 540. That is, the gap "h" (also see FIG. 23) is formed between the contact piece 546 of the contact unit 543 and the base plate portion 540. To put it briefly, the contact piece 546 is disposed at a location farther from the board 4 than the base plate portion 540.

(Mating Operation)

Figure 35:
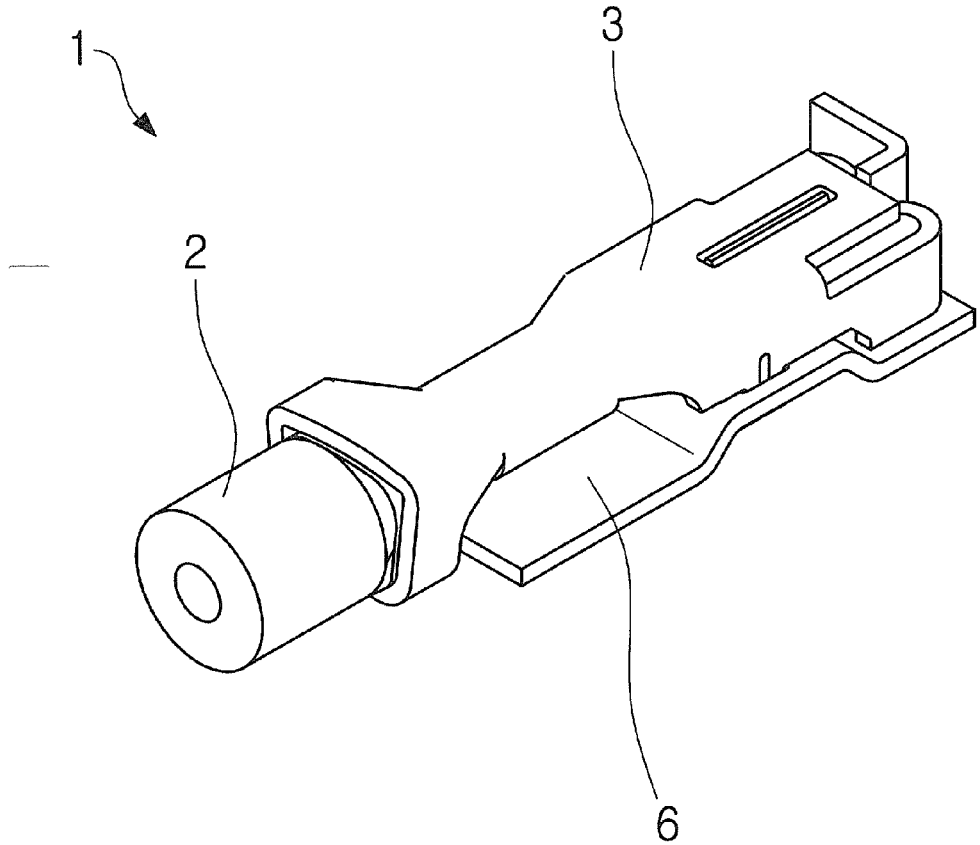
FIG. 35 is a perspective view of a wire-to-board connector in a state where the plug is attached to the receptacle (sixth embodiment)
Figure 35:
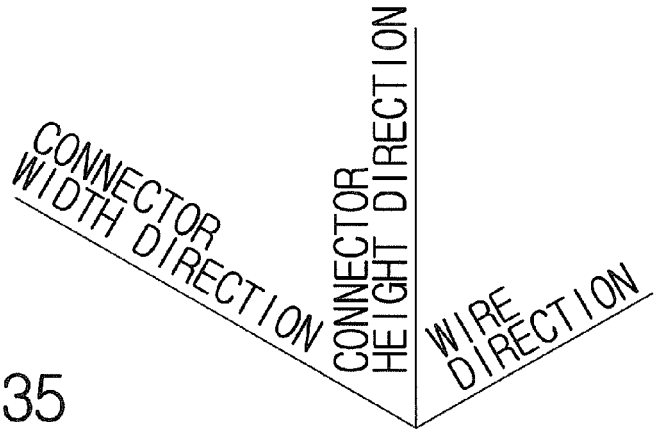
Figure 36:
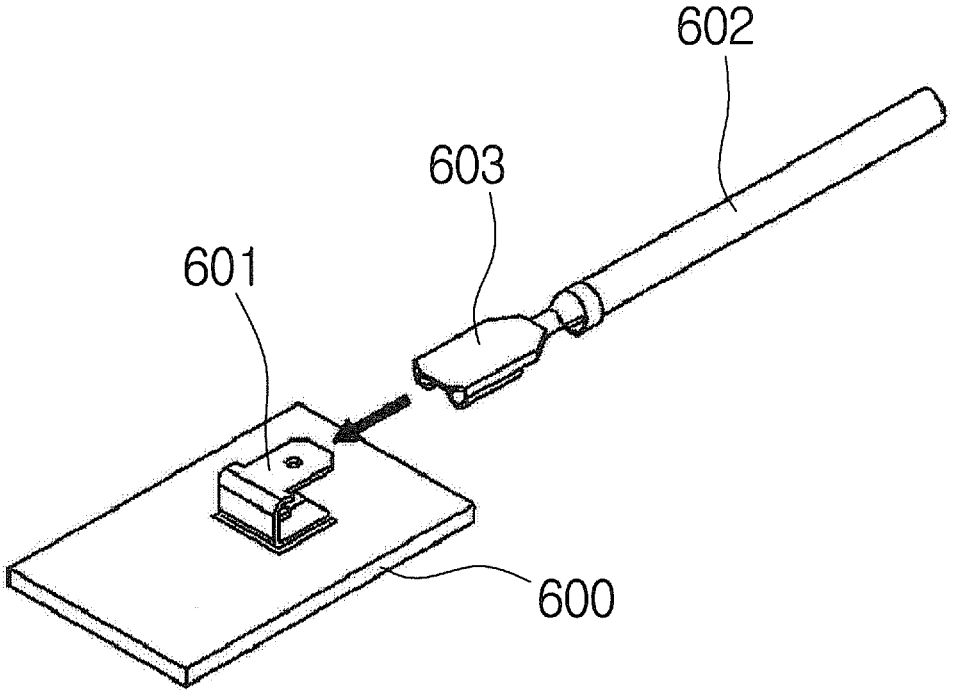
FIG. 36 is a diagram corresponding to FIG. 1 of Patent Literature 1.

Next, the mating operation for mating the plug 3 with the receptacle 6 will be described. For reference, FIG. 35 shows a state in which the plug 3 is mated with the receptacle 6.

First, as shown in FIG. 17, the wire 2 is attached to the plug 3, and the plug 3 is moved toward the receptacle 6. The direction of movement of the plug 3 toward the receptacle 6 is indicated the above-mentioned mating direction P. At this time, the plug 3 is moved toward the receptacle 6 in such a manner that the tapered portion 547 of the receptacle 6 shown in FIG. 34 is fitted between the contact portions 525 of the pair of contact beams 520 of the plug body 512 of the plug 3 shown in FIG. 32.

Then, the pair of contact portions 525 shown in FIG. 32 contacts the pair of inclined surfaces 548 of the contact piece 546 shown in FIG. 34, and the claw portion 526*c* and the claw portion 526*d* of each one of the pair of lock units 526 shown in FIG. 32 contact the base plate portion 540 in the state of being slightly inserted into the corresponding one of the pair of lock hole portions 540*d* shown in FIG. 34.

In this state, when the plug 3 is pushed in the board approaching direction by using the base plate portion 519 of the plug body 512 shown in FIG. 32, the plug 3 and the receptacle 6 behave in the following manner.

(1) The contact piece 546 shown in FIG. 34 is inserted between the contact portions 525 of the pair of contact beams 520, while the pair of contact beams 520 shown in FIG. 32 is elastically deformed. As a result, the contact portions 525 of the pair of contact beams 520 are allowed to reliably contact the contact piece 546 of the receptacle 6 by the spring restoring force of the contact beams 520.

(2) Eventually, the tapered portion 547 of the contact piece 546 shown in FIG. 34 is inserted into the slit 521 of the base plate portion 519 shown in FIG. 32. At this time, the plug-side end face 547*a* of the tapered portion 547 shown in FIG. 34 is opposed to the distal end inner wall surface 521*a* of the base plate portion 519 shown in FIG. 32. The wire-side end face 547*b* of the tapered portion 547 shown in FIG. 34 is opposed to the proximal end inner wall surface 521*b* of the base plate portion 519 shown in FIG. 32. As a result, the movement of the plug 3 in the wire direction relative to the receptacle 6 is constrained.

(3) The pair of lock units 526 shown in FIG. 32 are respectively inserted into the pair of lock hole portions 540*d* shown in FIG. 34, thereby allowing the claw portion 526*c* and the claw portion 526*d* to be caught on the lock plate portion 540*b* of the base plate portion 540. As a result, the plug 3 is prevented from being disengaged from the receptacle 6 when the wire 2 is pulled in the board separating direction. In this embodiment, the lock mechanism R is implemented by the lock units 526 shown in FIG. 32 and the lock hole portions 540*d* shown in FIG. 34.

This application is based upon and claims the benefit of priority from Japanese patent application No. 2012-074033, filed on Mar. 28, 2012, the disclosure of which is incorporated herein in its entirety by reference.

REFERENCE SIGNS LIST

1 WIRE-TO-BOARD CONNECTOR
2 WIRE
3 PLUG (FIRST TERMINAL)
4 BOARD
5 CONNECTOR MOUNTING SURFACE
6 RECEPTACLE (SECOND TERMINAL)
7 ELECTRODE PAD
8 STRAND WIRE (CENTRAL CONDUCTOR)
9 INSULATION
10 WIRE HOLDING PORTION
11 WIRE CONNECTING PORTION (CENTRAL CONDUCTOR HOLDING PORTION)
12 PLUG BODY
15 BASE PLATE PORTION
16 HOLDING PORTION
17 BASE PLATE PORTION
18 HOLDING PORTION
19 BASE PLATE PORTION
20 ERECT ROD GUIDE PORTION
22 ERECT ROD GUIDE HOLE PORTION (GUIDE HOLE PORTION)
23 CONTACT BEAM
23*a* PROXIMAL END
23*b* INCLINED PORTION
23*c* DISTAL END
24 PUSHING PLATE PORTION
25 CONTACT PIECE GUIDE PORTION
40 BASE PLATE PORTION
41 SIDE PLATE PORTION
42 ERECT ROD (GUIDE ROD PORTION)
43 CONTACT UNIT
44 GUIDE INCLINED PORTION (INCLINED PORTION)
45 UNIT PROXIMAL END
46 UNIT INTERMEDIATE PORTION
47 CONTACT PIECE
48 INCLINED SURFACE
49 LOCK UNIT
50 LOCK BEAM
51 CLAW PORTION
51*a* INCLINED SURFACE
140 BASE PLATE PORTION
141 SIDE PLATE PORTION
142 ERECT ROD (GUIDE ROD PORTION)
143 CONTACT UNIT
144 GUIDE INCLINED PORTION (INCLINED PORTION)
145 UNIT PROXIMAL END
146 UNIT INTERMEDIATE PORTION
147 CONTACT PIECE
148 INCLINED SURFACE
149 LOCK UNIT
153 STANDING PORTION
154 CURVED PORTION
155 INCLINED PORTION
155*a* INCLINED SURFACE
210 WIRE HOLDING PORTION
211 WIRE CONNECTING PORTION (CENTRAL CONDUCTOR HOLDING PORTION)
212 PLUG BODY
215 BASE PLATE PORTION
216 HOLDING PORTION
217 BASE PLATE PORTION
218 HOLDING PORTION
219 BASE PLATE PORTION
220 PUSHING PLATE PORTION
222 ERECT ROD GUIDE HOLE PORTION (GUIDE HOLE PORTION)
223 CONTACT BEAM
223*a* PROXIMAL END
223*b* INCLINED PORTION
223*c* DISTAL END
224 ERECT ROD GUIDE PORTION
224*a* NOTCH
225 LOCK UNIT
226 CONTACT PIECE GUIDE PORTION
227 LOCK BEAM
228 CLAW PORTION
240 BASE PLATE PORTION
240*a* FIRST SOLDERED PORTION
240*b* LOCK PLATE PORTION
240*c* SECOND SOLDERED PORTION
240*d* LOCK HOLE PORTION
241 SIDE PLATE PORTION
242 ERECT ROD (GUIDE ROD PORTION)
243 CONTACT UNIT
245 UNIT PROXIMAL END
246 UNIT INTERMEDIATE PORTION
247 CONTACT PIECE
248 INCLINED SURFACE
310 WIRE HOLDING PORTION
311 WIRE CONNECTING PORTION (CENTRAL CONDUCTOR HOLDING PORTION)
312 PLUG BODY
315 BASE PLATE PORTION
316 HOLDING PORTION

317 BASE PLATE PORTION
318 HOLDING PORTION
319 BASE PLATE PORTION
320 CONTACT BEAM
321 SLIT
321*a* DISTAL END INNER WALL SURFACE
321*b* PROXIMAL END INNER WALL SURFACE
322 SIDE PLATE PORTION
323 CURVED PORTION
324 INCLINED PORTION
325 CONTACT PORTION
326 LOCK HOLE PORTION
326*a* BOARD-SIDE INNER WALL SURFACE
326*b* PLUG-SIDE INNER WALL SURFACE
326*c* WIRE-SIDE INNER WALL SURFACE
327 PROTRUSION
327*a* PLUG-SIDE END FACE
327*b* WIRE-SIDE END FACE
340 BASE PLATE PORTION
341 LOCK BEAM
342 CONTACT UNIT
343 NOTCH
343*a* PLUG-SIDE INNER WALL SURFACE
343*b* WIRE-SIDE INNER WALL SURFACE
344 LOCK RAISED PORTION
344*a* PLUG-SIDE END FACE
344*b* BOARD-SIDE END FACE
345 UNIT PROXIMAL END
346 CONTACT PIECE
347 TAPERED PORTION
347*a* PLUG-SIDE END FACE
347*b* WIRE-SIDE END FACE
348 INCLINED SURFACE
410 WIRE HOLDING PORTION
411 WIRE CONNECTING PORTION (CENTRAL CONDUCTOR HOLDING PORTION)
412 PLUG BODY
415 BASE PLATE PORTION
416 HOLDING PORTION
417 BASE PLATE PORTION
418 HOLDING PORTION
419 BASE PLATE PORTION
420 CONTACT BEAM
421 SLIT
421*a* DISTAL END INNER WALL SURFACE
421*b* PROXIMAL END INNER WALL SURFACE
422 SIDE PLATE PORTION
423 CURVED PORTION
424 INCLINED PORTION
425 CONTACT PORTION
426 LOCK CLAW PORTION
426*a* PLUG-SIDE END FACE
426*b* WIRE-SIDE END FACE
426*c* DISTAL END FACE
427 PROTRUSION
427*a* PLUG-SIDE END FACE
440 BASE PLATE PORTION
441 SIDE PLATE PORTION
442 CONTACT UNIT
443 NOTCH
443*a* PLUG-SIDE INNER WALL SURFACE
444 LOCK NOTCH PORTION
444*a* LOCK SURFACE
444*b* PLUG-SIDE INNER WALL SURFACE
444*c* WIRE-SIDE INNER WALL SURFACE
445 UNIT PROXIMAL END
446 CONTACT PIECE
447 TAPERED PORTION
447*a* PLUG-SIDE END FACE
447*b* WIRE-SIDE END FACE
448 INCLINED SURFACE
510 WIRE HOLDING PORTION
511 WIRE CONNECTING PORTION (CENTRAL CONDUCTOR HOLDING PORTION)
512 PLUG BODY
515 BASE PLATE PORTION
517 BASE PLATE PORTION
518 HOLDING PORTION
519 BASE PLATE PORTION
520 CONTACT BEAM
521 SLIT
521*a* DISTAL END INNER WALL SURFACE
521*b* PROXIMAL END INNER WALL SURFACE
522 SIDE PLATE PORTION
523 CURVED PORTION
524 INCLINED PORTION
525 CONTACT PORTION
526 LOCK UNIT
526*a* LOCK BEAM
526*b* LOCK BEAM
526*c* CLAW PORTION
526*d* CLAW PORTION
540 BASE PLATE PORTION
540*a* FIRST SOLDERED PORTION
540*b* LOCK PLATE PORTION
540*c* SECOND SOLDERED PORTION
540*d* LOCK HOLE PORTION
543 CONTACT UNIT
545 UNIT PROXIMAL END
546 CONTACT PIECE
547 TAPERED PORTION
547*a* PLUG-SIDE END FACE
547*b* WIRE-SIDE END FACE
548 INCLINED SURFACE
g GAP
h GAP
i GAP
P MATING DIRECTION
R LOCK MECHANISM
s SLIT

The invention claimed is:

1. A wire-to-board connector comprising:

a first terminal that is attached to a wire; and a second terminal that is mounted on a connector mounting surface of a board, the first terminal and the second terminal being each formed of metal, the first terminal being mated with the second terminal to thereby connect the wire to the board, wherein when the first terminal is mated with the second terminal, a wire direction corresponding to a longitudinal direction of the wire in the vicinity of the first terminal is parallel to the connector mounting surface of the board, a mating direction in which the first terminal is mated with the second terminal is a direction approaching the connector mounting surface of the board, the second terminal includes a guide rod portion extending so as to be away from the connector mounting surface of the board, and the first terminal has a guide hole portion into which the guide rod portion is inserted.

2. A wire-to-board connector comprising:

a first terminal that is attached to a wire; and a second terminal that is mounted on a connector mounting surface of a board, the first terminal and the second terminal being each formed of metal, the first terminal being mated with the second terminal to thereby connect the wire to the board, wherein when the first terminal is mated with the second terminal, a wire direction corresponding to a longitudinal direction of the wire in the vicinity of the first terminal is parallel to the connector mounting surface of the board, a mating direction in which the first terminal is mated with the second terminal is a direction approaching the connector mounting surface of the board, the first terminal includes a pair of contact beams having a beam shape, the first terminal further includes a guide hole portion into which a guide rod is inserted, and the second terminal includes a contact piece that is inserted between the pair of contact beams.

3. The wire-to-board connector according to claim 2, wherein the pair of contact beams is formed in a cantilever shape.

4. The wire-to-board connector according to claim 2, wherein the first terminal includes a pushing plate portion disposed opposite to the board with the pair of contact beams interposed therebetween.

5. A wire-to-board connector comprising:

a first terminal that is attached to a wire; and a second terminal that is mounted on a connector mounting surface of a board, the first terminal and the second terminal being each formed of metal, the first terminal being mated with the second terminal to thereby connect the wire to the board, wherein when the first terminal is mated with the second terminal, a wire direction corresponding to a longitudinal direction of the wire in the vicinity of the first terminal is parallel to the connector mounting surface of the board, a mating direction in which the first terminal is mated with the second terminal is a direction approaching the connector mounting surface of the board, the second terminal includes:

a base plate portion opposed to the connector mounting surface of the board; and a pair of side plate portions that sandwich the first terminal mated with the second terminal in a wire orthogonal direction orthogonal to the wire direction, the first terminal includes a pair of contact beams having a beam shape, the second terminal includes a contact piece that is inserted between the pair of contact beams, and the contact piece is supported by one of the pair of side plate portions.

6. A wire-to-board connector comprising:

a first terminal that is attached to a wire; and a second terminal that is mounted on a connector mounting surface of a board, the first terminal and the second terminal being each formed of metal, the first terminal being mated with the second terminal to thereby connect the wire to the board, wherein when the first terminal is mated with the second terminal, a wire direction corresponding to a longitudinal direction of the wire in the vicinity of the first terminal is parallel to the connector mounting surface of the board, a mating direction in which the first terminal is mated with the second terminal is a direction approaching the connector mounting surface of the board, the second terminal includes:

a base plate portion opposed to the connector mounting surface of the board; and a pair of side plate portions that sandwich the first terminal mated with the second terminal in a wire orthogonal direction orthogonal to the wire direction, at least one of the first terminal and the second terminal has a lock mechanism that prevents disengagement of the first terminal from the second terminal, the second terminal further includes:

a pair of lock beams that are respectively supported by the pair of side plate portions and extend in a beam shape in the wire direction; and a pair of claw portions that are respectively supported by the pair of lock beams and protrude so as to approach each other, the first terminal is formed to be caught on the pair of claw portions of the second terminal when the first terminal is mated with the second terminal, and the pair of lock beams and the pair of claw portions constitute the lock mechanism.

7. The wire-to-board connector according to claim 6, wherein the first terminal includes a conductor holding portion that holds a conductor of the wire, and the conductor holding portion of the first terminal is formed to be caught on the pair of claw portions of the second terminal when the first terminal is mated with the second terminal.

8. A wire-to-board connector comprising:

a first terminal that is attached to a wire; and a second terminal that is mounted on a connector mounting surface of a board, the first terminal and the second terminal being each formed of metal, the first terminal being mated with the second terminal to thereby connect the wire to the board, wherein when the first terminal is mated with the second terminal, a wire direction corresponding to a longitudinal direction of the wire in the vicinity of the first terminal is parallel to the connector mounting surface of the board, a mating direction in which the first terminal is mated with the second terminal is a direction approaching the connector mounting surface of the board, the second terminal includes:

a base plate portion opposed to the connector mounting surface of the board;

a pair of side plate portions that sandwich the first terminal mated with the second terminal in a wire orthogonal direction orthogonal to the wire direction, and a pair of inclined portions which are respectively connected to the pair of side plate portions and are inclined so as to be gradually spaced apart from each other in a direction away from the connector mounting surface of the board.

* * * * *